US007717580B2

(12) United States Patent
Takata et al.

(10) Patent No.: US 7,717,580 B2
(45) Date of Patent: May 18, 2010

(54) RELAY CONNECTOR, MOUNTING STRUCTURE OF RELAY CONNECTOR AND CHASSIS, AND MOUNTING STRUCTURE OF RELAY CONNECTOR AND DISCHARGE TUBE

(75) Inventors: Yoshiki Takata, Suzuka (JP); Kenichi Iwamoto, Kobe (JP); Takaaki Kudo, Shibuya-ku (JP); Naofumi Ikenaga, Shibuya-ku (JP)

(73) Assignees: Sharp Kabushiki Kaisha, Osaka (JP); Japan Aviation Electronics Industry Ltd., Tokyo (JP)

( * ) Notice: Subject to any disclaimer, the term of this patent is extended or adjusted under 35 U.S.C. 154(b) by 0 days.

(21) Appl. No.: 12/642,297

(22) Filed: Dec. 18, 2009

(65) Prior Publication Data

US 2010/0091481 A1 Apr. 15, 2010

Related U.S. Application Data

(63) Continuation of application No. 12/305,373.

(30) Foreign Application Priority Data

Jun. 30, 2006 (JP) ..... 2006-181540
Jan. 30, 2007 (JP) ..... 2007-019921

(51) Int. Cl.
*G09F 13/04* (2006.01)

(52) U.S. Cl. ..... 362/97.1

(58) Field of Classification Search ..... 362/97.1, 362/97.2, 217.01, 217.14, 217.02, 217.08, 362/217.13, 640, 257
See application file for complete search history.

(56) References Cited

U.S. PATENT DOCUMENTS

2005/0226002 A1 10/2005 Aoki et al.
2006/0279957 A1 12/2006 Kwon et al.
2007/0286629 A1 * 12/2007 Kwon et al. ..... 399/69

FOREIGN PATENT DOCUMENTS

JP 5-34329 Y2 8/1993
JP 7-326448 A 12/1995
JP 2000-164304 A 6/2000

(Continued)

OTHER PUBLICATIONS

Takata et al.; "Relay Connector, Mounting Structure of Relay Connector and Chassis, and Mounting Structure of Relay Connector and Discharge Tube"; U.S. Appl. No. 12/305,373, filed Dec. 18, 2008.

(Continued)

*Primary Examiner*—Phuong K Dinh
(74) *Attorney, Agent, or Firm*—Keating & Bennett, LLP

(57) ABSTRACT

Relay connectors are arranged to supply power from power boards arranged on the back side of a chassis having a substantially plate-shaped configuration to discharge tubes arranged on the front side of the chassis. Each relay connector includes a holder having an insulation property and to be mounted to the chassis, and further includes a relay terminal mounted to the holder and capable of electrical connection to the discharge tube and the power board. The relay terminal is immune to direct contact with the chassis. This enables the use of a metallic chassis.

22 Claims, 43 Drawing Sheets

FOREIGN PATENT DOCUMENTS

| | | | |
|---|---|---|---|
| JP | 2002-367422 | A | 12/2002 |
| JP | 2004-294592 | A | 10/2004 |
| JP | 2005-302533 | A | 10/2005 |
| JP | 2006-93011 | A | 4/2006 |
| JP | 2006-344602 | A | 12/2006 |

OTHER PUBLICATIONS

"Publication of Japan Institute of Invention and Innovation of No. 2006-501678", Mar. 17, 2006.

Takata et al., "Discharge Tube, Ferrule, Lighting Device, Display Device and Television Receiver," U.S. Appl. No. 12/305,371, filed Dec. 18, 2008.

Takata et al., "Backlight Module, Backlight Module Manufacturing Method, Lighting Device, Display Device and Television Receiver," U.S. Appl. No. 12/305,372, filed Dec. 18, 2008.

Takata et al., "Discharge Tube, Ferrule, Lighting Device, Display Device and Television Receiver," U.S. Appl. No. 12/305,374, filed Dec. 18, 2008.

Takata et al., "Power Board, On-Board Connector, Lighting Device, Display Device and Television Receiver," U.S. Appl. No. 12/305,377, filed Dec. 18, 2008.

Takata et al., "Power Board, On-Board Connector, Lighting Device, Display Device and Television Receiver," U.S. Appl. No. 12/305,378, filed Dec. 18, 2008.

Takata et al., "Discharge Tube, Ferrule, Lighting Device, Display Device and Television Receiver," U.S. Appl. No. 12/358,303, filed Jan. 23, 2009.

Takata et al., "Discharge Tube, Ferrule, Lighting Device, Display Device and Television Receiver," U.S. Appl. No. 12/642,194, filed Dec. 18, 2009.

Takata et al., "Discharge Tube, Ferrule, Lighting Device, Display Device and Television Receiver," U.S. Appl. No. 12/642,043, filed Dec. 18, 2009.

Takata et al., "Discharge Tube, Ferrule, Lighting Device, Display Device and Television Receiver," U.S. Appl. No. 12/645,738, filed Dec. 23, 2009.

* cited by examiner

RELAY CONNECTOR, MOUNTING STRUCTURE OF RELAY CONNECTOR AND CHASSIS, AND MOUNTING STRUCTURE OF RELAY CONNECTOR AND DISCHARGE TUBE

BACKGROUND OF THE INVENTION

1. Field of the Invention

The present invention relates to a relay connector, a mounting structure of a relay connector and a chassis, and a mounting structure of a relay connector and a discharge tube.

2. Description of the Related Art

An example of a lighting device capable of functioning as a backlight for a liquid crystal display device is disclosed in JP-A-2004-294592. The lighting device has a construction in which a plurality of elongated discharge tubes are connected to first ends of relay terminals mounted to a substantially flat plate-shaped chassis while power sources are connected to the other ends of the relay terminals. The power from the power sources is supplied to the discharge tubes via the relay terminals.

In the above construction, bare relay terminals are directly mounted to the chassis. This precludes the use of a metallic chassis.

SUMMARY OF THE INVENTION

In view of the foregoing circumstances, preferred embodiments of the present invention provide a relay connector, which is arranged to define a power supply path from a power source to a discharge tube, to be mounted to a metallic chassis.

A relay connector according to a preferred embodiment of the present invention, which is arranged to supply power from a power source arranged on the back side of a chassis having a substantially plate-shaped configuration to a discharge tube arranged on the front side of the chassis, includes a holder having an insulation property and to be mounted to the chassis, and further includes a relay terminal mounted to the holder and capable of electrical connection to the discharge tube and the power source.

According to a preferred embodiment of the present invention, the relay terminal is immune to direct contact with the chassis. This enables the use of a metallic chassis.

In the relay connector according to a preferred embodiment of the present invention described above, the holder can be arranged to penetrate through a mounting hole of the chassis. An elastic retaining portion capable of elastic deflection and an engaging surface capable of being arranged to be substantially perpendicular to the through direction of the mounting hole may be provided on an outer surface of the holder, so that the holder can be fixed to the chassis while the chassis is sandwiched between the elastic retaining portion and the engaging surface.

In this case, the elastic retaining portion deflects elastically, when the holder is inserted into the mounting hole. When the holder has reached the proper mounting position so that the engaging surface abuts on the opening edge of the mounting hole, the elastic retaining portion is locked by the opening edge of mounting hole as a result of its elastic restoration. According to a preferred embodiment of the present invention, the relay connector can be mounted to the chassis simply by inserting the holder into the mounting hole.

In the relay connector according to a preferred embodiment of the present invention described above, a travel restricting portion, capable of abutting an opening edge of the mounting hole when the holder is mounted to the chassis, may be provided on the outer surface of the holder on which the elastic retaining portion is provided.

The elastic retaining portion can deform elastically so as to approach the outer surface of the holder. The elastic deformation of the elastic retaining portion may cause movement of the holder relative to the chassis. However, according to the above construction, the movement of the holder relative to the chassis can be restricted due to the travel restricting portion abutting the opening edge of the mounting hole.

In the relay connector according to a preferred embodiment of the present invention described above, a surface of the elastic retaining portion, which can abut on the opening edge of the mounting hole, may include an inclined surface capable of being arranged at an angle to the thickness direction of the chassis.

In this case, the surface of the elastic retaining portion, which can abut the opening edge of the mounting hole, preferably includes an inclined surface that can be arranged at an angle to the thickness direction of the chassis. Thereby, the chassis can be infallibly sandwiched between the elastic retaining portion and the engaging surface, even if the chassis has variations in thickness.

In the relay connector according to a preferred embodiment of the present invention described above, a container room capable of holding an end portion of the discharge tube may be provided in the holder, so that a tube connecting portion of the relay terminal is arranged in the container room. The tube connecting portion can be electrically connected to the discharge tube within the container room.

In this case, the connection between the discharge tube and the relay connector is housed within the container room, and therefore foreign substances can be prevented from interference with the connection.

In the relay connector according to a preferred embodiment of the present invention described above, in a case where the mounting direction of the discharge tube to the container room is set to be perpendicular or substantially perpendicular to the axis of the discharge tube, and a ferrule attached to the end portion of the discharge tube is held in the container room when the discharge tube is mounted; a movement restricting portion, capable of locking the ferrule so that axial movement of the discharge tube in a direction away from the container room is restricted, may be provided in the container room.

In this case, the movement of the discharge tube can be restricted due to the movement restricting portion locking the ferrule, even if the discharge tube moves in the axial direction so as to escape from the container room.

In the relay connector according to a preferred embodiment of the present invention described above, an extended portion, capable of being arranged to protrude from between the chassis and an opening edge of the container room and extend along the surface of the chassis, may be provided on an outer surface of the holder that is arranged perpendicularly or substantially perpendicular to the surface of the chassis and includes an opening of the container room.

In this case, the extended portion protruding from the outer surface of the holder is provided, which can result in a long creepage distance from the inside of the container room to the chassis. As a result, a leak, from the discharge tube held in the container room to the chassis outside the holder, can be prevented.

In the relay connector according to a preferred embodiment of the present invention described above, a tapered guiding portion, inclined from the mounting direction of the discharge tube, may be arranged on the holder, so as to extend from an opening edge of an opening provided as a receiving opening of the container room for receiving the discharge tube.

In this case, the tapered guiding portion can guide the discharge tube into the container room.

In the relay connector according to a preferred embodiment of the present invention described above, in a case where the power source includes an on-board connector mounted on the back surface of a circuit board that is to be arranged parallel or substantially parallel to the chassis so that the back surface is on the opposite side of the chassis, and further includes an output terminal arranged in an engaging recess that is formed on the on-board connector so as to correspond to a fitting hole formed through the circuit board; a wall portion, capable of projecting to the back side of the chassis and penetrating through the fitting hole so as to be inserted into the engaging recess, may be provided on the holder. A board connecting portion capable of connection to the output terminal can be provided on the relay terminal so as to extend along the wall portion.

In this case, the board connecting portion of the relay terminal can penetrate through the fitting hole of the circuit board so as to be connected to the output terminal within the engaging recess. Thus, the fitting hole formed as a through hole on the circuit board enables the on-board connector to be arranged on the back surface of the circuit board on the opposite side of the chassis. Further, the board connecting portion is arranged along the wall portion. As a result, the board connecting portion is prevented from being deformed or damaged, which is caused by interference from a foreign substance.

In the relay connector according to a preferred embodiment of the present invention described above, in a case where the output terminal includes a proximal portion arranged so that its displacement from the circuit board is restricted, a flexible portion extending from the proximal portion and being capable of elastic deflection, and a connecting portion having a substantially U-shaped configuration that extends from the flexible portion and can elastically pinch the wall portion and the board connecting portion, the board connecting portion when being inserted into the engaging recess can have elastic contact with a free-end-side strip portion of two strip portions of the connecting portion on the opposite side of the flexible portion, while the wall portion can have elastic contact with a strip portion of the two strip portions of the connecting portion on the side of the flexible portion.

In this case, if the board connecting portion of the relay terminal displaces from the output terminal to the flexible portion side, the whole connecting portion, together with the board connecting portion and the wall portion, moves to the flexible portion side while the connection between the board connecting portion and the free-end-side strip portion is maintained. If the board connecting portion displaces from the output terminal to the free end side or to the opposite side of the flexible portion, the free-end-side strip portion of the connecting portion is pushed by the board connecting portion so as to move to the free end side. Then, the connection between the board connecting portion and the free-end-side strip portion is also maintained.

In the relay connector according to a preferred embodiment of the present invention described above, in a case where the power source includes a plurality of output terminals which are arranged in a line on a circuit board so as to correspond to a plurality of relay terminals as the above relay terminal, and the output terminal includes a connecting portion that is elongated in a direction substantially perpendicular to the array direction of the relay terminals and the output terminals, a board connecting portion, having a plate-shaped configuration that is wider than the connecting portion and capable of being arranged parallel or substantially parallel to the array direction of the relay terminals and the output terminals, may be provided on the relay terminal. The board connecting portion can have contact with the connecting portion.

In the construction that includes a plurality of output terminals and a plurality of relay terminals arranged in lines, the output terminals may be displaced in the array direction from the relay terminals due to some reason such as the difference in thermal expansion rate between the circuit board as a mounting base for the output terminals and the chassis as a mounting base for the relay terminals.

For this reason, according to a preferred embodiment of the present invention, the connecting portion is arranged on the output terminal so as to be elongated in a direction substantially perpendicular to the array direction, while the board connecting portion is arranged on the relay terminal so as to define a plate-shaped configuration that is wider than the connecting portion and arranged parallel or substantially parallel to the array direction, so that the wide board connecting portion can have contact with the elongated connecting portion. The board connecting portion is preferably large in width along the array direction, and therefore the connection between the board connecting portion and the connecting portion can be maintained even if the relay terminals displace in the array direction from the output terminals.

In the relay connector according to a preferred embodiment of the present invention described above, a tube engaging portion arranged to allow the discharge tube to enter therein after approaching along a direction substantially perpendicular to the surface of the chassis, and a power engaging portion arranged to allow an on-board connector of the power source to engage therewith after approaching along a direction substantially perpendicular to the surface of the chassis may be provided on the holder.

In this case, each of the mounting direction of the discharge tube to the relay connector and the mounting direction of the power source to the relay connector is preferably substantially perpendicular to the surface of the chassis. Therefore, the discharge tube and the power source can be mounted to the chassis so as to define a stack structure.

A mounting structure of a relay connector and a chassis, according to a preferred embodiment of the present invention, is used to mount the relay connector to the chassis having a substantially plate-shaped configuration. The relay connector is arranged to supply power from a power source arranged on the back side of the chassis to a discharge tube arranged on the front side of the chassis. In the mounting structure, a mounting hole is formed through the chassis, and the relay connector includes a holder having an insulation property and to be mounted to the chassis, and further includes a relay terminal mounted to the holder and capable of electrical connection to the discharge tube and the power source. An elastic retaining portion capable of elastic deflection and an engaging surface arranged to be substantially perpendicular to the through direction of the mounting hole are provided on an outer surface of the holder. The holder is fixed to the chassis so as to penetrate therethrough, while the chassis is sandwiched between the elastic retaining portion and the engaging surface.

According to the mounting structure, the elastic retaining portion deflects elastically, when the holder is inserted into the mounting hole. When the holder has reached the proper mounting position so that the engaging surface abuts on the opening edge of the mounting hole, the elastic retaining portion is locked by the opening edge of mounting hole as a result of its elastic restoration. According to a preferred embodiment of the present invention, the relay connector can be mounted to the chassis simply by inserting the holder into the mounting hole.

In the mounting structure of a relay connector and a chassis according to a preferred embodiment of the present invention described above, a travel restricting portion capable of abutting against an opening edge of the mounting hole may be provided on the outer surface of the holder on which the elastic retaining portion is provided.

The elastic retaining portion can deform elastically so as to approach the outer surface of the holder. The elastic deformation of the elastic retaining portion may cause movement of the holder relative to the chassis. However, according to the above construction, the movement of the holder relative to the chassis can be restricted due to the travel restricting portion abutting the opening edge of the mounting hole.

In the mounting structure of a relay connector and a chassis according to a preferred embodiment of the present invention described above, a surface of the elastic retaining portion, which abuts on the opening edge of the mounting hole, may be formed of an inclined surface tilted at an angle to the thickness direction of the chassis.

In this case, the surface of the elastic retaining portion, which abuts on the opening edge of the mounting hole, is formed of an inclined surface tilted at an angle to the thickness direction of the chassis. Thereby, the chassis can be infallibly sandwiched between the elastic retaining portion and the engaging surface, even if the chassis has variations in thickness.

In the mounting structure of a relay connector and a chassis according to a preferred embodiment of the present invention described above, in a case where a container room capable of holding an end portion of the discharge tube is provided in the holder so that the relay terminal can be electrically connected to the discharge tube within the container room; an extended portion, arranged to protrude from between the chassis and an opening edge of the container room and extend along the surface of the chassis, may be provided on an outer surface of the holder that is arranged perpendicularly to the surface of the chassis and includes an opening of the container room.

In this case, the extended portion protruding from the outer surface of the holder is provided, which can result in a long creepage distance from the inside of the container room to the chassis. Thereby, a leak, from the discharge tube held in the container room to the chassis outside the holder, can be prevented.

A mounting structure of a relay connector and a discharge tube, according to a preferred embodiment of the present invention, is provided. The relay connector is arranged to supply power from a power source arranged on the back side of a chassis having a substantially plate-shaped configuration to a discharge tube arranged on the front side of the chassis. In the mounting structure, the relay connector includes a holder having an insulation property and to be mounted to the chassis, and further includes a relay terminal mounted to the holder and capable of electrical connection to the discharge tube and the power source. A container room capable of holding an end portion of the discharge tube is provided in the holder, and a tube connecting portion of the relay terminal is arranged in the container room so that the discharge tube is electrically connected to the tube connecting portion within the container room.

In this case, the connection between the discharge tube and the relay connector is housed within the container room, and therefore foreign substances can be prevented from interference with the connection.

In the mounting structure of a relay connector and a discharge tube according to a preferred embodiment of the present invention described above, in a case where the mounting direction of the discharge tube to the container room is perpendicular or substantially perpendicular to the axis of the discharge tube, and a ferrule attached to the end portion of the discharge tube is held in the container room when the discharge tube is mounted, a movement restricting portion, capable of locking the ferrule so that axial movement of the discharge tube in a direction away from the container room is prevented, may be provided in the container room.

In this case, the movement of the discharge tube can be prevented due to the movement restricting portion locking the ferrule, even if the discharge tube moves in the axial direction so as to escape from the container room.

In the mounting structure of a relay connector and a discharge tube according to a preferred embodiment of the present invention described above, an extended portion, capable of being arranged to protrude from between the chassis and an opening edge of the container room and extend along the surface of the chassis, may be provided on an outer surface of the holder that is arranged perpendicularly or substantially perpendicular to the surface of the chassis and includes an opening of the container room.

In this case, the extended portion protruding from the outer surface of the holder is provided, which can result in a long creepage distance from the inside of the container room to the chassis. Thereby, a leak, from the discharge tube held in the container room to the chassis outside the holder, can be prevented.

In the mounting structure of a relay connector and a discharge tube according to a preferred embodiment of the present invention described above, a tapered guiding portion, inclined from the mounting direction of the discharge tube, may be arranged on the holder, so as to extend from an opening edge of an opening provided as a receiving opening of the container room for receiving the discharge tube.

In this case, the tapered guiding portion can guide the discharge tube into the container room.

Amounting structure of a relay connector and a power source, according to a preferred embodiment of the present invention, is provided. The relay connector is arranged to supply power from a power source arranged on the back side of a chassis having a substantially plate-shaped configuration to a discharge tube arranged on the front side of the chassis. In the mounting structure, the power source includes an on-board connector mounted on the back surface of a circuit board that is to be arranged parallel or substantially parallel to the chassis so that the back surface is on an opposite side of the chassis, and further includes an output terminal arranged in an engaging recess that is formed on the on-board connector so as to correspond to a fitting hole formed through the circuit board. The relay connector includes a holder having an insulation property and to be mounted to the chassis, and further includes a relay terminal mounted to the holder and capable of electrical connection to the discharge tube and the power source. A wall portion, capable of projecting to the back side of the chassis and penetrating through the fitting hole so as to be inserted into the engaging recess, is provided on the holder. A board connecting portion capable of connection to the output terminal is provided on the relay terminal, so as to extend along the wall portion.

The board connecting portion of the relay terminal can penetrate through the fitting hole of the circuit board so as to be connected to the output terminal within the engaging recess. Thus, the fitting hole formed as a through hole on the circuit board enables the on-board connector to be arranged on the back surface of the circuit board on the opposite side of the chassis. Further, the board connecting portion is arranged along the wall portion, and thereby the board connecting portion is prevented from being deformed or damaged, caused by interference from a foreign substance.

In the mounting structure of a relay connector and a power source according to a preferred embodiment of the present invention described above, the output terminal can include a proximal portion arranged so that its displacement from the circuit board is restricted, a flexible portion extending from the proximal portion and being capable of elastic deflection, and a connecting portion having a substantially U-shaped configuration that extends from the flexible portion and can elastically pinch the wall portion and the board connecting portion. The board connecting portion when being inserted into the engaging recess can have elastic contact with a free-end-side strip portion of two strip portions of the connecting portion on the opposite side of the flexible portion, while the wall portion can have elastic contact with a strip portion of the two strip portions of the connecting portion on the side of the flexible portion.

In this case, if the board connecting portion of the relay terminal displaces from the output terminal to the flexible portion side, the whole connecting portion, together with the board connecting portion and the wall portion, moves to the flexible portion side while the connection between the board connecting portion and the free-end-side strip portion is maintained. If the board connecting portion displaces from the output terminal to the free end side or to the opposite side of the flexible portion, the free-end-side strip portion of the connecting portion is pushed by the board connecting portion so as to move to the free end side. Then, the connection between the board connecting portion and the free-end-side strip portion is also maintained.

In the mounting structure of a relay connector and a power source according to a preferred embodiment of the present invention described above, the power source can include a plurality of output terminals as the above output terminal, which are arranged in a line on the circuit board so as to correspond to a plurality of relay terminals as the above relay terminal. The output terminal may include a connecting portion that is elongated in a direction substantially perpendicular to the array direction of the relay terminals and the output terminals, while the board connecting portion may have a substantially plate-shaped configuration that is wider than the connecting portion and arranged parallel or substantially parallel to the array direction of the relay terminals and the output terminals. The board connecting portion can have contact with the connecting portion.

In the construction that includes a plurality of output terminals and a plurality of relay terminals arranged in lines, the output terminals may displace in the array direction from the relay terminals due to some reason such as the difference in thermal expansion rate between the circuit board as a mounting base for the output terminals and the chassis as a mounting base for the relay terminals.

For this reason, in the above construction, the connecting portion is provided on the output terminal so as to be elongated in a direction substantially perpendicular to the array direction, while the board connecting portion is provided on the relay terminal so as to provide a substantially plate-shaped configuration that is wider than the connecting portion and arranged parallel or substantially parallel to the array direction, so that the wide board connecting portion can have contact with the elongated connecting portion. The board connecting portion is preferably large in width along the array direction, and therefore the connection between the board connecting portion and the connecting portion can be maintained even if the relay terminals displace in the array direction from the output terminals.

A mounting structure of a discharge tube and a power source on a relay connector, according to a preferred embodiment of the present invention, is used to mount the discharge tube and the power source to the relay connector that is arranged to supply power from the power source arranged on the back side of a chassis having a substantially plate-shaped configuration to the discharge tube arranged on the front side of the chassis. In the mounting structure, the relay connector includes a holder having an insulation property and to be mounted to the chassis, and further includes a relay terminal mounted to the holder and capable of electrical connection to the discharge tube and the power source. A tube engaging portion arranged to allow the discharge tube to enter therein after approaching along a direction substantially perpendicular to the surface of the chassis, and a power engaging portion arranged to allow the power source to engage therewith after approaching along a direction substantially perpendicular to the surface of the chassis are provided on the holder.

In this case, each of the mounting direction of the discharge tube to the relay connector and the mounting direction of the power source to the relay connector is preferably substantially perpendicular to the surface of the chassis. Therefore, the discharge tube and the power source can be mounted to the chassis so as to define a stack structure.

A lighting device according to another preferred embodiment of the present invention includes a relay connector according to a preferred embodiment of the present invention described above, a discharge tube, a power source and a chassis.

In the lighting device described above, a plurality of relay connectors defining the above-described relay connector can be arranged in a line along one lateral edge of a pair of parallel or substantially parallel lateral edges of the chassis. A grounding member, which includes a plurality of grounding terminals conductively mounted to an elongated support plate and arranged in a line, may be arranged along the other lateral edge of the pair of parallel or substantially parallel lateral edges of the chassis. A plurality of discharge tubes defining the above discharge tube, which are elongated in a direction substantially perpendicular to the pair of lateral edges, can be arranged parallel to one another, so that a ferrule attached to one end portion of each of the plurality of discharge tubes is individually connected to the relay terminal of the relay connector while a ferrule attached to the other end portion of each of the plurality of discharge tubes is individually connected to the grounding terminal.

In this case, the plurality of discharge tubes are short-circuited through the grounding member connected to the ferrule attached on the end of each discharge tube, and are collectively grounded, in which the plurality of grounding terminals of the grounding member are not required to be insulated from one another. Therefore, insulating members, which surround the grounding terminals for insulation purposes or separate the grounding terminals, are not necessary. Thus, the number of components can be reduced according to preferred embodiments of the present invention.

A display device according to a further preferred embodiment of the present invention includes a lighting device according to a preferred embodiment of the present invention described above, and a display panel arranged on the front side of the lighting device.

A television receiver according to yet another preferred embodiment of the present invention includes a display device according to a preferred embodiment of the present invention described above.

Other features, elements, steps, characteristics and advantages of the present invention will become more apparent from the following detailed description of preferred embodiments of the present invention with reference to the attached drawings.

DETAILED DESCRIPTION OF THE PREFERRED EMBODIMENTS

Preferred Embodiment 1

Preferred embodiment 1 according to the present invention will be hereinafter explained with reference to FIGS. 1 to 17.

Overview of Display Device D

Figure 1:
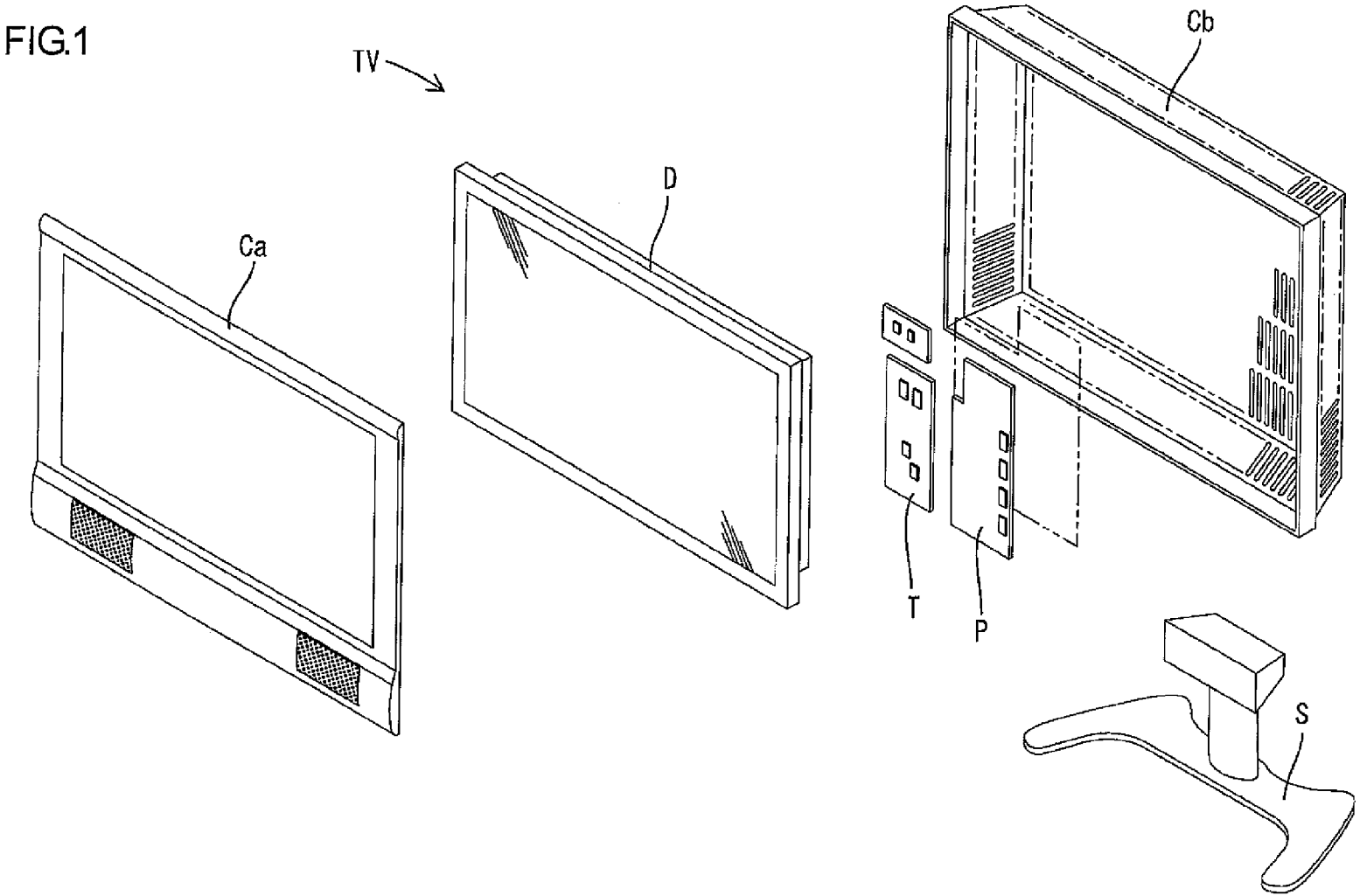
FIG. 1 is an exploded perspective view of a television receiver according to preferred embodiment 1 of the present invention.
Figure 2:
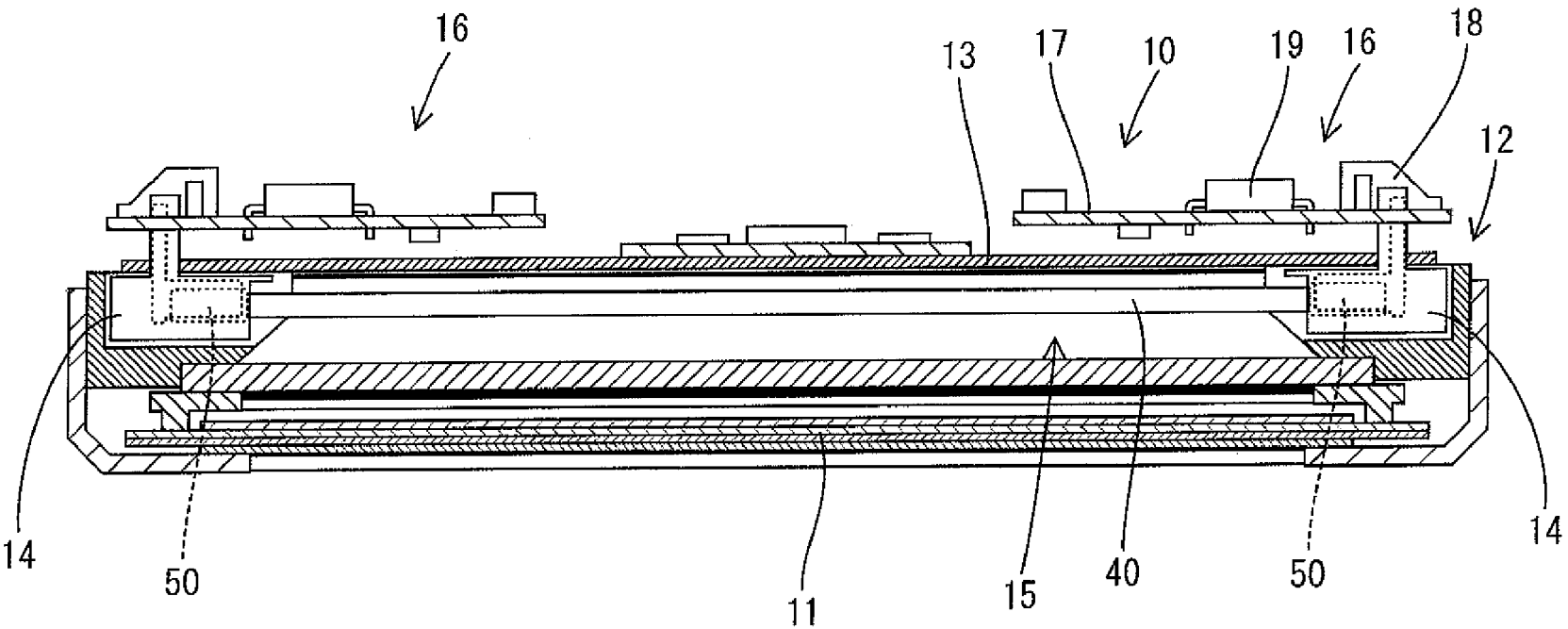
FIG. 2 is a horizontal sectional view of a display device.

A display device D used in a television receiver TV shown in FIG. 1 is a so-called liquid crystal display device, which preferably has a substantially horizontally-elongated rectangular shape and includes a display panel 11 and a lighting device 10 as shown in FIG. 2. The display panel 11 is disposed on the front side of the lighting device 10, so that the lighting device 10 as a backlight can illuminate the display panel 11 from the back side. As shown in FIG. 1, the television receiver TV includes the display device D, and front and back cabinets Ca and Cb capable of holding the display device D therebetween. Further included are a power source P other than a power board 16 (corresponding to a power source of the present invention) described below, a tuner T and a stand S. FIG. 2 schematically shows the display device D, and therefore the shapes of relay connectors 14, on-board connectors 18 and the like differ slightly from those in the other figures.

The display panel 11 has a well-known construction, in which liquid crystal as a material with an optical property that changes with applied voltage is disposed in the gap between a transparent TFT substrate and a transparent CF substrate. TFTs (Thin Film Transistors), as switching elements connected to a source wiring line and a gate wiring line running at right angles to each other, and pixel electrodes connected to the TFTs are provided on the TFT substrate. A color filter, on which color sections of three primary colors, i.e., Red (R), Green (G) and Blue (B), are arranged in a matrix, and a common electrode are provided on the CF substrate.

Overview of Lighting Device 10

Figure 3:
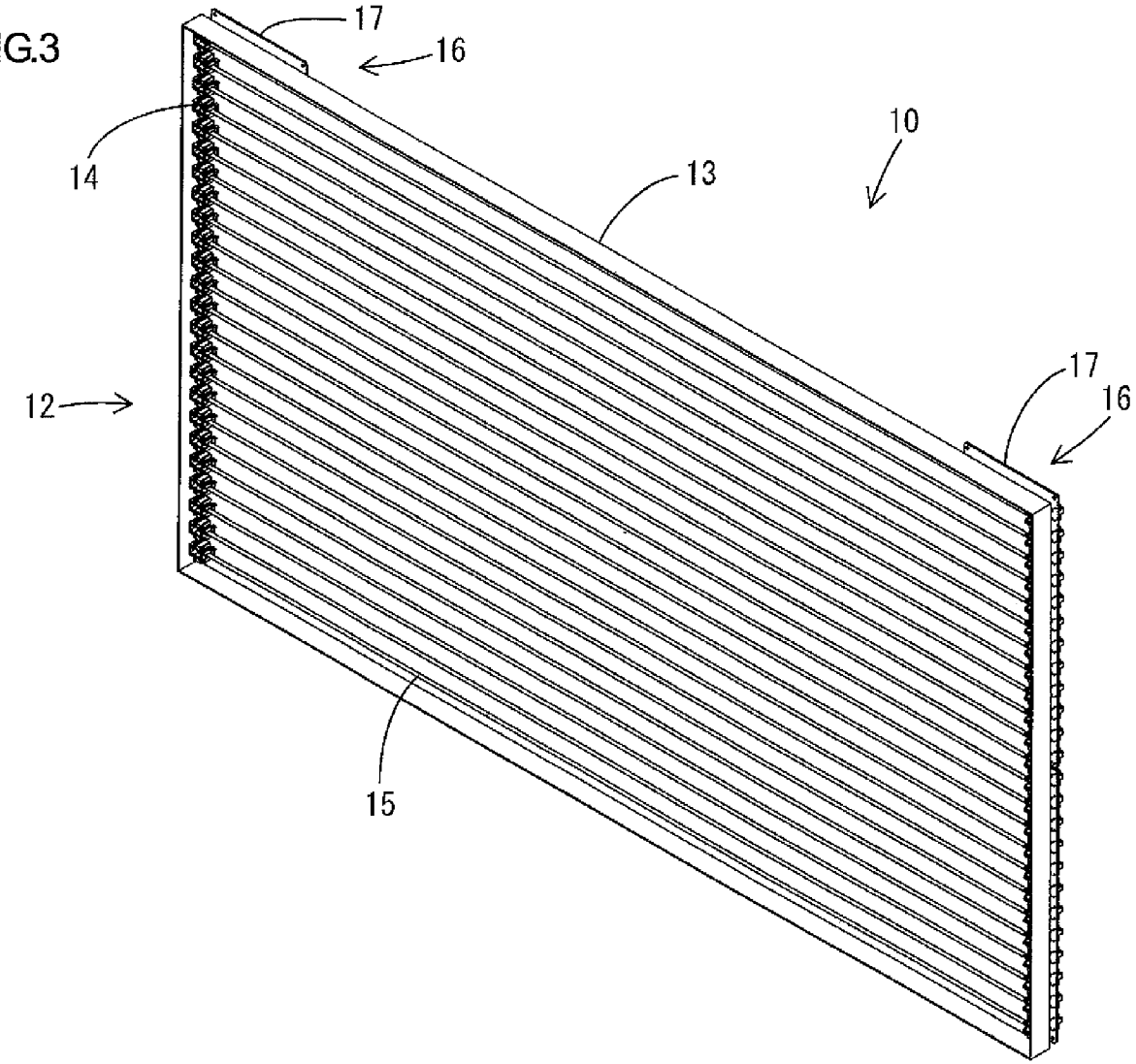
FIG. 3 is a perspective view of a chassis to which relay connectors, discharge tubes and power boards are mounted.
Figure 4:
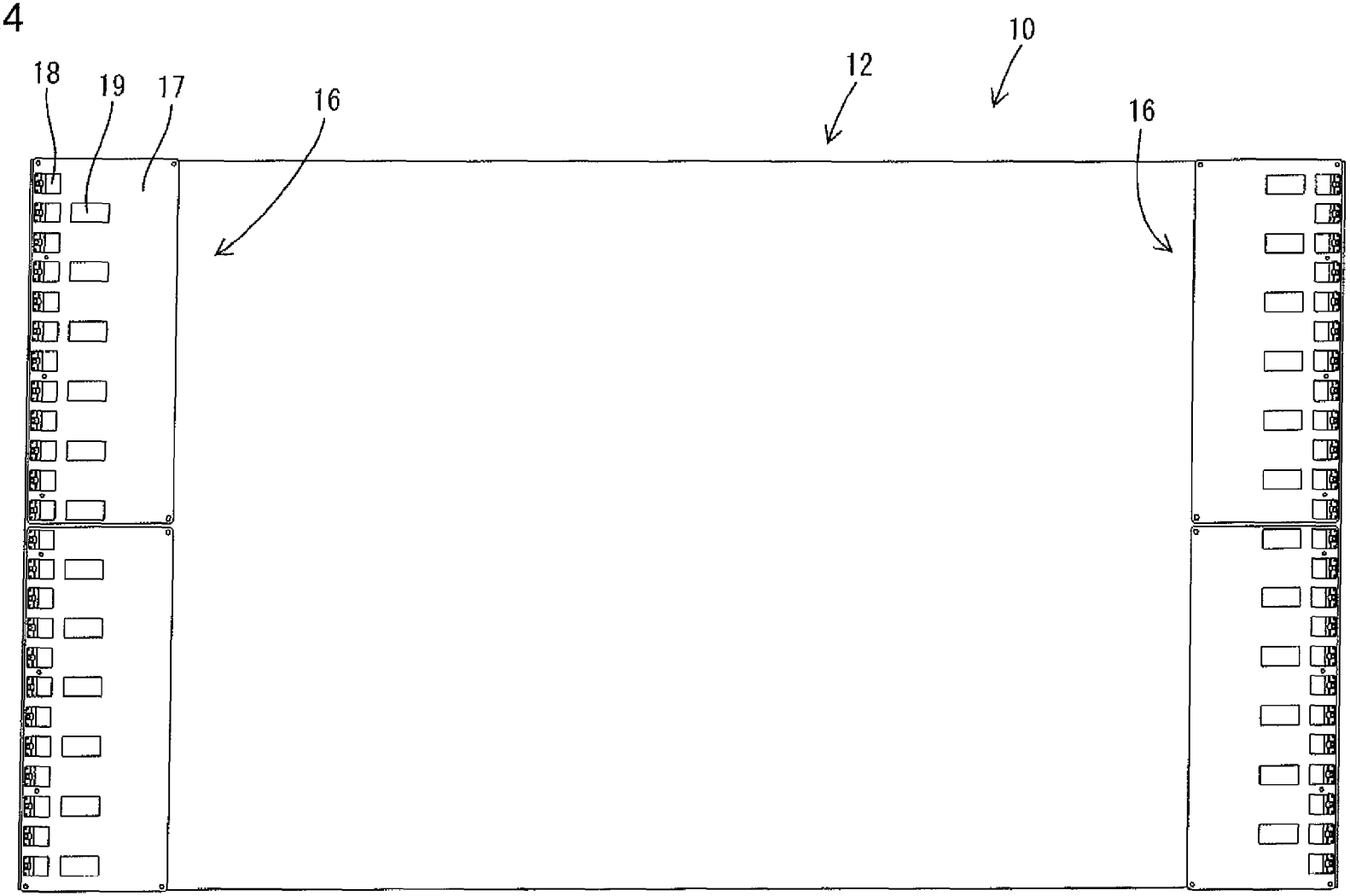
FIG. 4 is a rear view of the chassis to which the power boards are mounted.

As shown in FIGS. 2 to 4, the lighting device 10 includes a lamp unit 12 and power boards 16 (corresponding to a power source of the present invention). The lamp unit 12 includes a metallic chassis 13, which preferably has a substantially horizontally-elongated rectangular plate and functions as a reflector plate. Further included are a plurality of discharge tubes 15 held in a horizontal position and vertically arranged on the front side of the chassis 13 so as to be parallel or substantially parallel to one another, and a plurality of relay connectors 14 which are vertically arranged along the lateral edges of the chassis 13 so as to correspond to the discharge tubes 15. The power boards 16 are disposed on the back side of the chassis 13 so as to supply power to the discharge tubes 15 via the relay connectors 14.

A plurality of substantially rectangular mounting holes 13H corresponding to the ends of the discharge tubes 15 are formed through the chassis 13 so as to extend from the front side to the back side, and are vertically arranged to be level with the respective discharge tubes 15. The relay connectors 14 are mounted through the respective mounting holes 13H.

Relay Connector 14

As shown in FIGS. 5 to 8 and 10, each relay connector 14 includes a holder 20 made of synthetic resin, and a metallic relay terminal 30 housed in the holder 20.

The holder 20 includes a box-shaped portion 21 that defines a block-shaped configuration as a whole, and further includes a wall portion 27 that projects backward from the back surface of the box-shaped portion 21. On the holder 20, a pair of upper and lower elastic retaining portions 25 are formed as cantilevered portions, which extend posteriorly (i.e., in the same direction as the mounting direction of relay connector 14 to the chassis 13) and along the outer surface (i.e., upper surface and lower surface) of the box-shaped portion 21. A retaining protrusion 25*a* having a substantially right triangular shape is provided on the distal end of each elastic retaining portion 25 so as to project to the opposite side of the box-shaped portion 21. Further, travel restricting portions 24 having an elongated rib-shaped configuration are preferably provided on the respective upper and lower surfaces of the box-shaped portion 21 so as to extend along the elastic retaining portions 25 (or parallel or substantially parallel to the elastic retaining portions 25). The longitudinal area (i.e., the area extending parallel or substantially parallel to the mounting direction of the relay connector 14 to the chassis 13), that includes the travel restricting portion 24, substantially corresponds to the longitudinal area that includes the elastic retaining portion 25. An abutting surface (or an insertion restricting portion) 20*a* arranged to abut against the circuit board 17 is provided on the distal end side (i.e., the anterior end side along the mounting direction of the relay connector 14 to the circuit board 17) of each travel restricting portion 24. Due to the abutting surfaces 20*a*, the distal end of the relay terminal 30 or the distal end of the wall portion 27 is prevented from contacting the far end of an engaging recess 63 described below. A pair of engaging surfaces 26 are provided on the back surface of the box-shaped portion 21, and are positioned on the right side of the wall portion 27 and the left side of the wall portion 27, respectively. The pair of engaging surfaces 26 are arranged across the elastic retaining portions 25, i.e., on the respective right and left sides thereof, so as to be parallel or substantially parallel to the chassis 13.

A container room 23 (corresponding to a tube engaging portion of the present invention) is formed in the box-shaped portion 21, so as to have an opening extending from the front side to the right side (i.e., to the lateral side on the opposite side of the lateral edge portion of the chassis 13). The front opening portion of the opening of the container room 23 is provided as a receiving opening 23*a*, into which an end portion (or ferrule 50) of the discharge tube 15 is fitted from the front side. The lateral opening portion is provided as an escape opening 23*b* for preventing interference with the glass tube 40 when the end portion of the discharge tube 15 is held in the container room 23. A movement restricting portion 22 is arranged on the escape opening 23*a*, so as to bulge inward from the opening edge. The vertical size of the gap corresponding to the movement restricting portion 22 is preferably smaller than the inner diameter of the body 51 of the ferrule 50. On the box-shaped portion 21, an extended portion 28 protruding parallel or substantially parallel to the chassis 13 is provided on the lateral surface of the box-shaped portion 21 that includes the escape opening 23*b*. The extended portion 28 extends so as to separate the front surface of the chassis 13 from the escape opening 23*b*. The surface of the extended portion 28 that faces the chassis 13 is provided as the engaging surface 26 described above. A lightening portion is formed on the extended portion 28 by cutting or removing the chassis 13 facing surface (or back surface) thereof.

The relay terminal 30 is held within the holder 20. The relay terminal 30, which can be formed by bending a metallic plate that is formed into a predetermined shape by punching, for example, includes a tube connecting portion 31 having a pair of upper and lower elastic nipping portions 32 including plates having a substantially circular arc shape, and further includes a board connecting portion 33 having a plate-shaped configuration projecting to the back side. A pair of supporting portions 34 are formed on the end portion of the board connecting portion 33, so as to extend perpendicularly or substantially perpendicularly from its upper and lower edge portions. The pair of elastic nipping portions 32 extend from the pair of supporting parts 34 to the front side. The elastic nipping portions 32 are disposed in the container room 23. On the other hand, the board connecting portion 33 projects from the back surface of the box-shaped portion 21 so as to be exposed to the outside of the holder 20, and extends backwards along the wall portion 27. A pair of rib-shaped holding portions 27*a* are arranged on the wall portion 27 so as to extend along its upper and lower edges. The board connecting portion 33 is fixed to the wall portion 27 with its upper and lower edge portions fitted into the grooves of the rib-shaped holding portions 27*a*. The projecting direction of the wall portion 27 or the board connecting portion 33 extending from the box-shaped portion 21 is preferably perpendicular or substantially perpendicular to the chassis 13 (i.e., it is the same direction as the mounting direction of relay connector 14 to the chassis 13).

Figure 9:
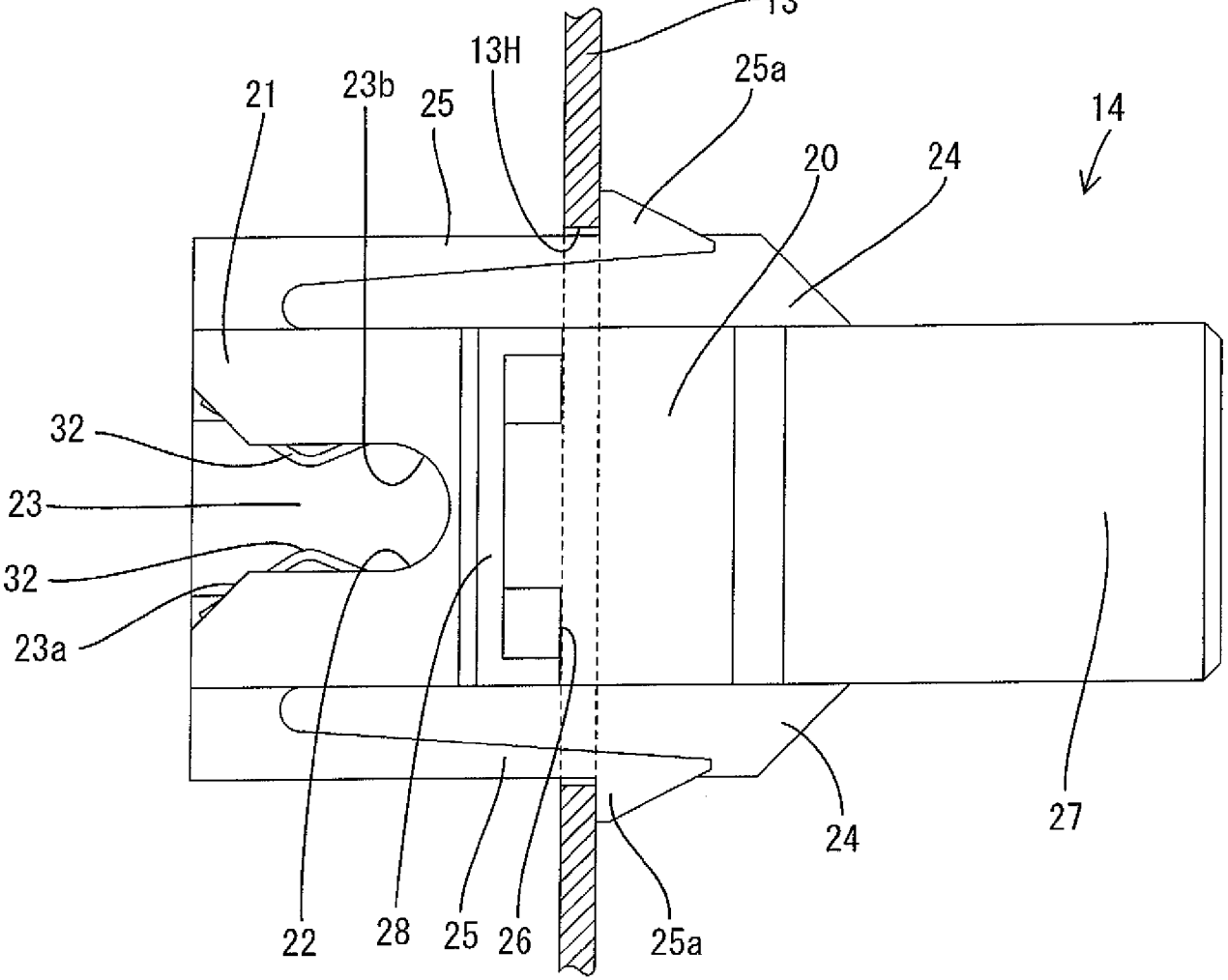
FIG. 9 is a sectional view showing a mounting structure of the relay connector and the chassis.
Figure 10:
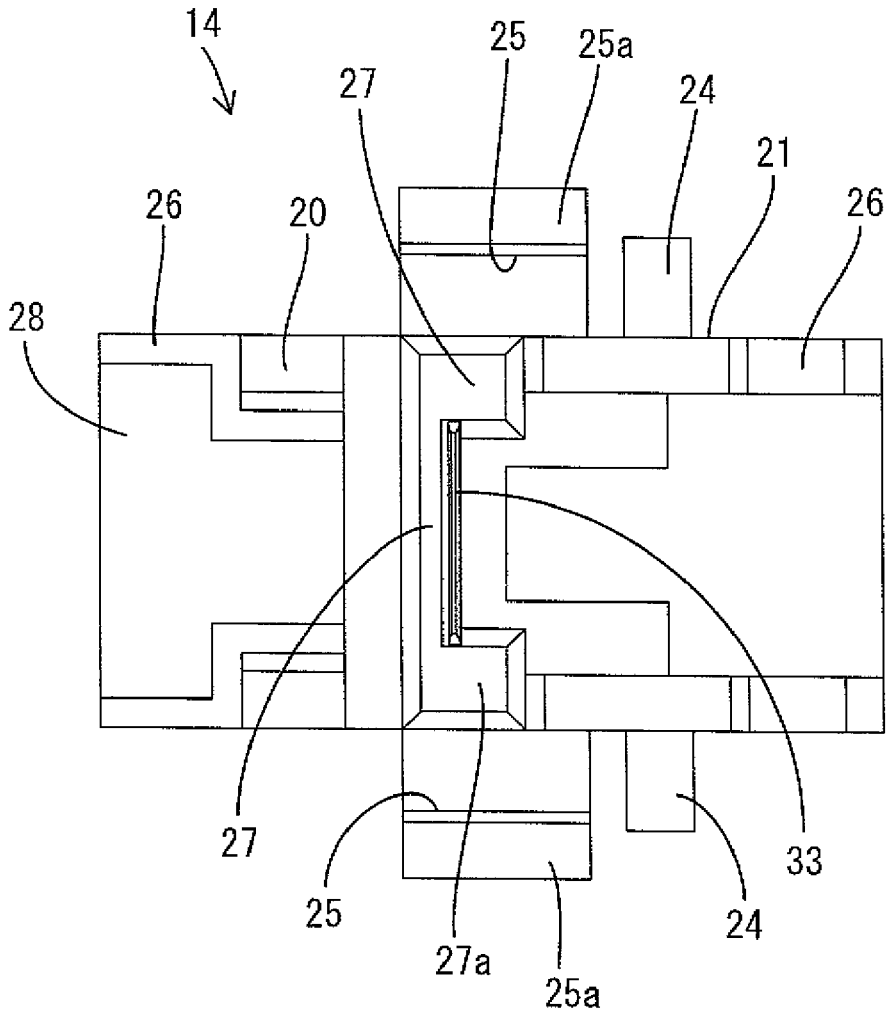
FIG. 10 is a rear view of the relay connector.

When the relay connector 14 is mounted to the chassis 13, referring to FIG. 9, the wall portion 27 of the holder 20 is inserted into the mounting hole 13H of the chassis 13 from the front side, so that the engaging surfaces 26 abut on the opening edge of the mounting hole 13H on the front surface of the chassis 13. In the course of the insertion, the retaining protrusions 25*a* of the elastic retaining portions 25 come in contact with the opening edge of the mounting hole 13H, and thereby the elastic retaining portions 25 deform elastically so as to approach the box-shaped portion 21. When the engaging surfaces 26 come in contact with the front surface of the chassis 13, the retaining protrusions 25*a* having passed through the mounting hole 13H cause elastic restoration of the elastic retaining portions 25. As a result of the elastic restoration, the retaining protrusions 25*a* are locked by the opening edge of the mounting hole 13H on the back surface of the chassis 13. Consequently, the chassis 13 is sandwiched between the engaging surfaces 26 on the front side and the retaining protrusions 25*a* on the back side. Thus, the holder 20 is fixed to the chassis 13 so that its movement in the mounting direction (i.e., the through direction of the mounting hole 13H) is restricted. Then, the mounting of the relay connector 14 to the chassis 13 is completed.

When the relay connector 14 is attached to the chassis 13, the box-shaped portion 21 as the front end portion of the holder 20 projects (or is exposed) to the front side of the chassis 13 while the wall portion 27 as the back end portion of the holder 20 projects (or is exposed) to the back side of the chassis 13. The elastic retaining portions 25 can deform elastically so as to approach the outer surface of the holder 20 (or so as to cause vertical movement). Due to the elastic deformation of the elastic retaining portions 25, the holder 20 may move in the vertical direction relative to the chassis 13 (or relative to the mounting hole 13H). However, in the present preferred embodiment, the vertical movement of the holder 20 relative to the chassis 13 can be restricted due to the travel restricting portions 24, which are arranged on the same outer surface as the elastic retaining portions 25 so as to abut on the opening edge of the mounting hole 13H.

Discharge Tube 15

Figure 11:
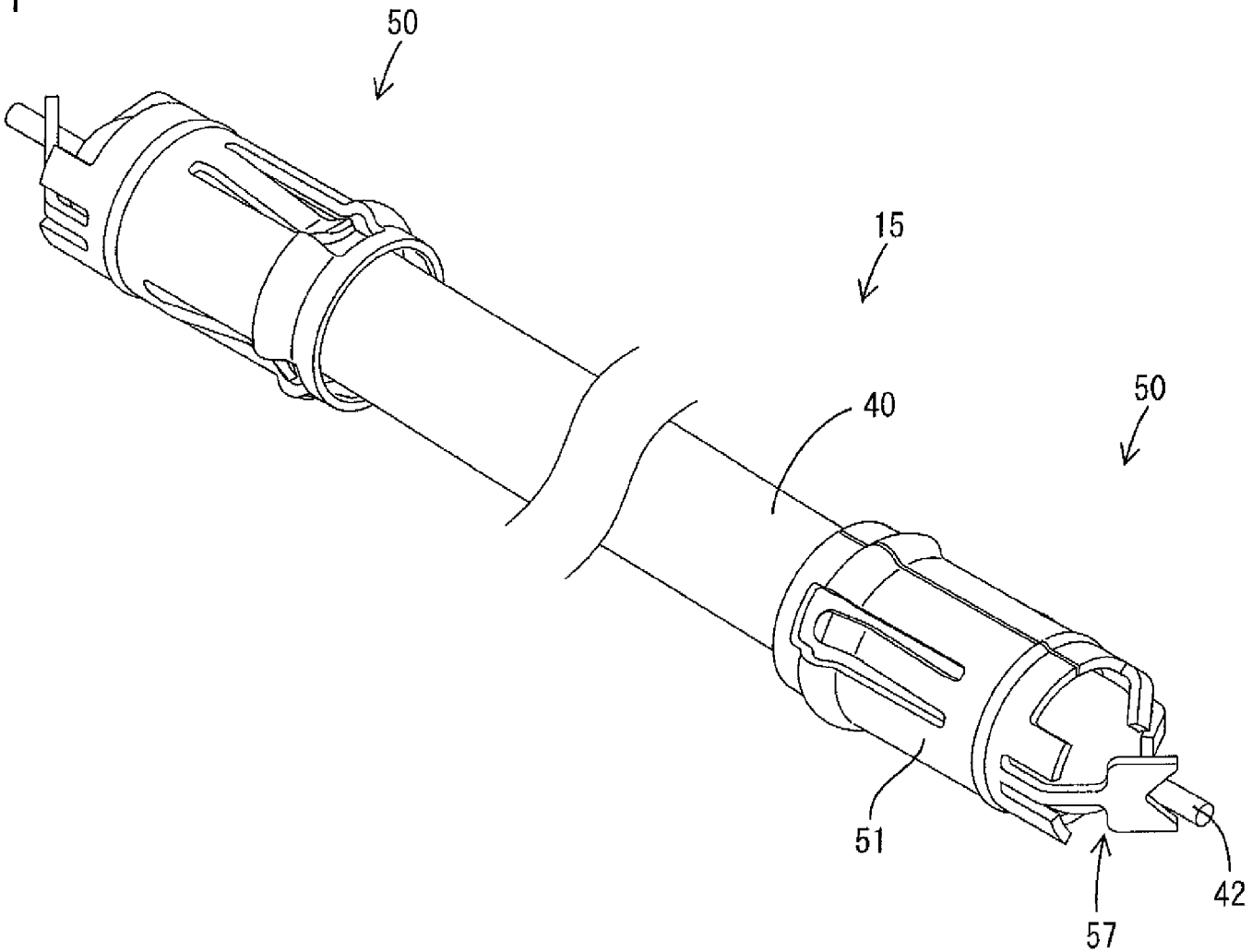
FIG. 11 is a perspective view of a discharge tube.
Figure 12:
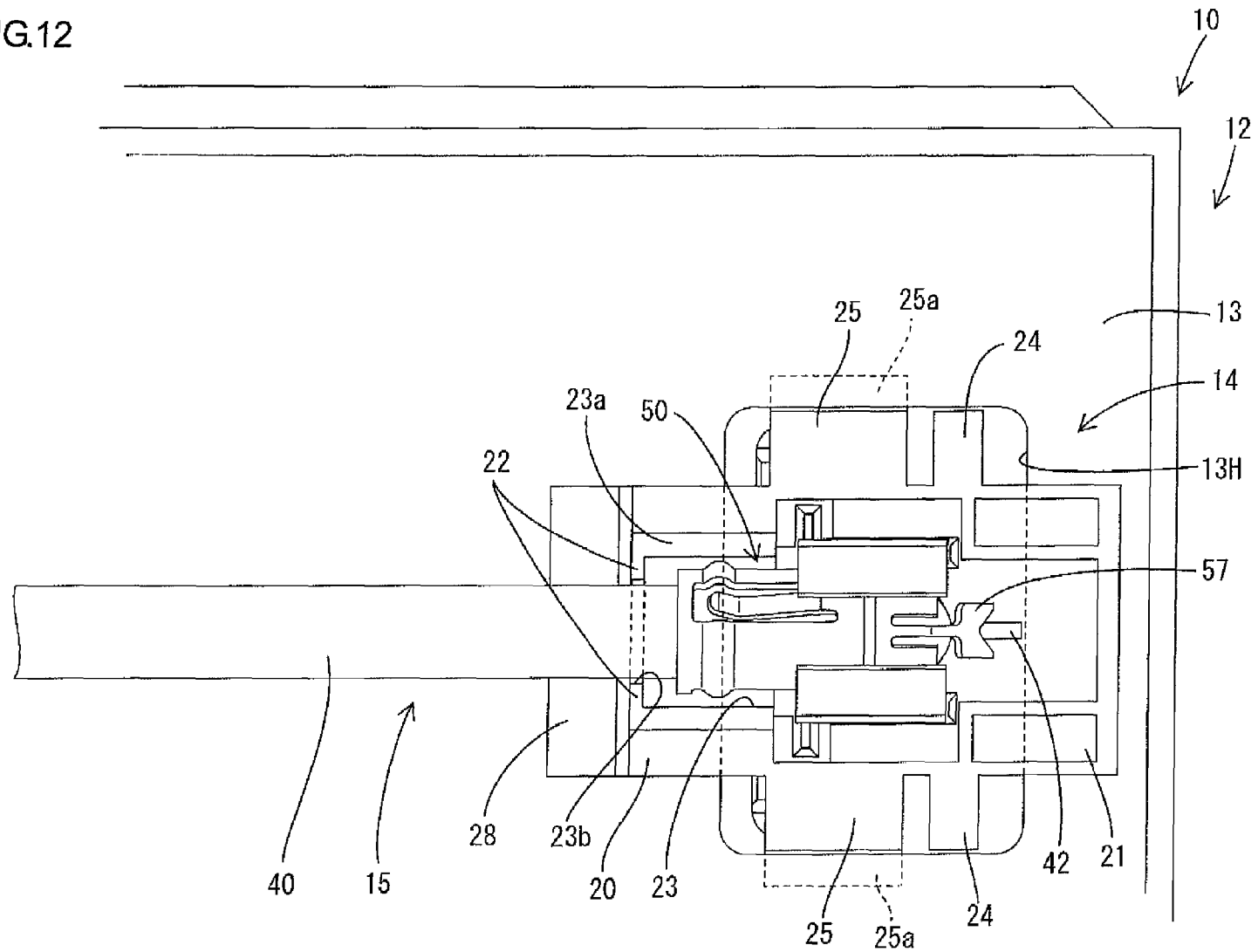
FIG. 12 is a rear view of a lighting device.
Figure 13:
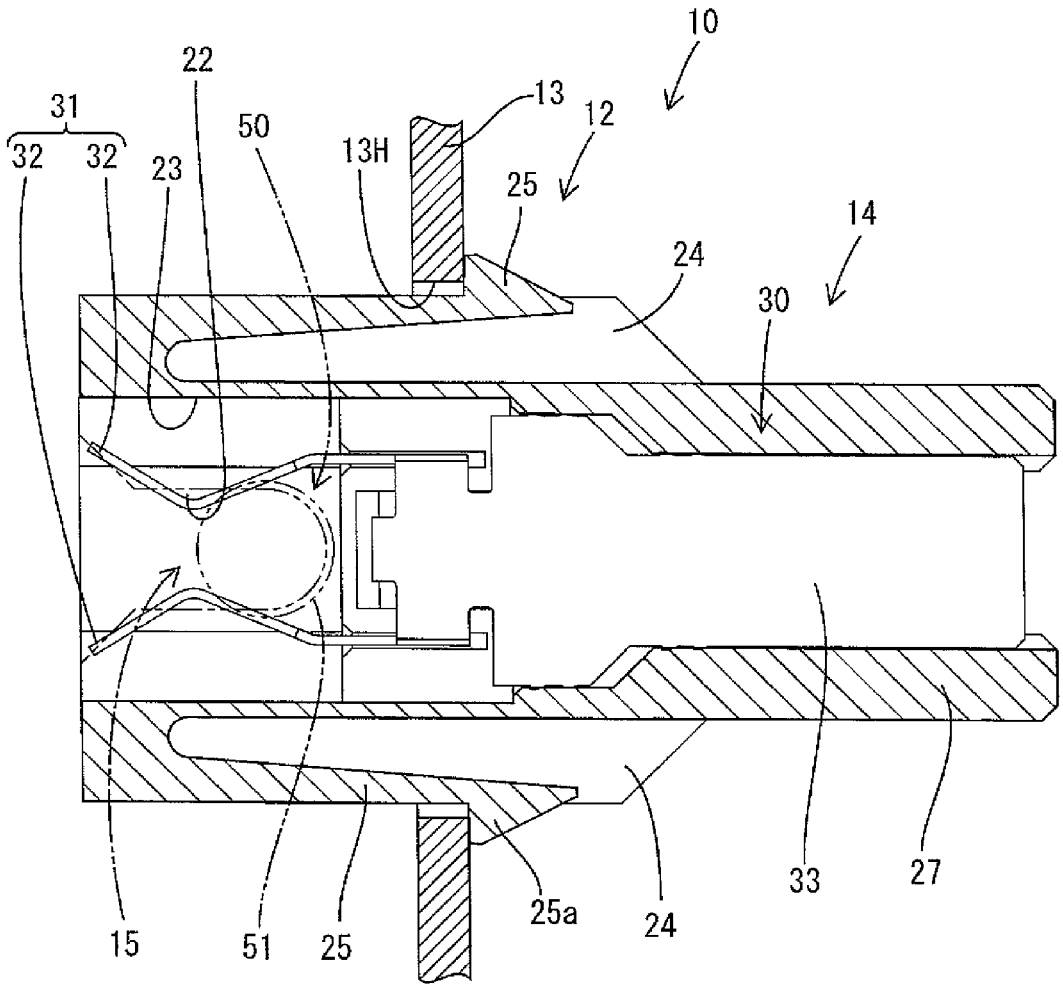
FIG. 13 is a partially-enlarged front view of the lighting device.
Figure 14:
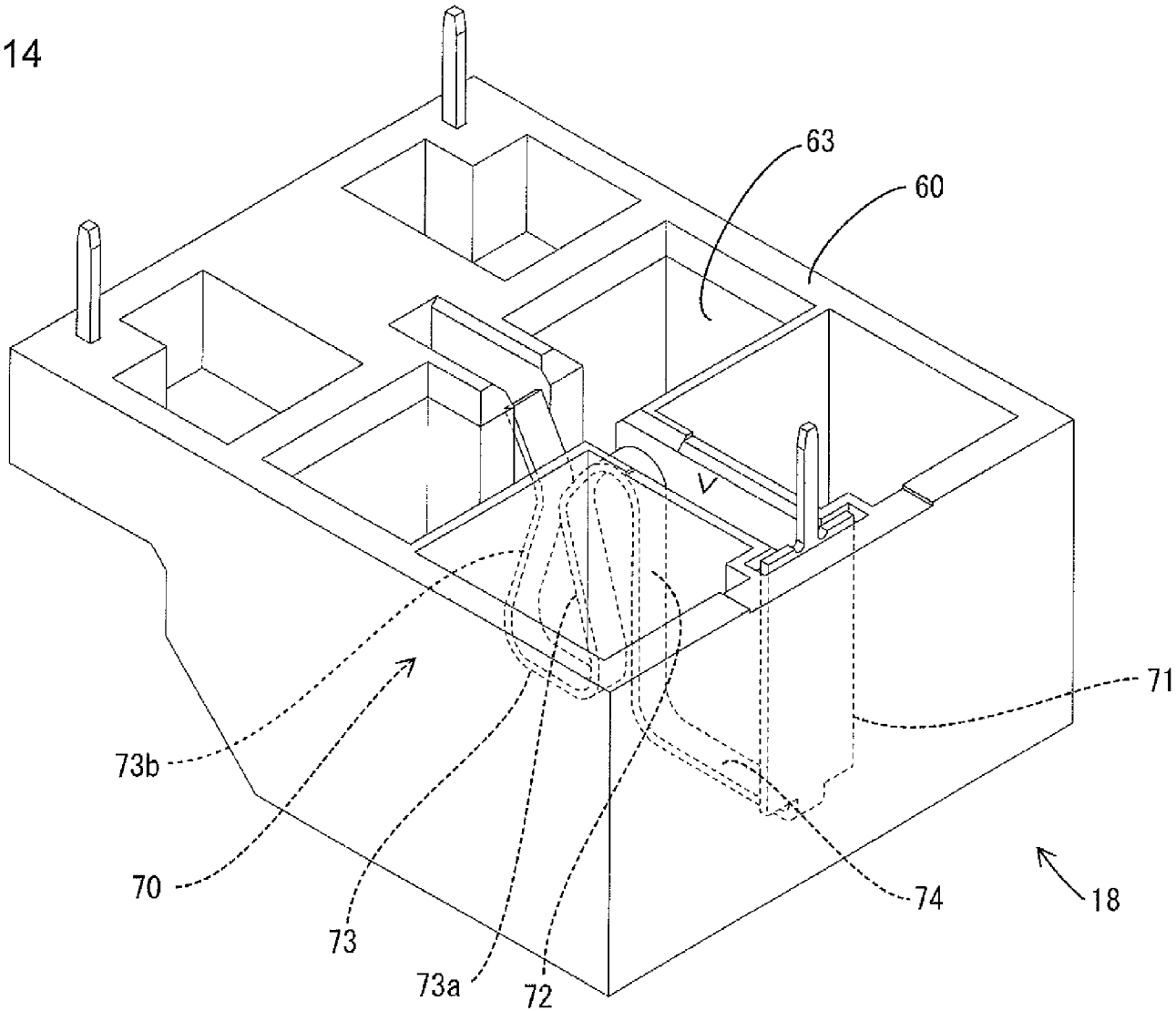
FIG. 14 is a perspective view of the on-board connector.
Figure 15:
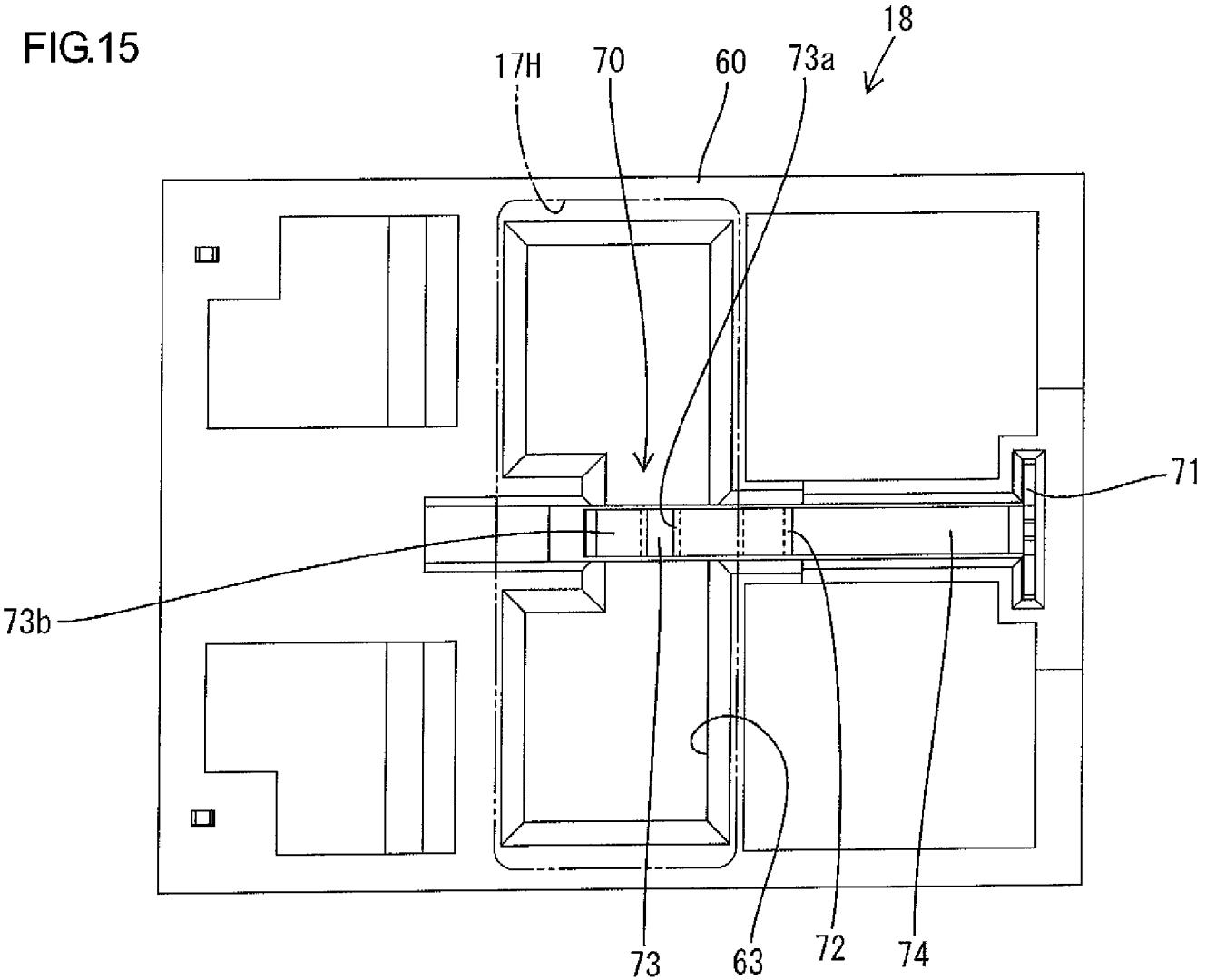
FIG. 15 is a front view of the on-board connector.

Referring to FIG. 11, each discharge tube 15 preferably is formed of a cold cathode fluorescent tube that includes a generally elongated glass tube 40 having a circular cross section, elongated outer leads 42 which have a circular cross section and project linearly from the respective ends of the glass tube 40 and coaxially with the glass tube 40, and further includes ferrules 50 attached to the respective end portions of the glass tube 40. Each ferrule 50 preferably is a single-piece component, which can be formed by bending or hammering a metallic (e.g., copper alloy) plate that is gilded and formed into a predetermined shape by punching, for example. The ferrule 50 includes a body 51 that preferably has a substantially cylindrical shape, and further includes a conductive portion 57 that extends from the body 51 in an oblique direction leaning inwardly. The body 51 is fitted onto the outer circumference of the end portion of the glass tube 40, while the conductive portion 57 is connected to the outer lead 42.

The discharge tube 15 is fixed to relay connectors 14. At the time of fixation, the discharge tube 15 held in a horizontal position is moved toward the front face of the chassis 13, and the end portions and the ferrules 50 of the glass tube 40 are fitted into the container rooms 23 of the relay connectors 14 from the front side. The mounting direction of the discharge tube 15 to the relay connectors 14 is preferably substantially perpendicular to the front surface of the chassis 13. When the discharge tube 15 enters the container rooms 23, the pairs of elastic nipping portions 32 are pushed to open vertically due to elastic deflection, resulting in elastically pinching the bodies 51 of the ferrules 50. Consequently, the discharge tube 15 is held by the tube connecting portions 31 at its end portions, and is thus fixed to the chassis 13 via the relay terminals 30 and the holders 20 provided as the relay terminal 30 mounting bases.

When the discharge tube 15 is attached to the relay connectors 14, the weight of the discharge tube 15 is received solely by the chassis 13 via the relay connectors 14. That is, the outer leads 42 will not be under load due to the weight of the discharge tube 15. Further, the pair of elastic nipping portions 32 can have contact with the body 51 while elastically pinching it. Thereby, the outer lead 42 is electrically conductively connected to the relay terminal 30 via the ferrule 50. The ferrule 50 fitted onto the end portion of the discharge tube 15 is held in the container room 23, and the movement restricting portion 22 narrower than the inner diameter of the ferrule 50 is provided on the escape opening 23*b* of the container room 23. Therefore, even if the end portion of the discharge tube 15, together with the ferrule 50, moves in the axial direction so as to escape from the container room 23, the movement of the discharge tube 15 can be restricted due to the movement restricting portion 22 catching the ferrule 50. Further, the extended portion 28 is formed on the outer surface of the holder 20, that is perpendicular or substantially perpendicular to the surface of the chassis 13 and includes the escape opening 23*b* of the container room 123, so as to protrude from between the chassis 13 and the escape opening 23*b* and extend along the surface of the chassis 13. This results in a long creepage distance from the inside of the container room 23 to the front surface of the chassis 13. Thereby, a leak, from the discharge tube 15 held in the container room 23 to the chassis 13 outside the holder 20, can be prevented.

Overview of Power Board 16

Figure 5:
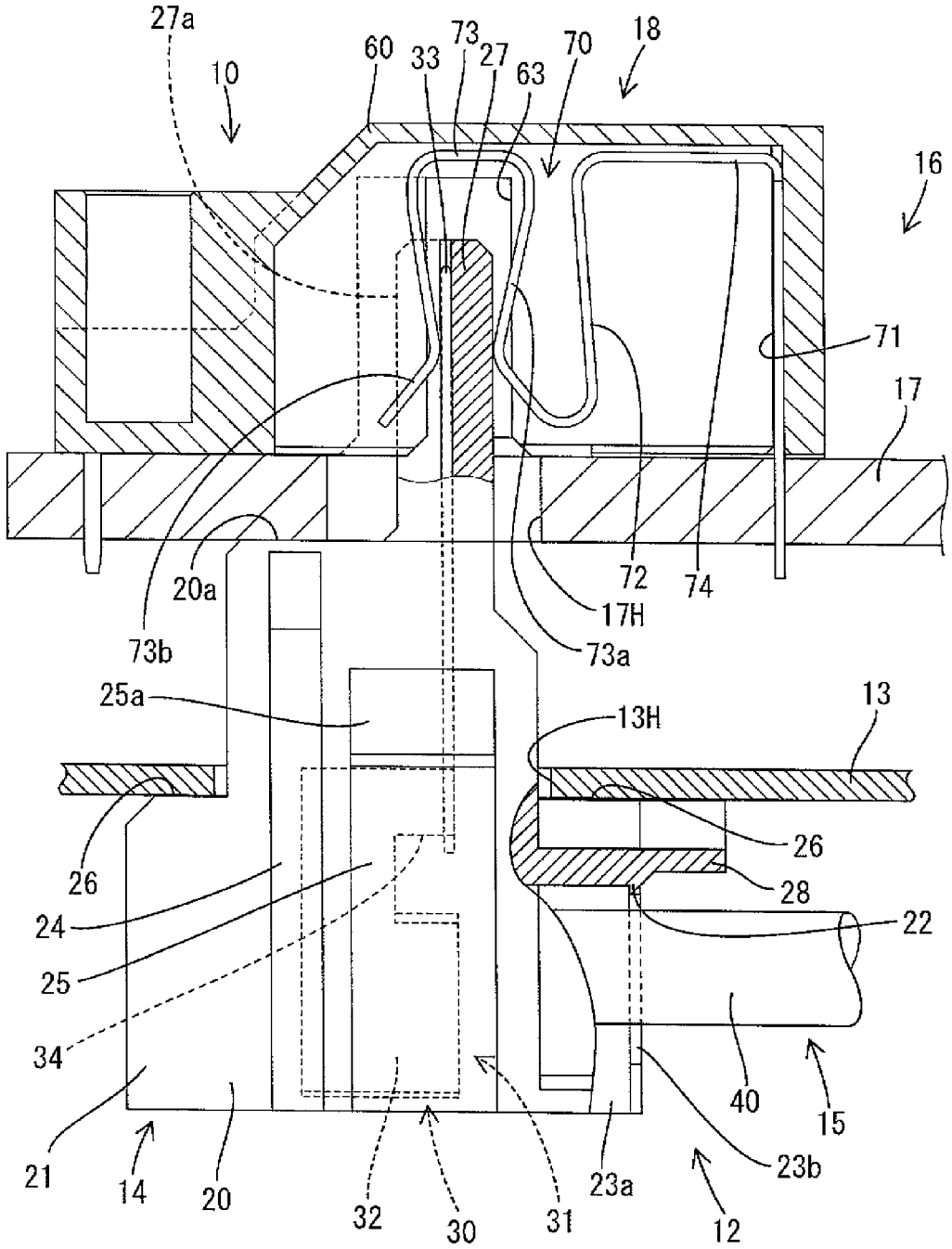
FIG. 5 is a horizontal sectional view showing an on-board connector mounted to a lamp unit.
Figure 6:
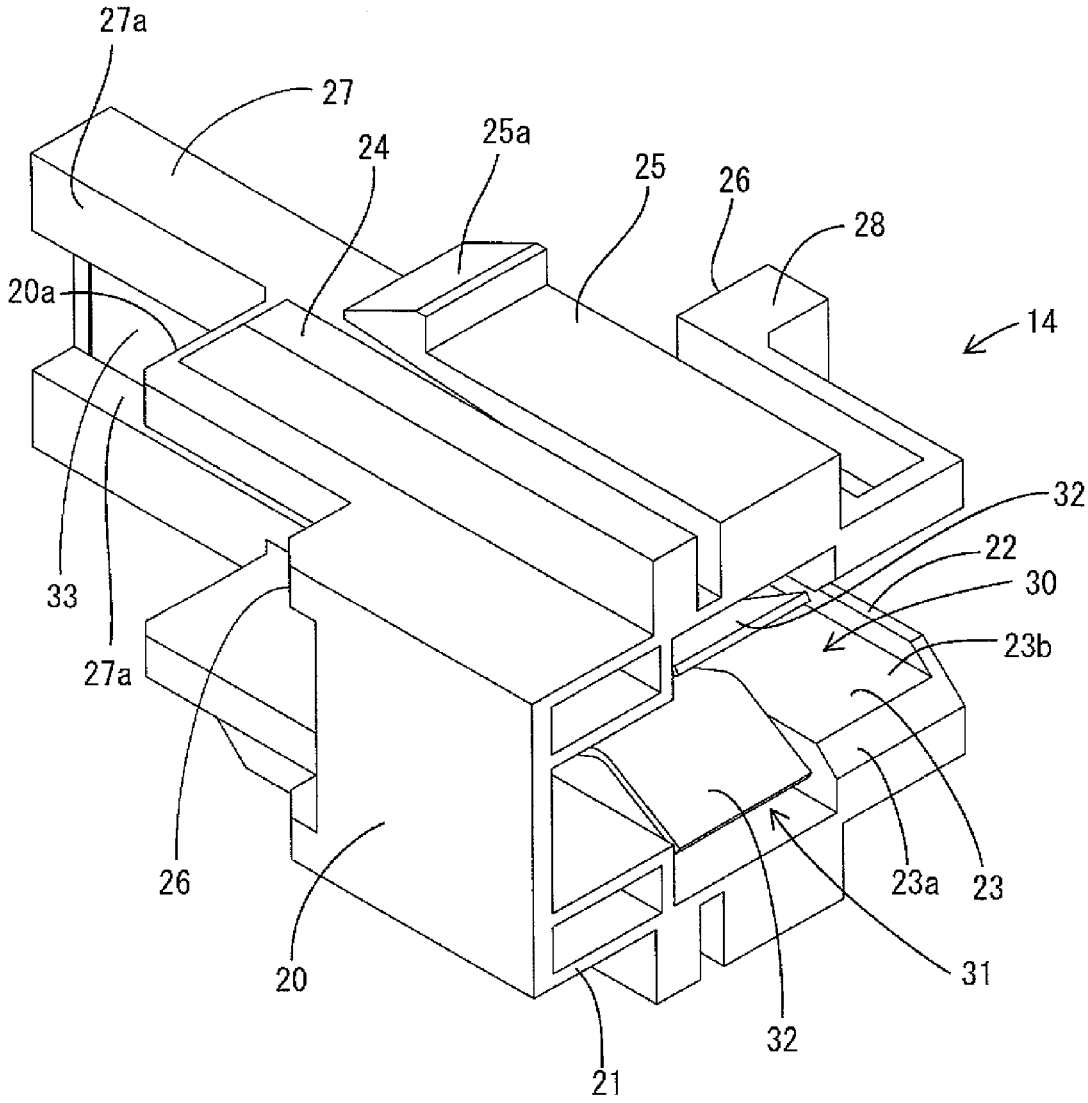
FIG. 6 is a perspective view of a relay connector.
Figure 7:
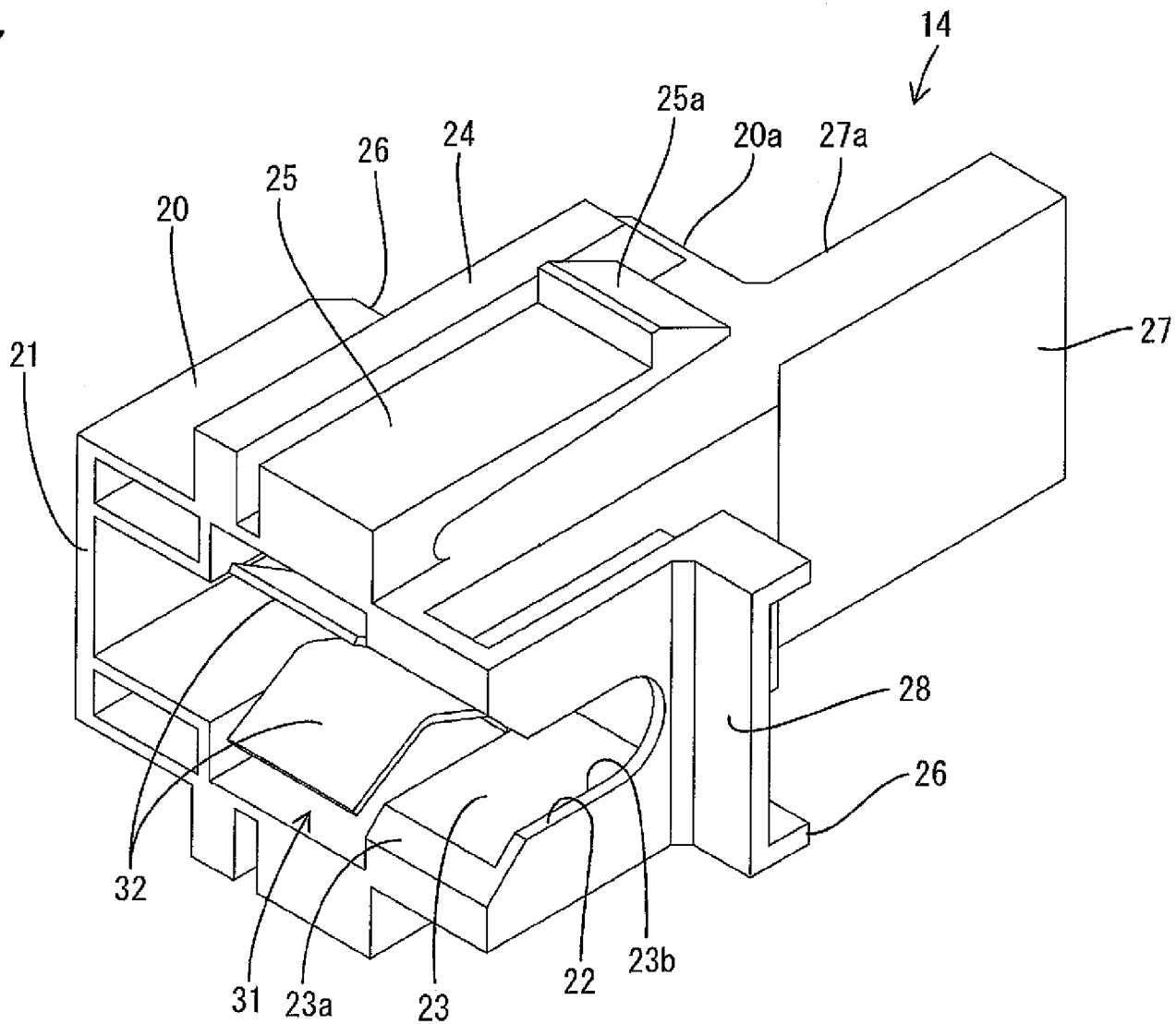
FIG. 7 is a perspective view of the relay connector.
Figure 8:
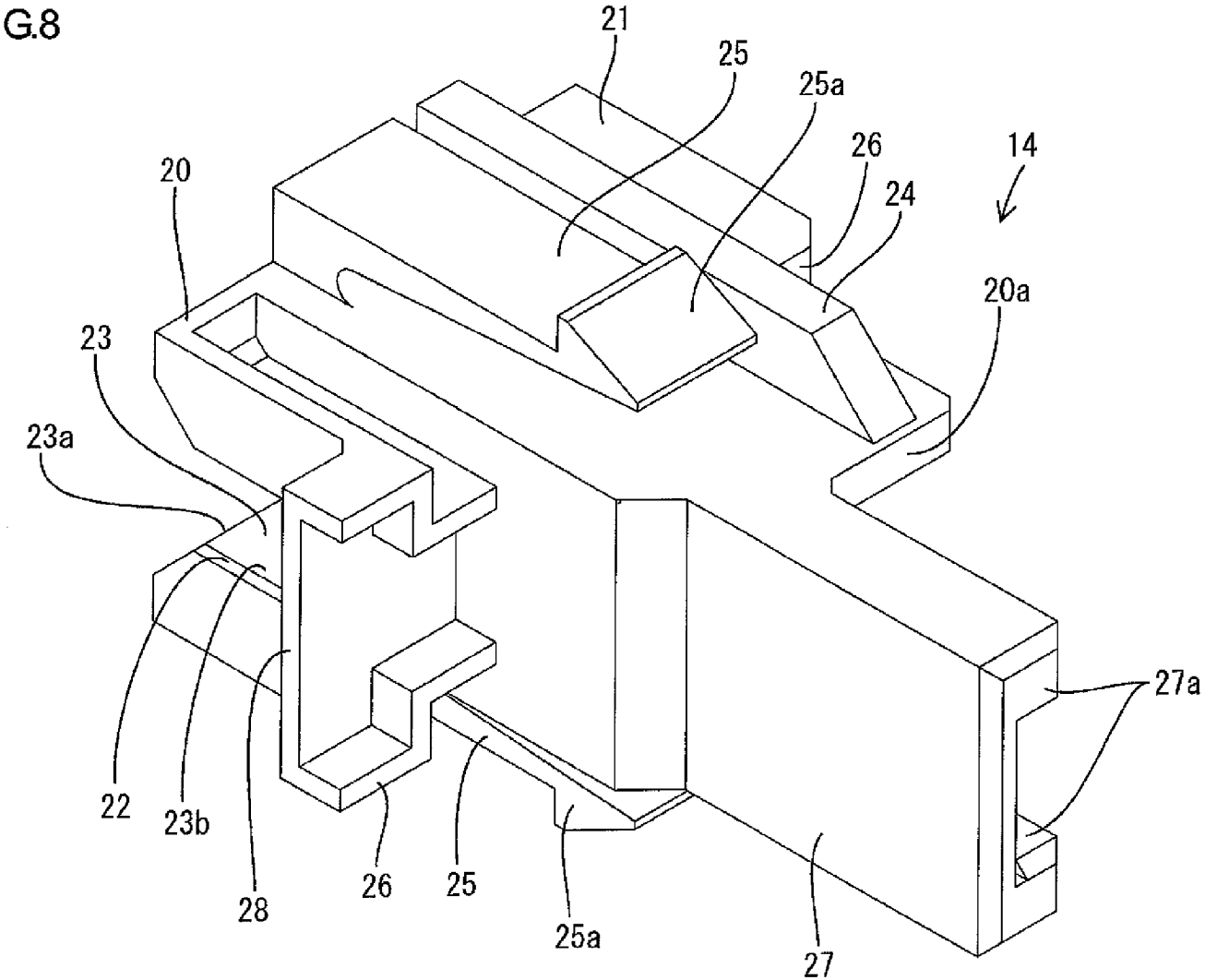
FIG. 8 is a perspective view of the relay connector.

As shown in FIGS. 4 and 5, each power board 16 includes a circuit board 17 having a circuit provided on its back surface (i.e., the surface on the opposite side of the chassis 13), electronic components 19 mounted on the back surface of the circuit board 17, and a plurality of on-board connectors 18 mounted on the back surface of the circuit board 17.

The circuit board 17 preferably has a substantially vertically-elongated rectangular shape as a whole, and is preferably formed using a phenolic paper-base copper-clad laminated board (known as a phenolic paper). A plurality of fitting holes 17H having a vertically-elongated rectangular shape are formed through the circuit board 17 so as to extend from the front side to the back side. The plurality of fitting holes 17H are arranged vertically along the lateral side edge of the circuit board 17 so as to correspond to the above-described relay terminals 30 (or relay connectors 14).

As shown in FIGS. 14 to 17, each on-board connector 18 includes a housing 60 made of synthetic resin, and a metallic output terminal 70 completely contained in the housing 60. The on-board connectors 18 are arranged along the lateral side edge of the circuit board 17 so as to correspond to the respective fitting holes 17H. An engaging recess 63 with a vertically-elongated rectangular opening is formed on the outer surface (i.e., the circuit board 17 facing surface) of the housing 60. The position and size of the engaging recess 63 are set to correspond substantially to those of the fitting hole 17H. The relay connector 14 is fitted into the engaging recess 63.

The output terminal 70, which can be formed by bending a metallic plate that is formed into a predetermined shape by punching, for example, includes a proximal portion 71, a supported portion 74, a flexible portion 72 and a connecting portion 73. The output terminal 70 is mounted into the housing 60 from the circuit board 17 facing surface side. The proximal portion 71 has a plate-shaped configuration, and is fixed to the housing 60 by press fitting while being electrically connected to the circuit board 17. The proximal portion 71 is thus fixed to the circuit board 17, and consequently the on-board connector 18 is integrated with the circuit board 17. The supported portion 74 preferably has a substantially elongated shape, and extends substantially perpendicularly from the proximal portion 71. The flexible portion 72 preferably has a substantially elongated shape, and extends substantially perpendicularly from the distal end of the supported portion 74. The flexible portion 72 can be slanted at an acute or obtuse angle to the supported portion 74, due to its elastic deformation. The connecting portion 73 preferably has a substantially elongated shape, and specifically has a substantially U-shaped configuration having a narrowed open end. The connecting portion 73 includes a first strip portion 73*a* that loops back at the distal end of the flexible portion 72 and extends in a direction away from the circuit board 17, and further includes a second strip portion 73*b* that loops back at the distal end of the first strip portion 73*a* and extends in a direction toward the circuit board 17. On the connecting portion 73, the distance between the strip portions 73*a*, 73*b* preferably is partly shorter. The shorter-distance portions of the strip portions 73*a*, 73*b* are located in the engaging recess 63.

Figure 16:
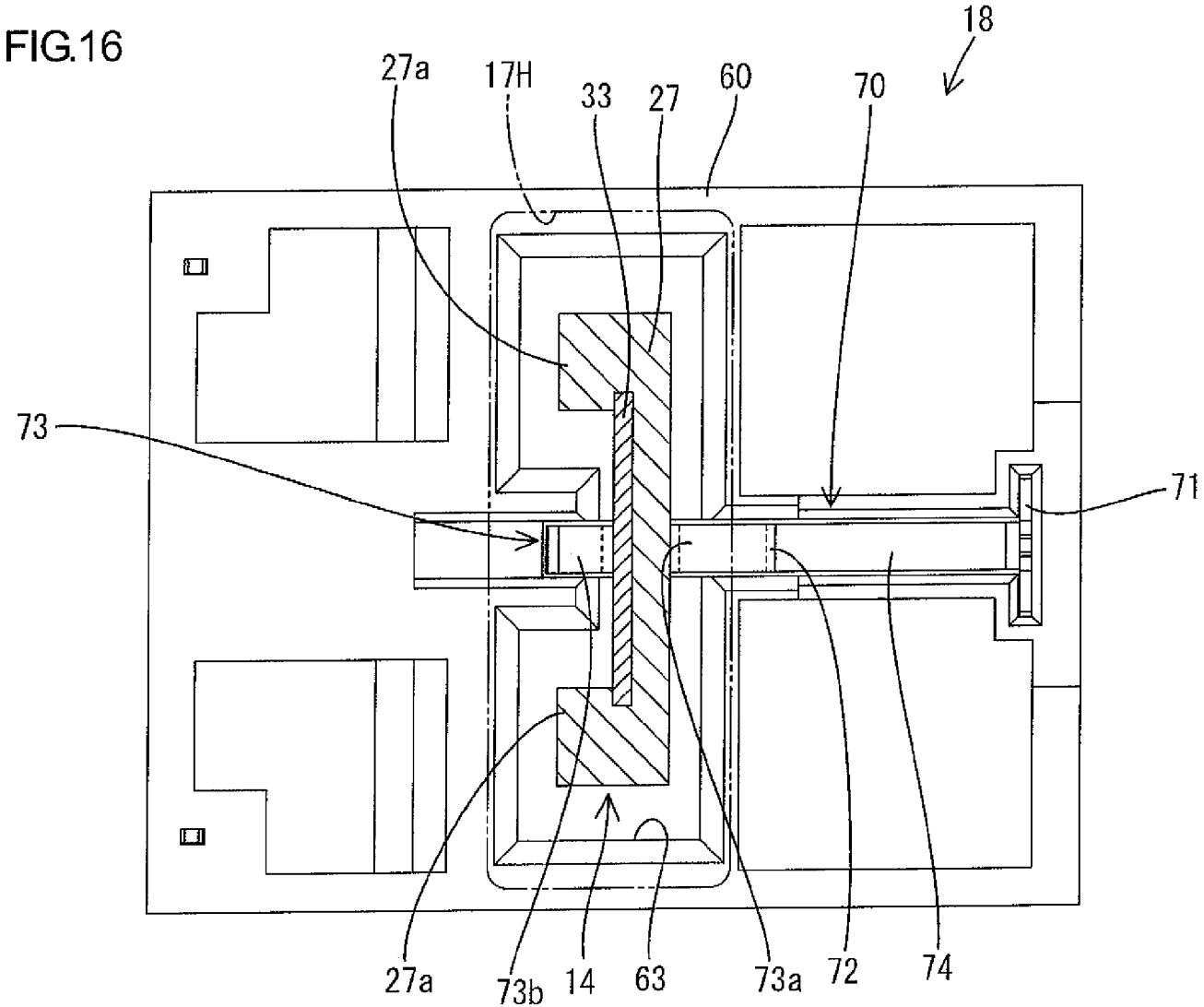
FIG. 16 is a front view of the on-board connector into which the relay connector is fitted.
Figure 17:
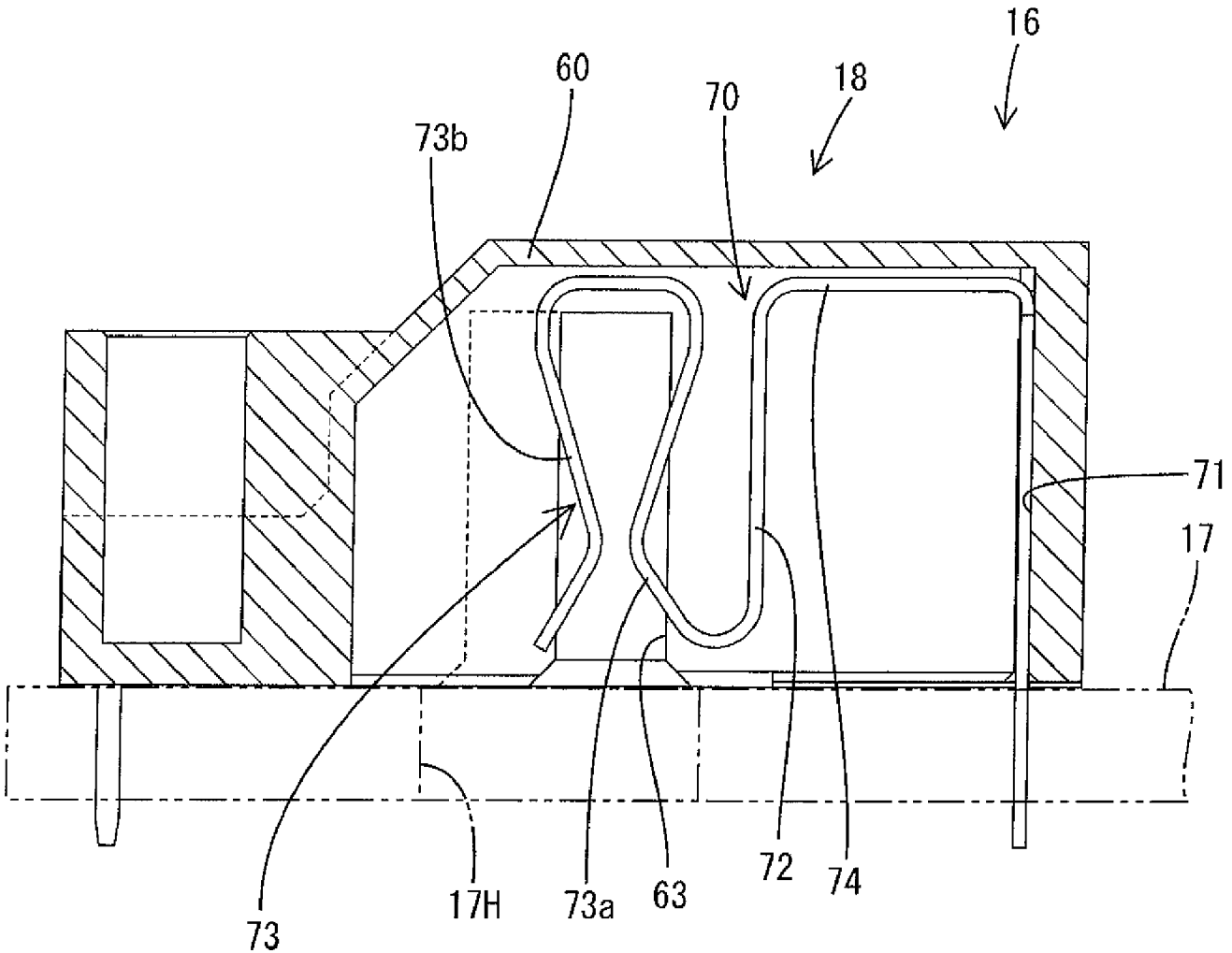
FIG. 17 is a horizontal sectional view of the on-board connector.

The power board 16 is mounted to the chassis 13 by being moved toward the chassis 13 from the back side while the circuit board 17 is kept parallel or substantially parallel to the chassis 13. The mounting direction of the on-board connectors 18 to the relay connectors 14 is directly opposite to the mounting direction of the discharge tube 15 to the relay connectors 14. That is, the fitting direction of the on-board connectors 18 is parallel or substantially parallel to the mounting direction of the discharge tube 15 to the relay connectors 14. At the time of fixation, the wall portion 27 of each relay connector 14 and the board connecting portion 33 arranged along the wall portion 27 penetrate the circuit board 17 through the fitting hole 17H, and are inserted into the engaging recess 63 of the on-board connector 18 so as to be placed between the first strip portion 73*a* and the second strip portion 73*b*, as shown in FIGS. 5 and 16. Consequently, the wall portion 27 has contact with the first strip portion 73*a*, while the board connecting portion 33 has contact with the second strip portion 73*b*. The connecting portion 73 deforms elastically so as to increase the distance between the first strip portion 73*a* and the second strip portion 73*b*. The relay connector 14 is thus fitted into the on-board connector 18, and thereby the relay terminal 30 is conductively connected to the output terminal 70. Consequently, the power board 16 is connected to the discharge tubes 15 via the relay connectors 14, so that the power from the power board 16 can be supplied to the discharge tubes 15. When the on-board connectors 18 have reached a proper state of being fitted onto the relay connectors 14, the power board 16 is screwed to the chassis 13.

When the power board 16 is attached to the relay connector 14, the board connecting portion 33 in the engaging recess 63 has elastic contact with the second strip portion or free-end-side strip portion 73*b* of the two strip portions 73*a*, 73*b* of the connecting portion 73 on the opposite side of the flexible portion 72, while the wall portion 27 has elastic contact with the first strip portion 73*a* of the two strip portions 73*a*, 73*b* of the connecting portion 73 on the side of the flexible portion 72. According to the construction, if the board connecting portion 33 of the relay terminal 30 displaces from the output terminal 70 to the flexible portion 72 side, the whole connecting portion 73, together with the board connecting portion 33 and the wall portion 27, moves to the flexible portion 72 side while the connection between the board connecting portion 33 and the free-end-side strip portion 73*b* is maintained. On the other hand, if the board connecting portion 33 displaces from the output terminal 70 to the free end side or to the opposite side of the flexible portion 72, the free-end-side strip portion 73*b* of the connecting portion 73 is pushed by the board connecting portion 33 so as to move to the free end side. Then, the connection between the board connecting portion 33 and the free-end-side strip portion 73*b* is also maintained.

In the construction that includes a plurality of output terminals 70 and a plurality of relay terminals 30 arranged in lines, the output terminals 70 may be displaced in the array direction from the relay terminals 30 due to some reason such as the difference in thermal expansion rate between the circuit board 17 as a mounting base for the output terminals 70 and the chassis 13 as a mounting base for the relay terminals 30.

For this reason, in the present preferred embodiment, the connecting portion 73 is arranged on the output terminal 70 so as to be elongated in a direction substantially perpendicular to the array direction, while the board connecting portion 33 is arranged on the relay terminal 30 so as to define a plate-shaped configuration that is wider than the connecting portion 73 and parallel or substantially parallel to the array direction, so that the wide board connecting portion 33 has contact with the elongated connecting portion 73. The board connecting portion 33 is preferably large in width along the array direction, and therefore the connection between the board connecting portion 33 and the connecting portion 73 can be maintained even if the relay terminal 30 displaces in the array direction from the output terminal 70.

The fitting holes 17H are formed as through holes on the circuit board 17. This enables the on-board connectors 18 to be arranged on the back surface of the circuit board 17 on the opposite side of the chassis 13.

The relay terminal 30 is fitted into the engaging recess 63 so that the clearance space is left between the relay terminal 30 and the inside surface of the engaging recess 63. Due to the clearance space, the relay terminal 30 is movable within the engaging recess 63. For example, the relay terminal 30 is fitted into the engaging recess 63 so as to be movable in the vertical direction in FIG. 5, i.e., in the inserting direction. Even when the relay terminal 30 moves or displaces in the inserting direction, the connection to the output terminal 70 can be maintained. Specifically, the margin for contact, which extends toward the far end of the engaging recess 63 from the contact portion formed between the board connecting portion 33 and the connecting portion 73, is preferably larger than the allowed movement distance along the inserting direction, as shown in FIG. 5. Thereby, the connection between the relay terminal 30 and the output terminal 70 can be maintained. The length of the wall portion 27 is designed so that the distal end of the relay terminal 30 is prevented from contact with the far end of the engaging recess 63 when the relay terminal 30 is inserted into the engaging recess 63.

The relay connector 14 of the present preferred embodiment is formed to include a holder 20 having an insulation property and to be mounted to the chassis 13, and further include a relay terminal 30 mounted to the holder 20 and capable of electrical connection to the discharge tube 15 and the power board 16, as described above. That is, the relay terminal 30 is immune to direct contact with the chassis 13. This enables the use of a metallic chassis 13.

The holder 20 is formed to be capable of penetrating through the mounting hole 13H of the chassis 13. Further, the elastic retaining portions 25 capable of elastic deflection and extending substantially parallel to the through direction of the mounting hole 13H, and the engaging surfaces 26 substantially perpendicular to the through direction of the mounting hole 13H are provided on the outer surface of the holder 20. The holder 20 is fixed to the chassis 13 while the chassis 13 is sandwiched between the elastic retaining portions 25 and the engaging surfaces 26. According to the construction, the relay connector 14 can be mounted to the chassis 13 simply by inserting the holder 20 into the mounting hole 13H.

The discharge tube 15 is electrically connected to the tube connecting portion 31 within the container room 23. Thereby, foreign substances are prevented from interference with the connection between the discharge tube 15 and the relay terminal 30.

Further, the board connecting portion 33 is arranged along the wall portion 27, and thereby the board connecting portion 33 is prevented from deformation, or the like, caused by interference from a foreign substance.

On the holder 20, the container room 23 (or the tube engaging portion) that allows the discharge tube 15 to enter therein after approaching along a direction substantially perpendicular to the surface of the chassis 13 is provided, and further the wall portion 27 (or a power engaging portion) that allows the on-board connector 18 of the power board 16 to engage therewith after approaching along a direction substantially perpendicular to the surface of the chassis 13 is provided.

Thus, each of the mounting direction of the discharge tube 15 to the relay connectors 14 and the mounting direction of the power boards 16 to the relay connectors 14 is set to be substantially perpendicular to the surface of the chassis 13. Therefore, the discharge tubes 15 and the power boards 16 can be mounted to the chassis 13 so as to define a stack structure.

Preferred Embodiment 2

Figure 18:
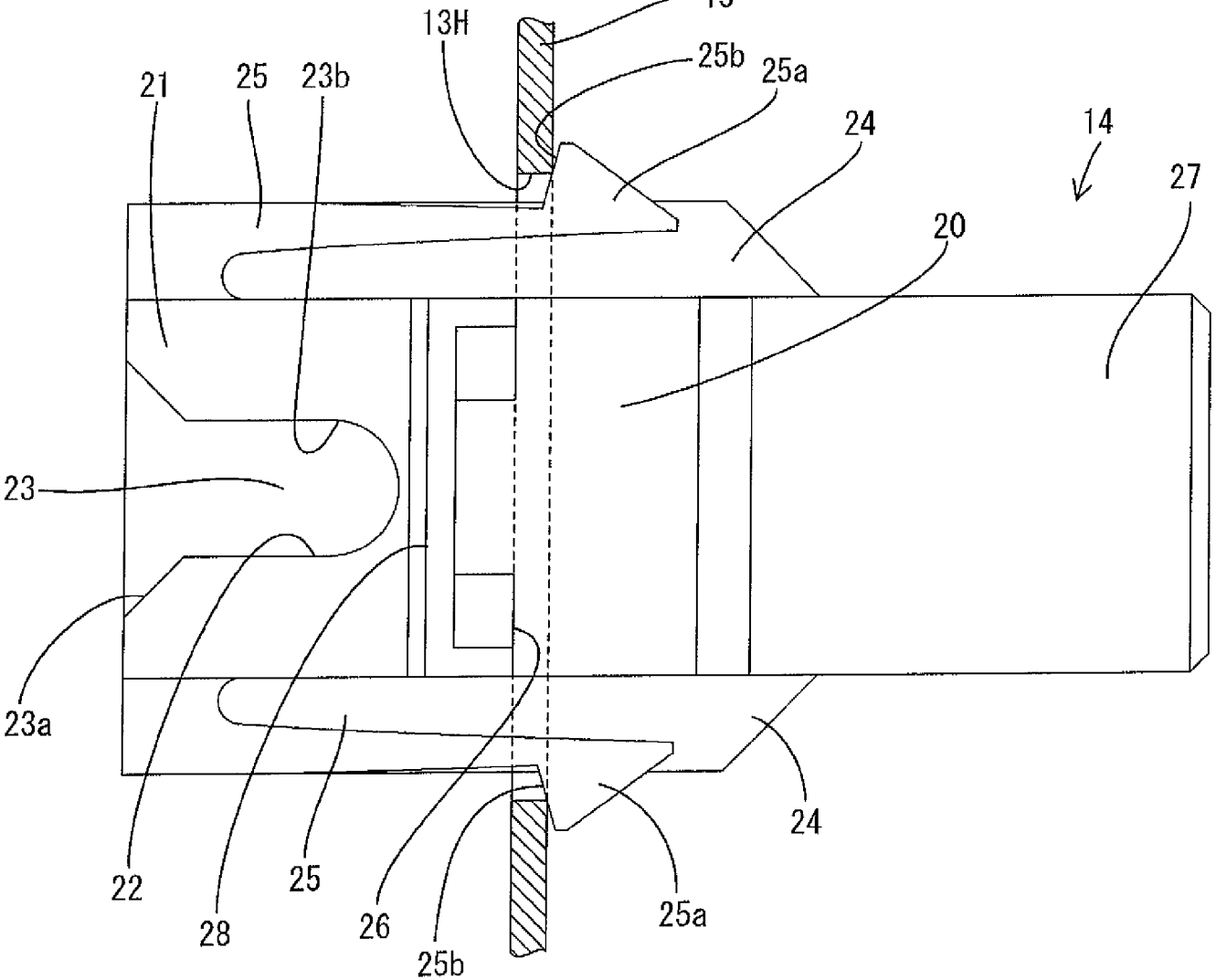
FIG. 18 is a sectional view showing a mounting structure of a relay connector and a chassis according to preferred embodiment 2 of the present invention.

Next, preferred embodiment 2 of the present invention will be explained with reference to FIG. 18. In preferred embodiment 2, the construction of the retaining protrusion 25*a* of an elastic retaining portion 25 differs from that of preferred embodiment 1. The other constructions are similar to preferred embodiment 1. Therefore, the same constructions are designated by the same symbols, and explanations for the constructions, operations and effects thereof are omitted.

In preferred embodiment 2, the surface of the retaining protrusion 25*a* of each elastic retaining portion 25, which abuts on the opening edge of the mounting hole 13H, is formed of an inclined surface 25*b* that is tilted at an angle to the thickness direction of the chassis 13 (i.e., to the mounting direction of the relay connector 14 to the chassis 13). According to the construction, the chassis 13 can be infallibly sandwiched between the elastic retaining portions 25 and the engaging surfaces 26, even if the chassis 13 has variation in thickness.

Preferred Embodiment 3

Figure 19:
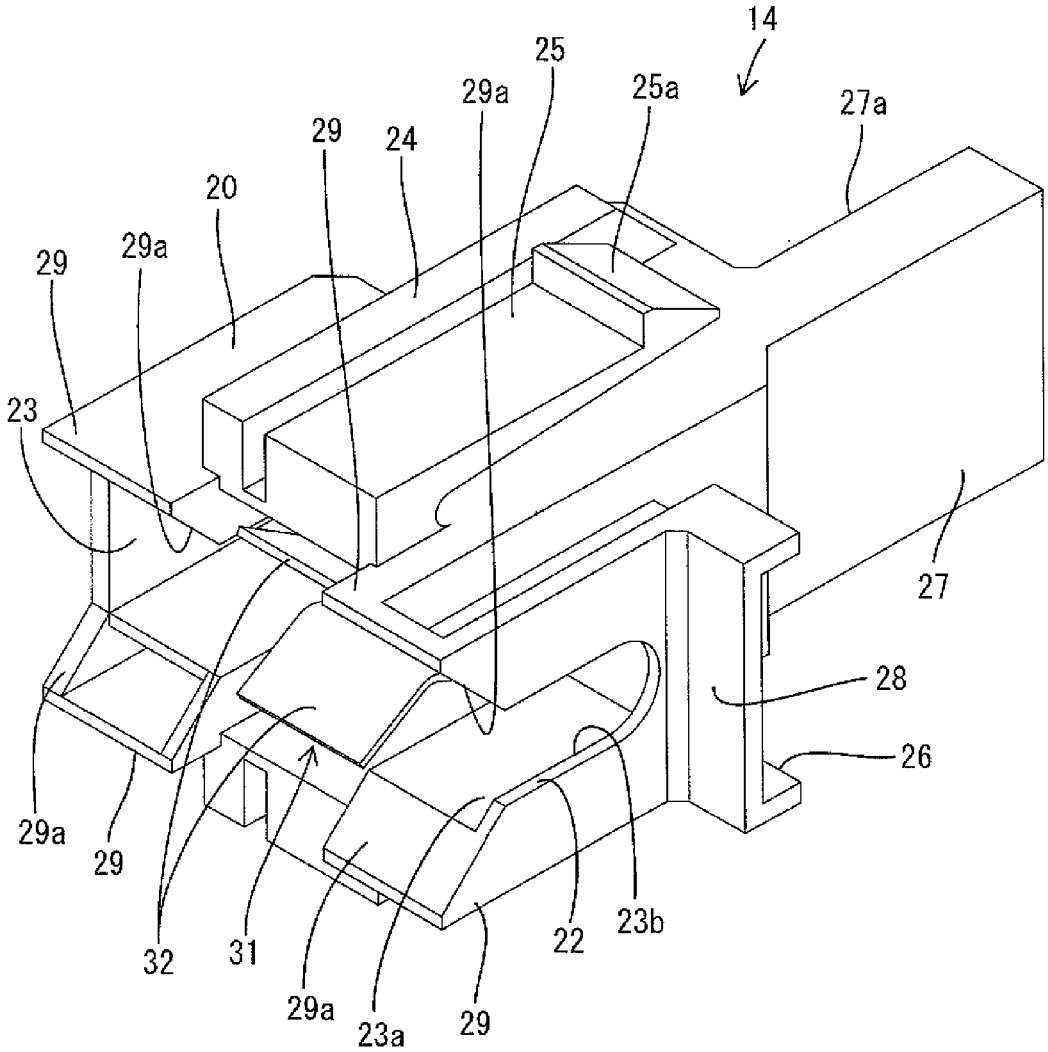
FIG. 19 is a perspective view of a relay connector according to preferred embodiment 3 of the present invention.
Figure 20:
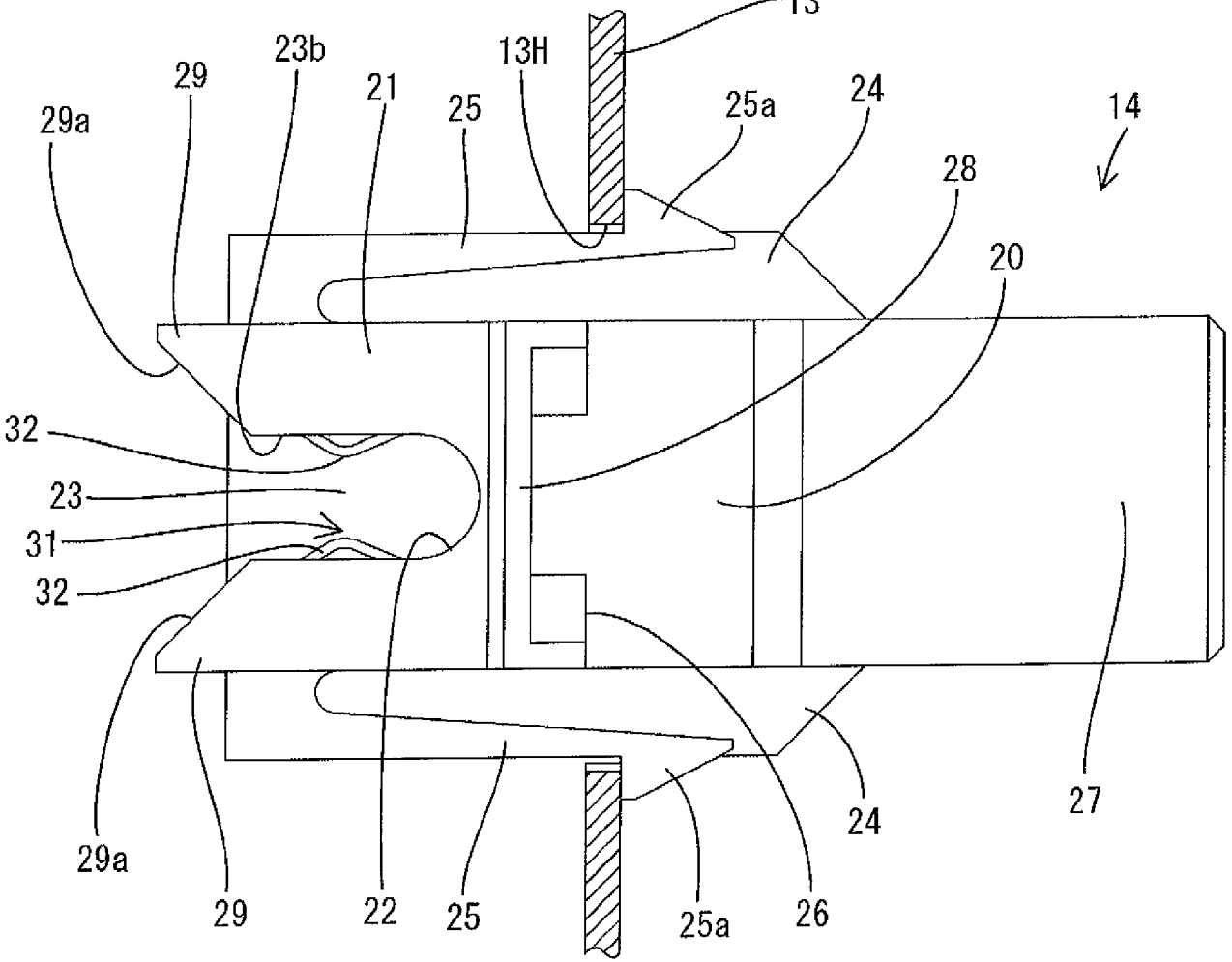
FIG. 20 is a side view of the relay connector according to preferred embodiment 3 of the present invention.

Next, preferred embodiment 3 of the present invention will be explained with reference to FIGS. 19 and 20. In preferred embodiment 3, tapered guiding portions 29 are provided on the holder 20 of each relay connector 14 of preferred embodiment 1. A pair of upper and lower tapered guiding portions 29 are arranged so as to protrude anteriorly from the opening edge of the receiving opening 23*a* that is provided as an opening of the container room 23 for receiving a discharge tube 15. Each tapered guiding portion 29 includes guiding surfaces 29*a* inclined from the mounting direction of the discharge tube 15. The guiding surfaces 29*a* are arranged across the tube connecting portion 31, i.e., on the respective right and left sides thereof.

The tapered guiding portions 29 thus formed can guide a discharge tube 15 into the container room 23 at the time of its fixation. In the case that a discharge tube 15 is mounted to relay connectors 14 while being held by an arm (not shown) of an automatic machine, the discharge tube 15 can be correctly positioned with respect to the tube connecting portion 31 provided in the container room 23, if guided surfaces inclined at the same angle as the guiding surfaces 29*a* of the tapered guiding portions 29 are formed on the arm side.

Preferred Embodiment 4

Next, preferred embodiment 4 of the present invention will be explained with reference to FIGS. 21 to 32. In preferred embodiment 4, the construction of a lighting device 110 differs from that of preferred embodiment 1. The other constructions are similar to preferred embodiment 1. Therefore, the same constructions are designated by the same symbols, and explanations for the constructions, operations and effects thereof are omitted.

Overview of Lighting Device 110

Figure 21:
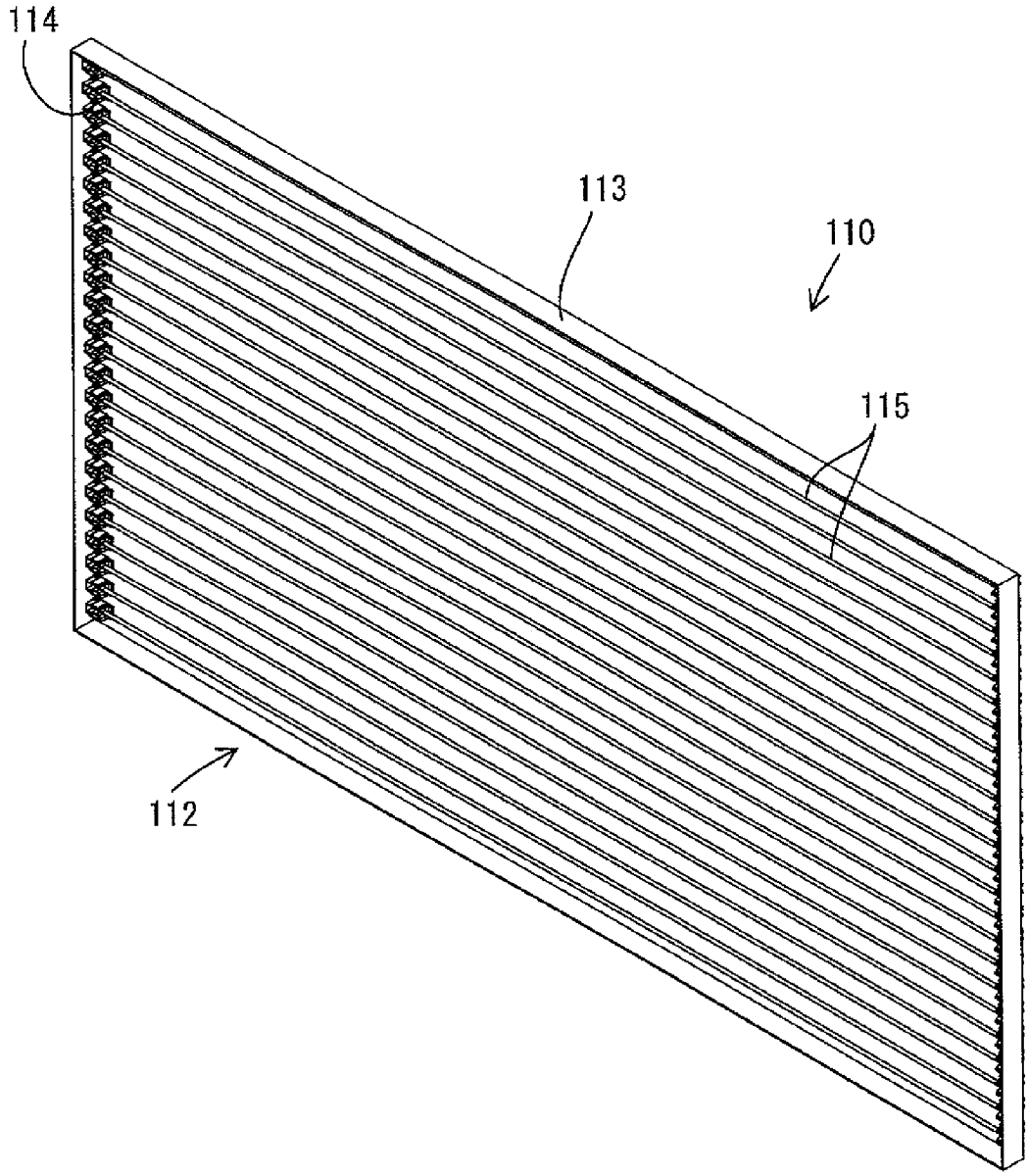
FIG. 21 is a front perspective view of a lighting device according to preferred embodiment 4 of the present invention.
Figure 22:
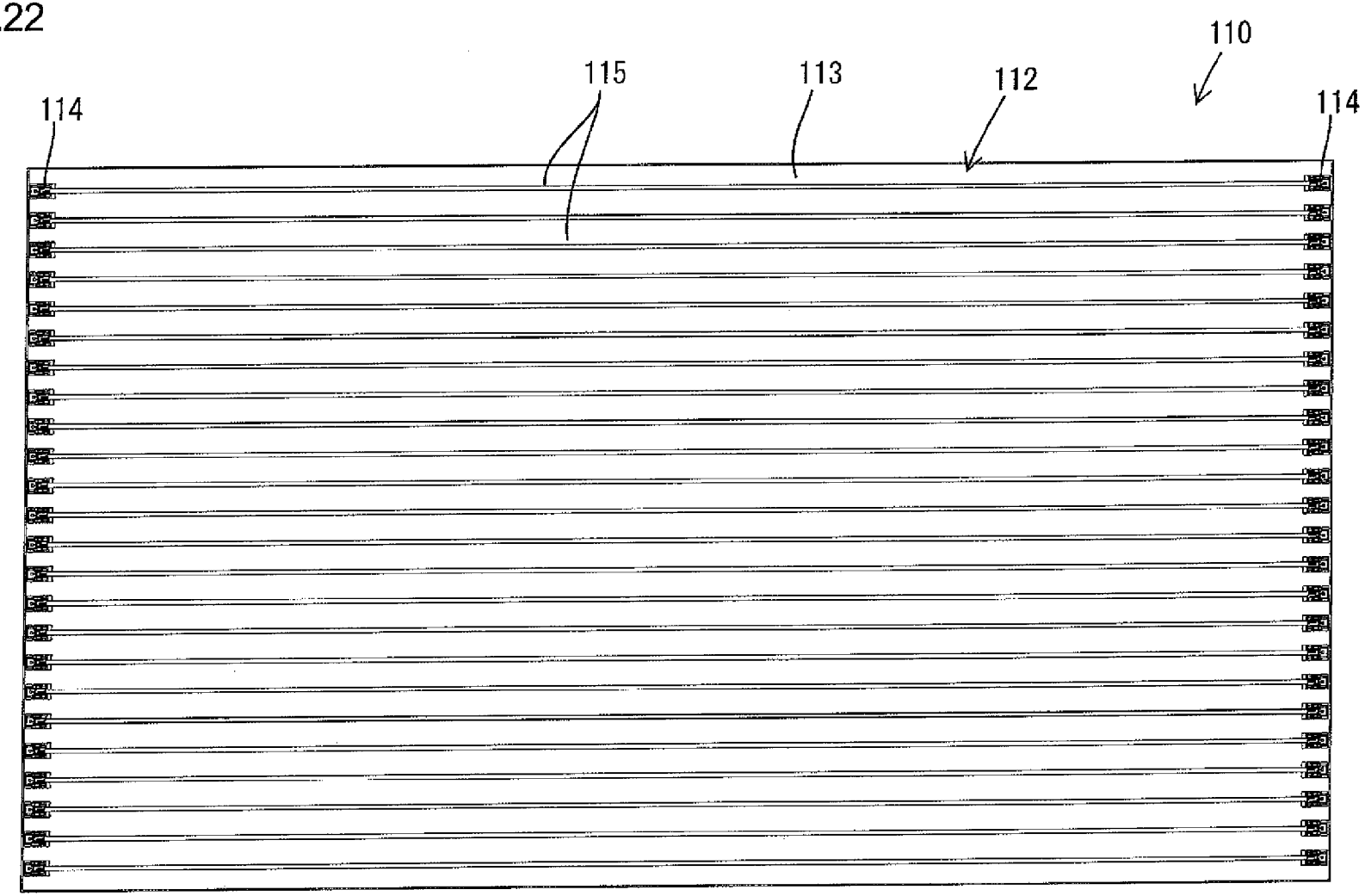
FIG. 22 is a front view of the lighting device.
Figure 23:
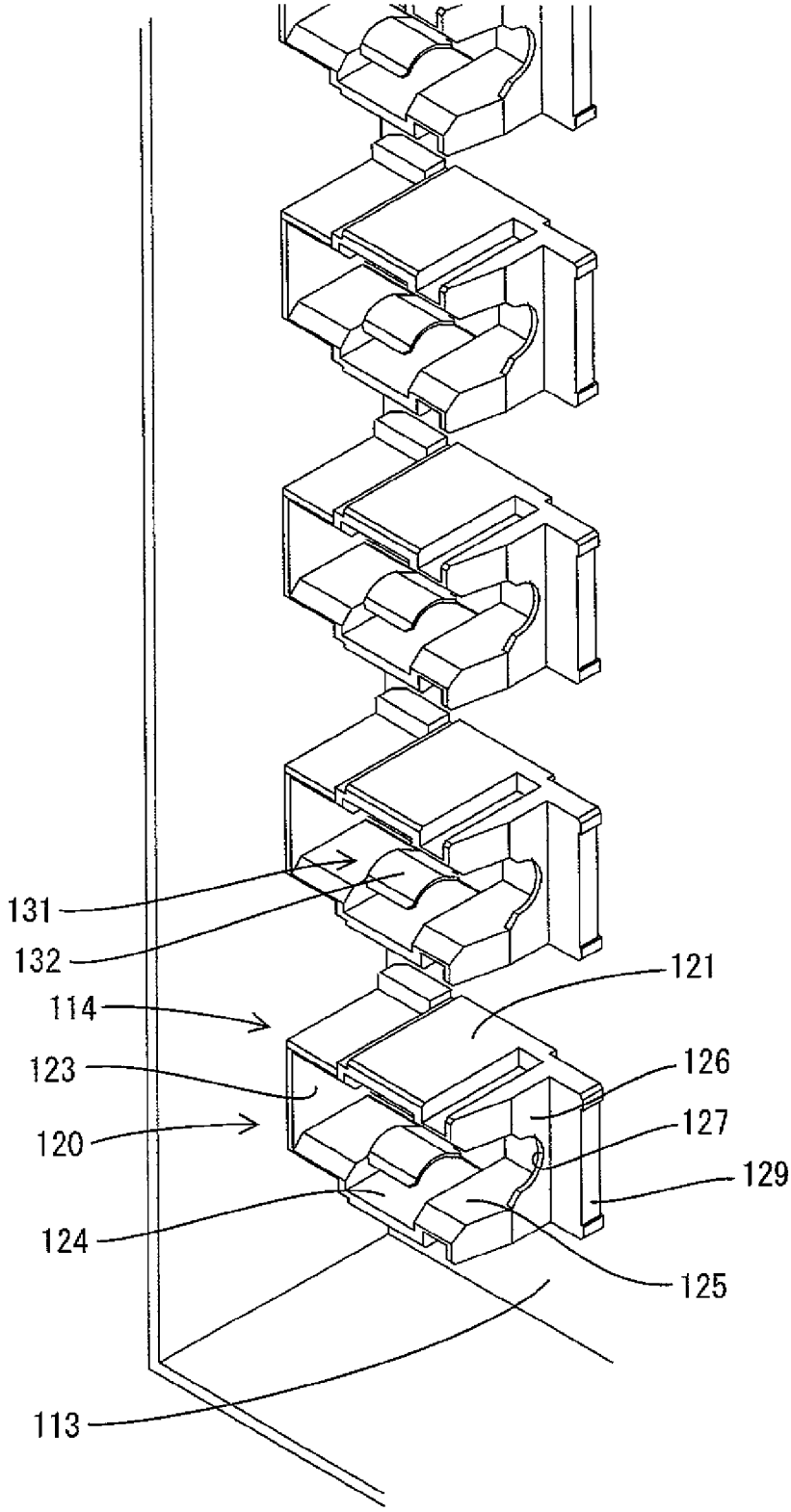
FIG. 23 is a perspective view of relay connectors.
Figure 24:
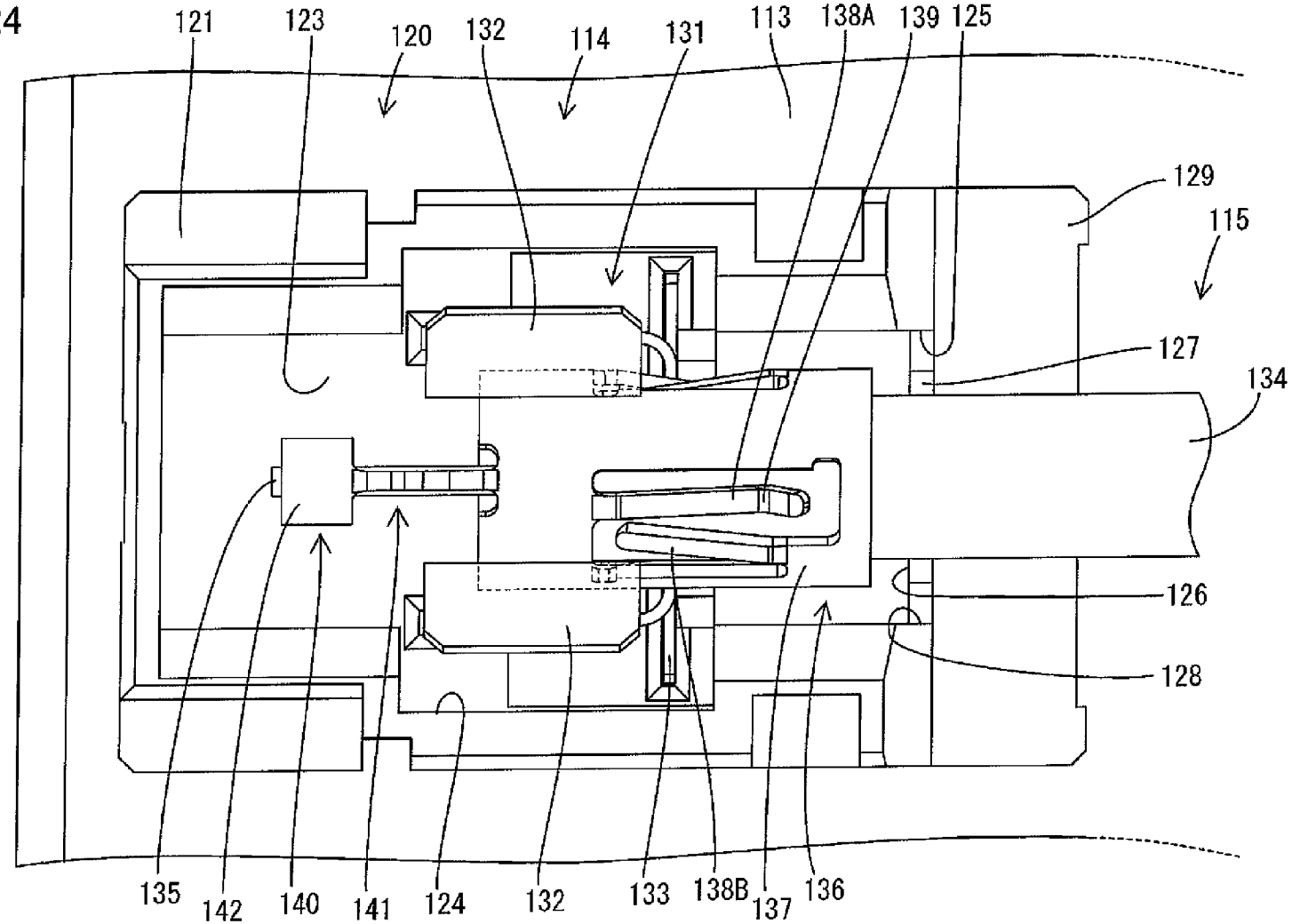
FIG. 24 is a partially-enlarged front view showing a connecting structure between a relay connector and a discharge tube.
Figure 25:
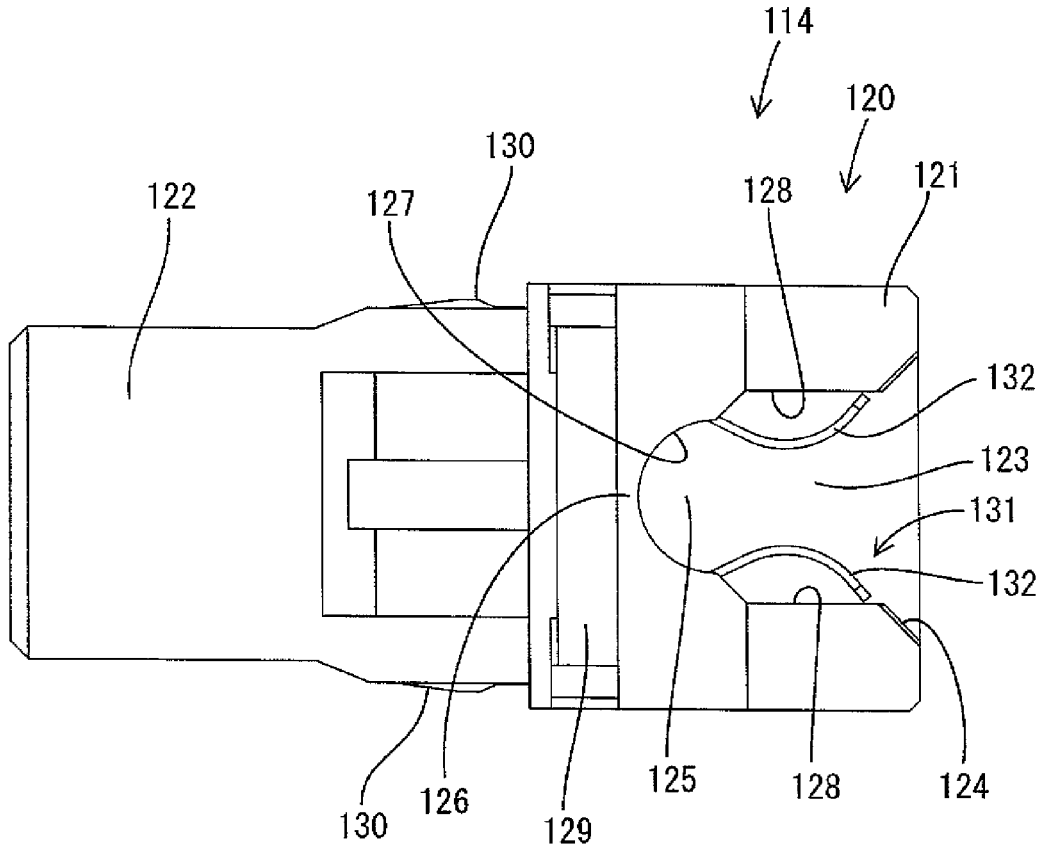
FIG. 25 is a side view of a relay connector.
Figure 26:
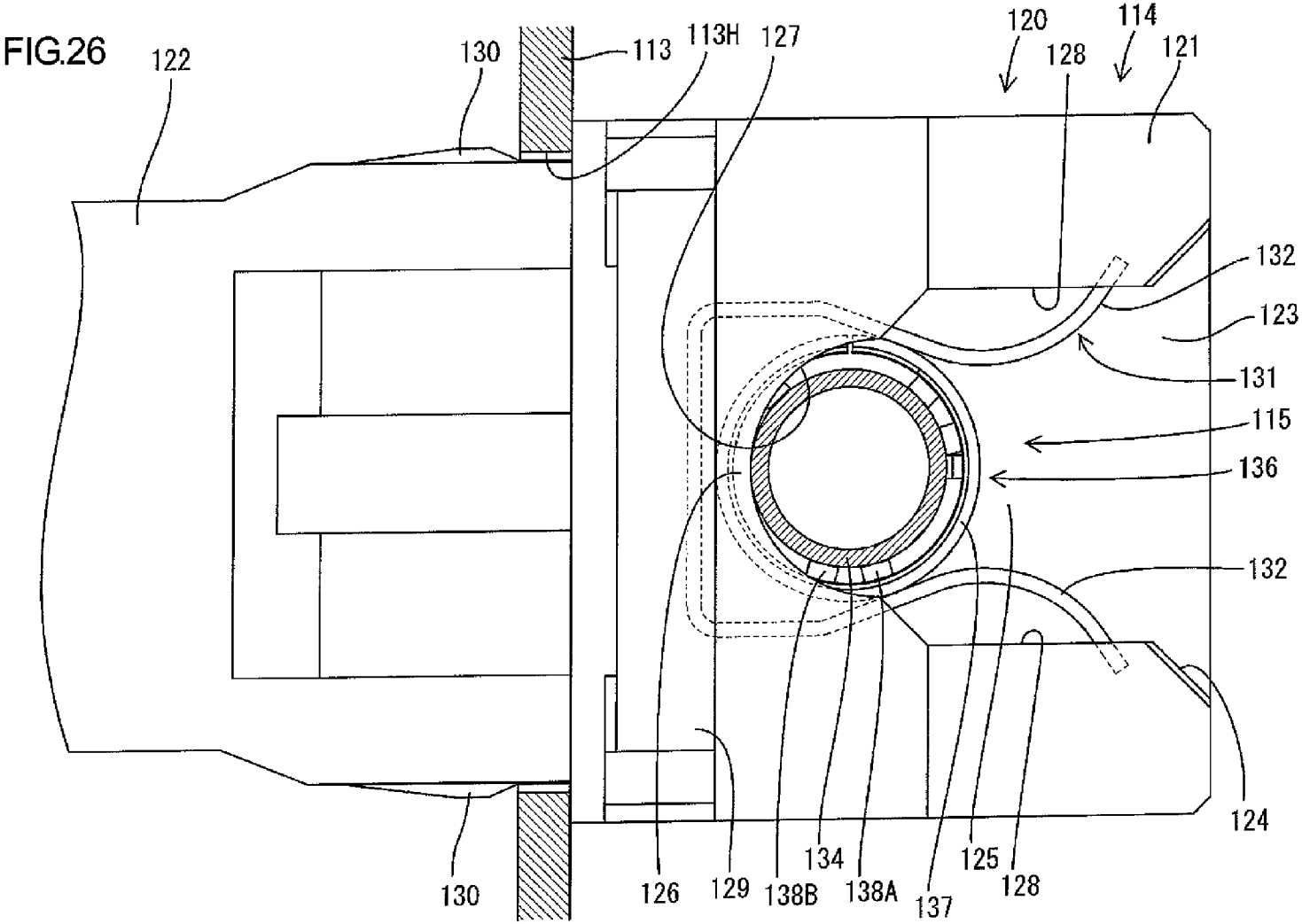
FIG. 26 is a sectional view showing that a ferrule on a discharge tube is capable of engaging with a stopper.
Figure 27:
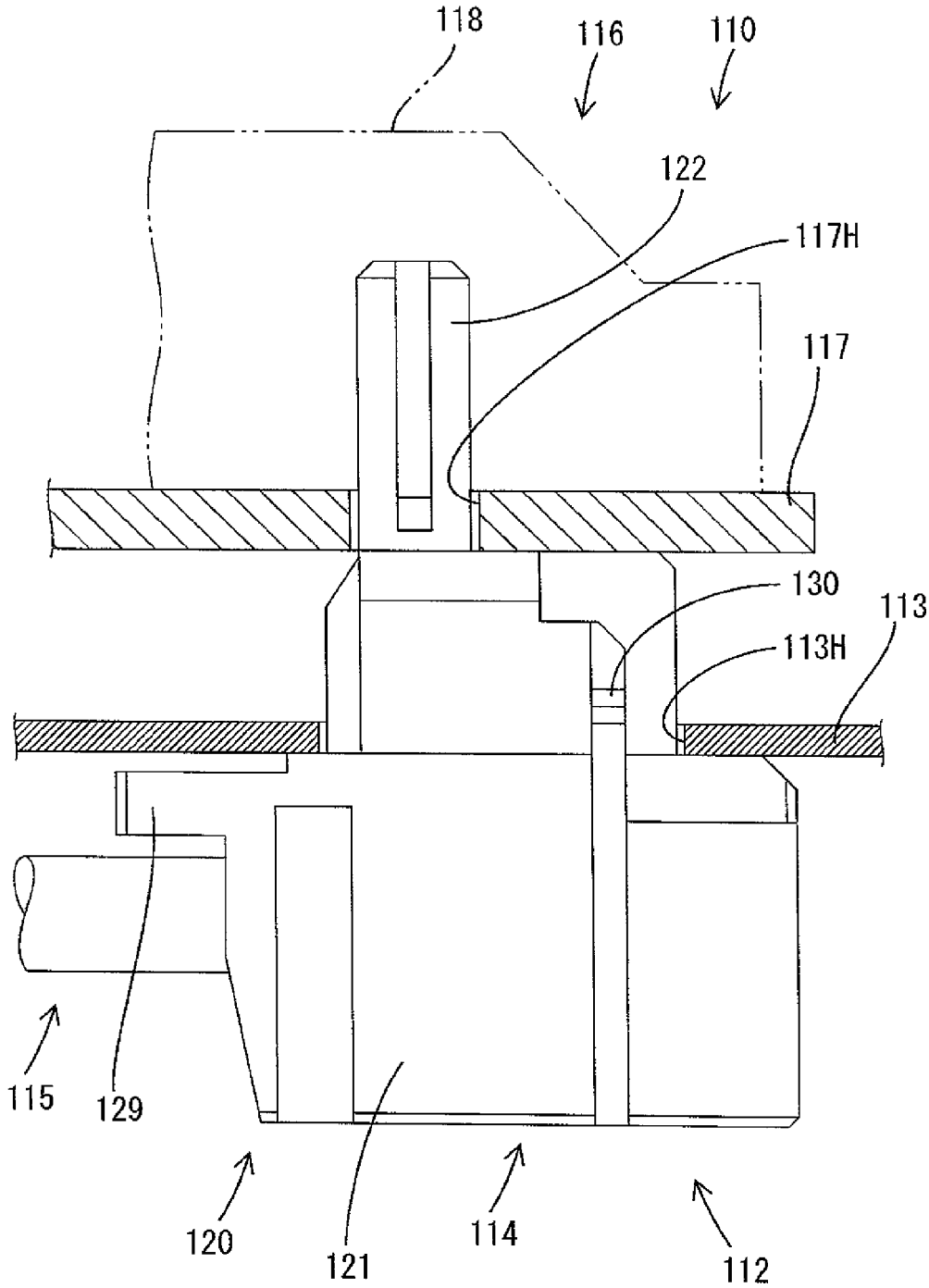
FIG. 27 is a sectional view showing a connecting structure between a relay connector and a power board.

The lighting device 110 includes a lamp unit 112 and power boards 116, as shown in FIGS. 21 and 22. The lamp unit 112 includes a metallic chassis 113, which preferably has a substantially horizontally-elongated rectangular plate and functions as a reflector plate. Further included are a plurality of discharge tubes 115 held in a horizontal position and vertically arranged on the front side of the chassis 113 so as to be parallel or substantially parallel to one another, and a plurality of relay connectors 114 which are vertically arranged along the lateral edges of the chassis 113 so as to correspond to the discharge tubes 115. The power boards 116 are disposed on the back side of the chassis 113 so as to supply power to the discharge tubes 115 via the relay connectors 114.

A plurality of substantially rectangular mounting holes 113H corresponding to the ends of the discharge tubes 115 are formed through the chassis 113 so as to extend from the front side to the back side, and are vertically arranged to be level with the respective discharge tubes 115. The relay connectors 114 are mounted through the respective mounting holes 113H.

Relay Connector 114

As shown in FIGS. 23 to 26, each relay connector 114 includes a holder 120 made of synthetic resin, and a relay terminal 131 that is housed in the holder 120 and made of metal (e.g., stainless steel).

The holder 120 includes a box-shaped portion 121 that has a block-shaped configuration as a whole, and further includes a wall portion 122 that projects backward from the back surface of the box-shaped portion 121.

A container room 123 is formed in the box-shaped portion 121, so as to have an opening extending from the front side to the lateral side (i.e., the lateral side on the opposite side of the lateral edge portion of the chassis 113). The front opening portion of the opening of the container room 123 is provided as a receiving opening 124, into which an end portion (or ferrule 136) of the discharge tube 115 is fitted from the front side. The lateral opening portion is provided as an escape opening 125 for preventing interference with the glass tube 134 when the end portion of the discharge tube 115 is held in the container room 123. A stopper 126 (corresponding to a movement restricting portion of the present invention) is formed on the escape opening 125, so as to bulge inward from the opening edge and form a plate-shape configuration. Due to the stopper 126, the escape opening 125 is narrowed so as to form a substantially U-shaped opening. The vertical size of the substantially U-shaped escape opening 125 is preferably smaller than the inner diameter of the body 137 of the ferrule 136 and be equal to or slightly larger than the outer diameter of the glass tube 134 of the discharge tube 115. On the escape opening 125, a concave portion 127 having a semicircular shape is formed on the far end portion of the opening edge. The radius of curvature of the concave portion 127 is preferably equal to or slightly larger than the radius of curvature of the outer circumference of the glass tube 134. On the escape opening 125, a pair of upper and lower guiding portions 128 are formed on areas of the opening edge on the front side of the concave portion 127.

On the box-shaped portion 121, an extended portion 129 extending parallel or substantially parallel to the chassis 113 is formed on the lateral surface of the box-shaped portion 121 that includes the escape opening 125. The extended portion 129 extends so as to separate the front surface of the chassis 113 from the escape opening 125. A pair of upper and lower retaining protrusions 130 are formed on the outer surface (i.e., upper surface and lower surface) of the box-shaped portion 121.

The relay terminal 131 is held within the holder 120. The relay terminal 131 can be formed by bending a metallic plate that is formed into a predetermined shape by punching, for example. The relay terminal 131 includes a pair of vertically symmetrical elastic pressing portions 132 including curved plates, and further includes a board connecting portion 133 defining a flat plate-shaped portion that projects to the back side. The pair of elastic pressing portions 132, which are housed in the container room 123, can deflect elastically and vertically so as to increase distance therebetween. The vertical distance between the pair of elastic pressing portions 132 is shortest at a position corresponding to the front side of the concave portion 127 of the stopper 126. The minimum distance between the elastic pressing portions 132, when the elastic pressing portions 132 are not forced into elastic deflection or are in a free state, is preferably smaller than the outer diameter of the body 137 of the ferrule 136 attached on the discharge tube 115. On the other hand, the board connecting portion 133 projects from the back surface of the box-shaped portion 121 so as to be exposed to the outside of the holder 120, and extends backwards along the wall portion 122.

When the relay connector 114 is mounted to the chassis 113, the wall portion 122 of the holder 120 is inserted into a mounting hole 113H from the front side of the chassis 113. Thereby, the outer surface of the box-shaped portion 121 comes in contact with the opening edge of the mounting hole 113H on the front surface of the chassis 113, while the retaining protrusions 130 are locked by the opening edge of the mounting hole 113H on the back surface of the chassis 113. Thus, the chassis 113 is sandwiched between the outer surface of the box-shaped portion 121 on the front side and the retaining protrusions 130 on the back side. Thereby, the holder 120 is fixed to the chassis 113 so that its movement in the mounting direction (i.e., the through direction of the mounting hole 113H) is restricted. Then, the mounting of the relay connector 114 to the chassis 113 is completed. When the relay connector 114 is attached to the chassis 113, the box-shaped portion 121 as the front end portion of the holder 120 projects (or is exposed) to the front side of the chassis 113 while the wall portion 122 as the back end portion of the holder 120 projects (or is exposed) to the back side of the chassis 113.

Discharge Tube 115

Figure 28:
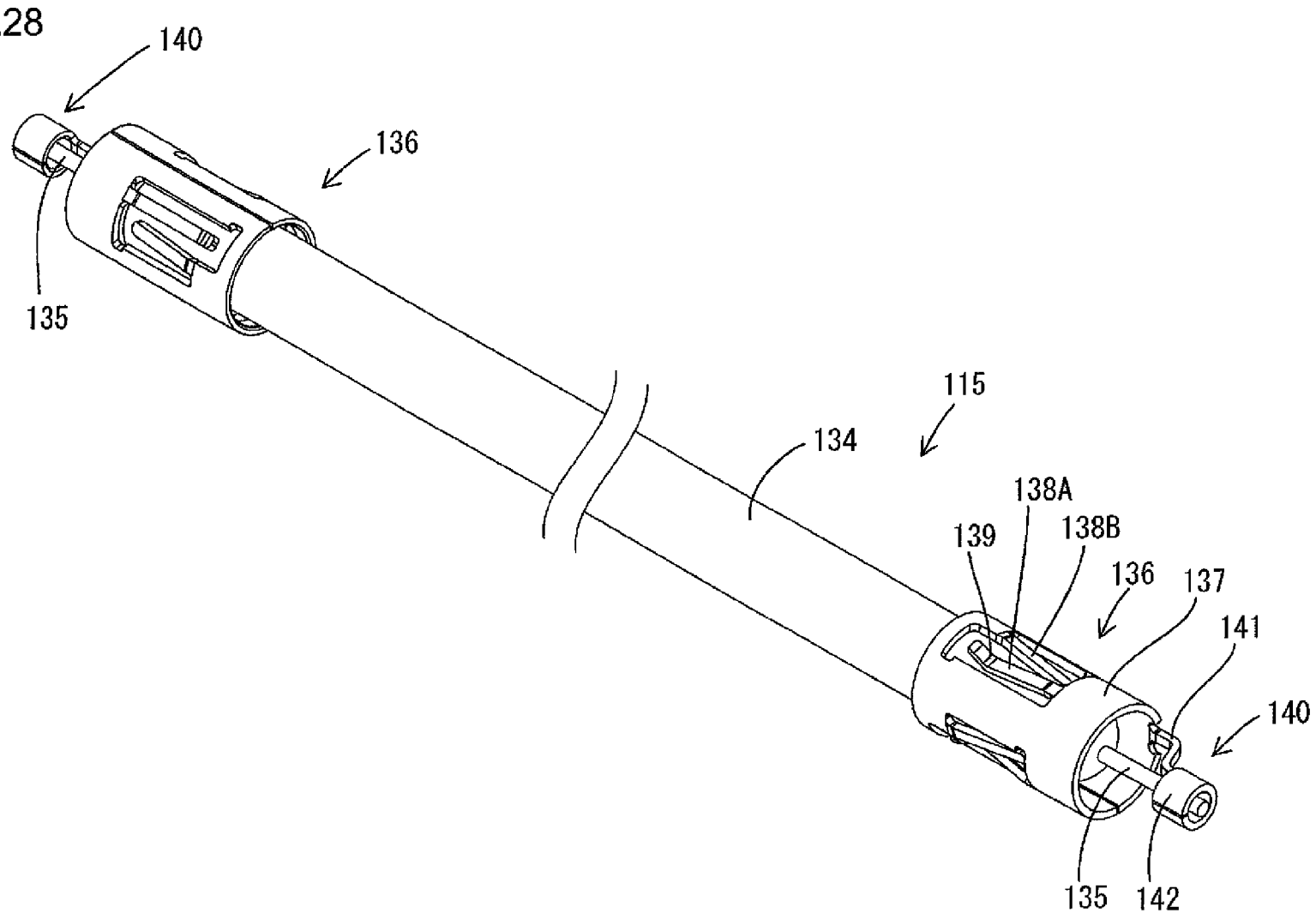
FIG. 28 is a perspective view of a discharge tube.

Referring to FIG. 28, each discharge tube 115 preferably is formed of a cold cathode fluorescent tube that includes a generally elongated straight glass tube 134 having a circular cross section, and elongated metallic (e.g., nickel or cobalt metal) outer leads 135 which have a circular cross section and project linearly from the respective ends of the glass tube 134 and coaxially with the glass tube 134. Further included are ferrules 136 attached to the respective end portions of the glass tube 134. Mercury is encapsulated in the glass tube 134. Each end portion of the glass tube 134 is melted into a substantially hemispherical shape by heat, and thereby forms a domed portion. The outer lead 135 penetrates the domed portion.

Figure 29:
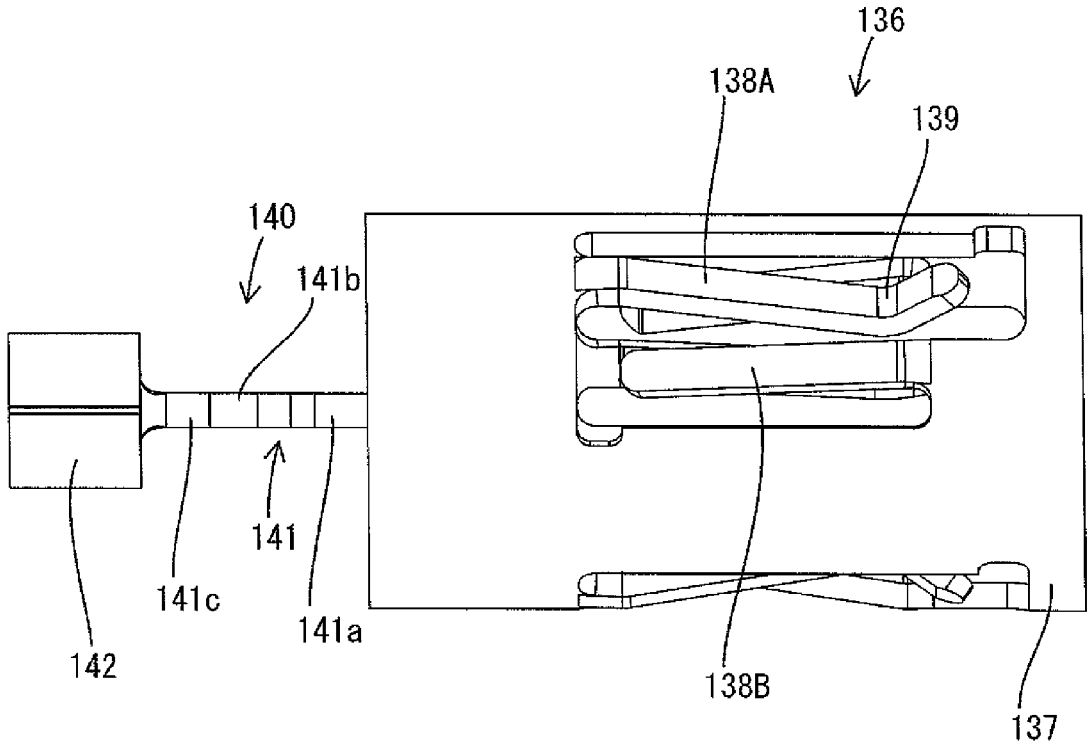
FIG. 29 is a rear view of a ferrule.
Figure 30:
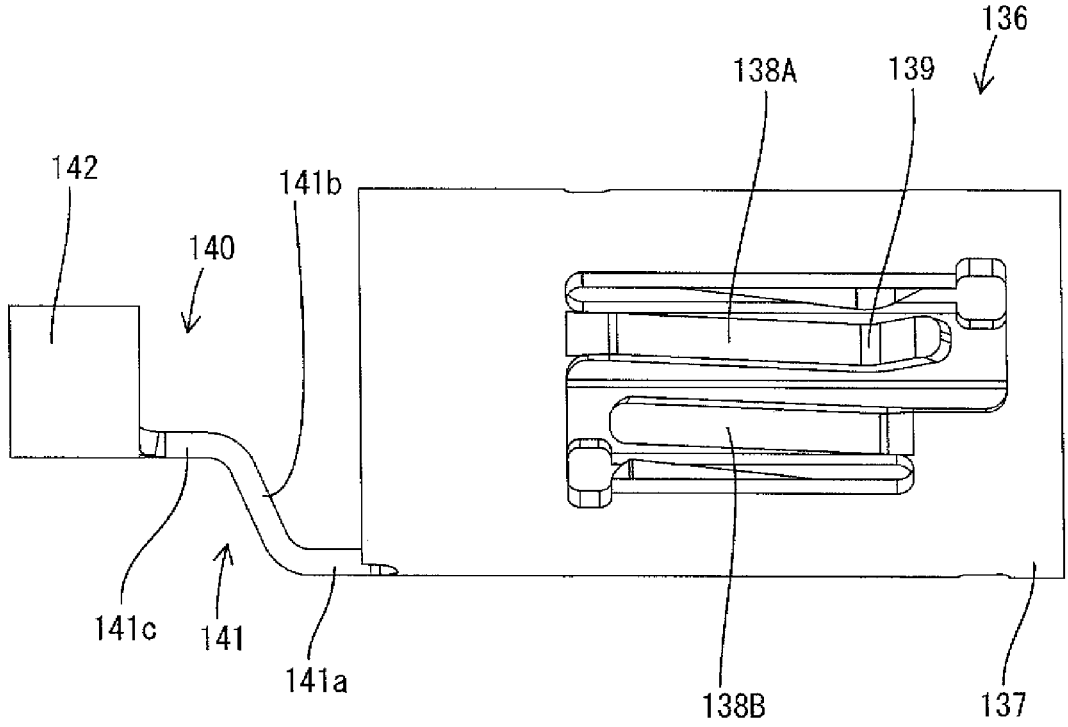
FIG. 30 is a plan view of the ferrule.
Figure 31:
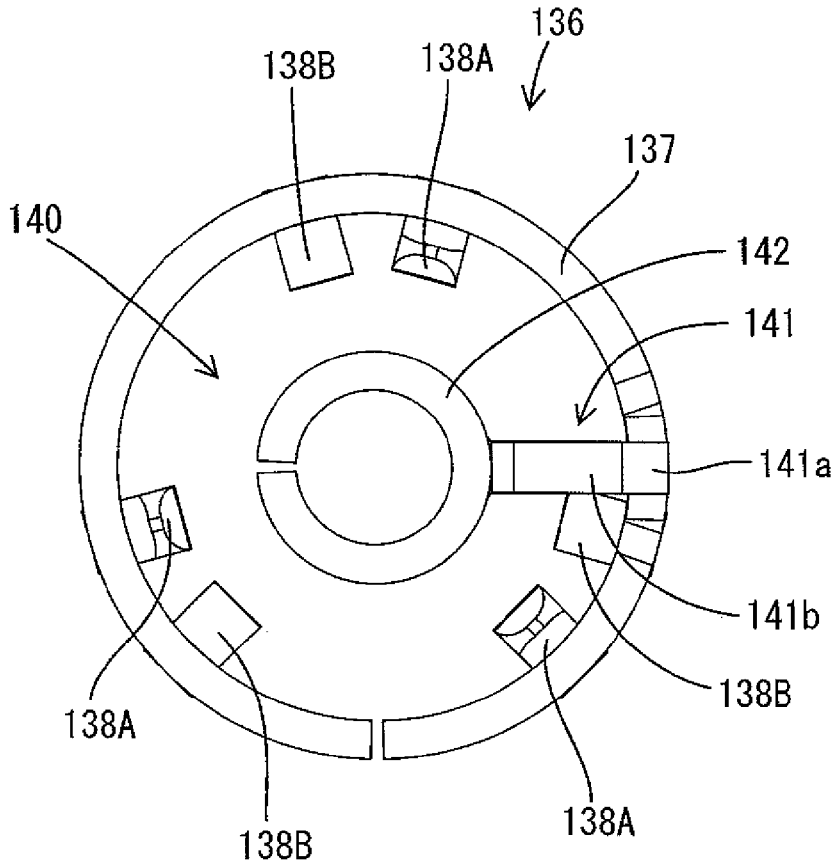
FIG. 31 is a side view of the ferrule.

Referring to FIGS. 29 to 31, each ferrule 136 preferably is a single-piece component, which can be formed by bending or hammering a metallic (e.g., stainless steel) plate that is formed into a predetermined shape by punching, for example. The ferrule 136 includes a body 137 and a conductive portion 140. The body 137 preferably has a substantially cylindrical shape concentric with the glass tube 134. The inner diameter of the body 137 is preferably slightly larger than the outer diameter of the glass tube 134.

Three pairs of elastic gripping portions 138A, 138B are formed on the body 137 by making slit-shaped cuts in portions thereof, which are arranged at even angular intervals along the circumferential direction.

A first elastic gripping portion 138A, i.e., one of a pair of elastic gripping portions 138A, 138B, is generally formed as a cantilevered portion extending posteriorly (specifically, in an oblique direction slightly leaning radially inwardly), which is capable of elastic and radial deflection with a supported point on its proximal end (or anterior end). A curved portion 139 is formed on the distal end portion (or posterior end portion) of the first elastic gripping portion 138A, so as to curve in an oblique direction leaning radially outwardly. The outer surface of the curve (or inwardly facing surface) of the curved portion 139 is provided as a contact point when abutting on the outer circumferential surface of the glass tube 134. The imaginary line that connects the contact points provided on the three first elastic gripping portions 138A forms a circle concentric with the body 137. The diameter of the imaginary circle, when the first elastic gripping portions 138A are not forced into elastic deflection or are in a free state, is preferably smaller than the outer diameter of the glass tube 134.

A second elastic gripping portion 138B, i.e., the other of the pair of elastic gripping portions 138A, 138B, is arranged circumferentially adjacent to the first elastic gripping portion 138A, and is generally formed as a cantilevered portion extending anteriorly or reversely from the first elastic gripping portion 138A (specifically, in an oblique direction slightly leaning radially inwardly), which is capable of elastic and radial deflection with a supported point on its proximal end (or posterior end). The distal end of the second elastic gripping portion 138B is provided as a contact point when abutting on the outer circumferential surface of the glass tube 134. The imaginary line that connects the contact points provided on the three second elastic gripping portions 138B forms a circle concentric with the body 137. The diameter of the imaginary circle, when the second elastic gripping portions 138B are not forced into elastic deflection or are in a free state, is preferably smaller than the outer diameter of the glass tube 134.

On the body 137, a pair of protector portions are formed as cantilevered portions protruding anteriorly from the anterior end edge thereof. The pair of protector portions are arranged circumferentially spaced apart, and extend linearly from the body 137 so as to be flush therewith. The conductive portion 140 is provided as a cantilevered portion that extends anteriorly from between the pair of protector portions. The conductive portion 140 includes a long portion 141 continuous with the anterior end of the body 137, and a cylindrical portion 142 that further projects anteriorly from the anterior end (or distal end) of the long portion 141.

The long portion 141 includes a proximal portion 141*a* that extends from the body 137 so as to be flush with the body 137 and parallel or substantially parallel to the axis thereof, and further includes an intermediate portion 141*b* that extends radially inwardly from the distal end of the proximal portion 141*a* toward the axis of the body 137. Further included is a distal portion 141*c* that extends from the distal end of the intermediate portion 141*b* and parallel or substantially parallel to the axis of the body 137. The cylindrical portion 142 is connected to the distal end of the distal portion 141*c*. The width of the long portion 141 is preferably sufficiently small for the length of the long portion 141. Therefore, the long portion 141 is capable of elastic deformation in the radial direction of the body 137, elastic deformation in a direction intersecting with the radial direction (and intersecting with the longitudinal direction of the long portion 141), and elastic torsional deformation around the long portion 141 itself as the axis.

The cylindrical portion 142, which can be formed by bending a portion laterally extending from the distal end of the long portion 141 into a cylindrical shape, for example, is arranged substantially coaxially with the body 137. The cylindrical portion 142 is capable of displacement around the axis of the ferrule 136 and radial displacement, due to elastic deflection of the long portion 141.

Attachment of Ferrule 136 to Glass Tube 134

Next, an assembling process for attaching a ferrule 136 to a glass tube 134 will be explained.

During the assembling process, while a ferrule 136 and a glass tube 134 are held by respective holding devices (not shown), the ferrule 136 and the glass tube 134 are moved relatively and coaxially so as to approach each other. Thereby, the body 137 is fitted onto the glass tube 134. When the body 137 begins engagement, the contact points provided on the distal end portions of the three pairs of elastic gripping portions 138A, 138B have elastic contact with the outer circumference of the glass tube 134. The contact points slide on the outer circumferential surface of the glass tube 134, as the assembling process proceeds. Then, the tip of the outer lead 135 having passed through the body 137 begins to enter the hollow of the cylindrical portion 142. When both of the holding devices have thereafter reached predetermined final positions, the ferrule 136 and the glass tube 134 are axially positioned in proper positions, resulting in the tip end portion of the outer lead 135 circumferentially surrounded by the cylindrical portion 142. At the time, the tip end portion of the outer lead 135 will not greatly protrude from the anterior end of the cylindrical portion 142. That is, it slightly protrudes out of the cylindrical portion 142, or is aligned with the anterior end of the cylindrical portion 142, or alternatively it is located within the cylindrical portion 142.

Thereafter, the cylindrical portion 142 is clamped so as to deform with diameter reduction. After being clamped, the cylindrical portion 142 is electrically conductively fixed to the outer lead 135 by welding, and consequently the ferrule 136 is integrated with the glass tube 134. Then, the assembling process terminates, and the discharge tube 115 is completed.

When the ferrule 136 is attached to the glass tube 134, the body 137 is concentrically held on the glass tube 134 due to the elastic holding function of the three pairs of elastic gripping portions 138A, 138B. A gap (airspace) is secured between the outer circumference of the glass tube 134 and the inner circumference of the body 137, so as to extend over the substantially entire circumference.

Figure 40:
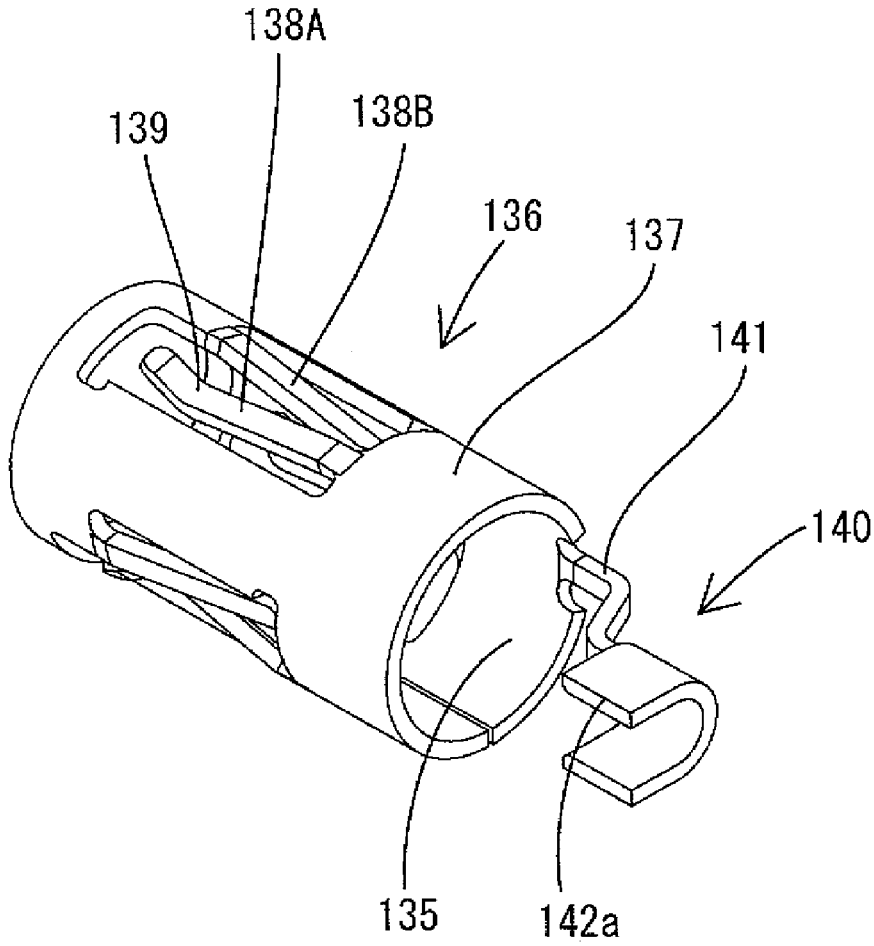
FIG. 40 is a perspective view showing a modification of a ferrule.
Figure 41:
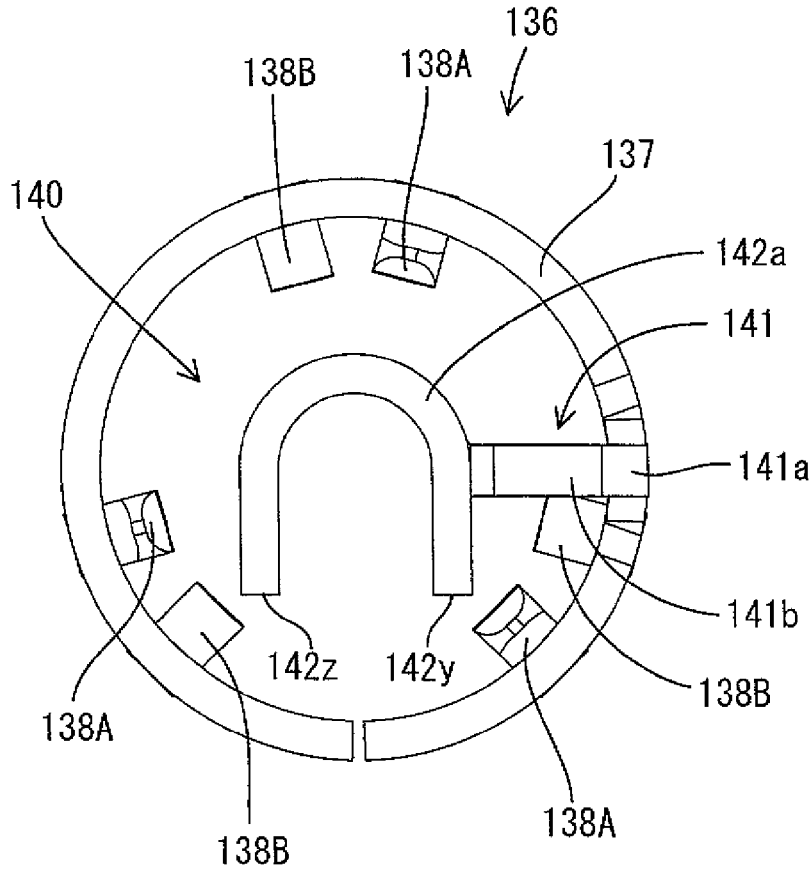
FIG. 41 is a side view of FIG. 40.

Instead of the cylindrical portion 142, a U-shaped connecting portion 142*a* may be provided as shown in FIGS. 40 and 41. In this case, after a glass tube 134 is fitted into a ferrule 136, the U-shaped connecting portion 142*a* is bended so as to hug the outer lead 135, in order to achieve electrical connection between the outer lead 135 and the connecting portion 142*a*. According to the present preferred embodiment thus including the bendable U-shaped connecting portion 142*a*, electrical connectivity with the outer lead 135 can be further improved.

Mounting of Discharge Tube 115 to Relay Connectors 114

The discharge tube 115, thus assembled, is fixed to relay connectors 114. At the time of fixation, the discharge tube 115 held in a horizontal position is moved toward the front face of the chassis 113, and the end portions and the ferrules 136 of the glass tube 134 are fitted into the container rooms 123 of the relay connectors 114 from the front side. At the time, the pair of elastic pressing portions 132 are pushed by the body 137 of the ferrule 136 so as to open vertically due to elastic deflection. After the body 137 has passed through the shortest-distance portions of the pair of elastic pressing portions 132, the body 137 is pulled deep into the container room 123 due to elastic restoring forces of the elastic pressing portions 132, resulting in the body 137 abutting on the bottom of the container room 123. Then, the mounting of the discharge tube 115 is completed.

The discharge tube 115 thus mounted is held by the pairs of elastic pressing portions 132 at its end portions, and consequently is fixed to the chassis 113 via the relay terminals 131 and the holders 120 provided as the relay terminal 131 mounting bases. At the time, the weight of the discharge tube 115 is received solely by the chassis 113 via the relay connectors 114. That is, the outer leads 135 will not be under load due to the weight of the discharge tube 115.

The pair of elastic pressing portions 132 can have elastic contact with the outer circumferential surface of the body 137, and thereby the outer lead 135 is electrically conductively connected to the relay terminal 131 via the ferrule 136. Further, the glass tube 134 is held due to elastic restoring forces of the pair of elastic pressing portions 132, so as to be pressed against the concave portion 127 of the stopper 126. Therefore, when viewed along the axial direction of the discharge tube 115, the body 137 appears to be positioned so as to partially overlap with the stopper 126. That is, the end edge of the body 137 on the opposite side of the conductive portion 140 is axially positioned in proximity to the stopper 126 so as to be partially faced therewith.

The extended portion 129 is formed on the outer surface of the holder 120, which is perpendicular or substantially perpendicular to the surface of the chassis 113 and includes the escape opening 125 of the container room 123, so as to protrude from between the chassis 113 and the escape opening 125 and extend along the surface of the chassis 113. This results in a long creepage distance from the inside of the container room 123 to the front surface of the chassis 113. Thereby, a leak, from the discharge tube 115 held in the container room 123 to the chassis 113 outside the holder 120, can be prevented.

Overview of Power Board 116

Figure 32:
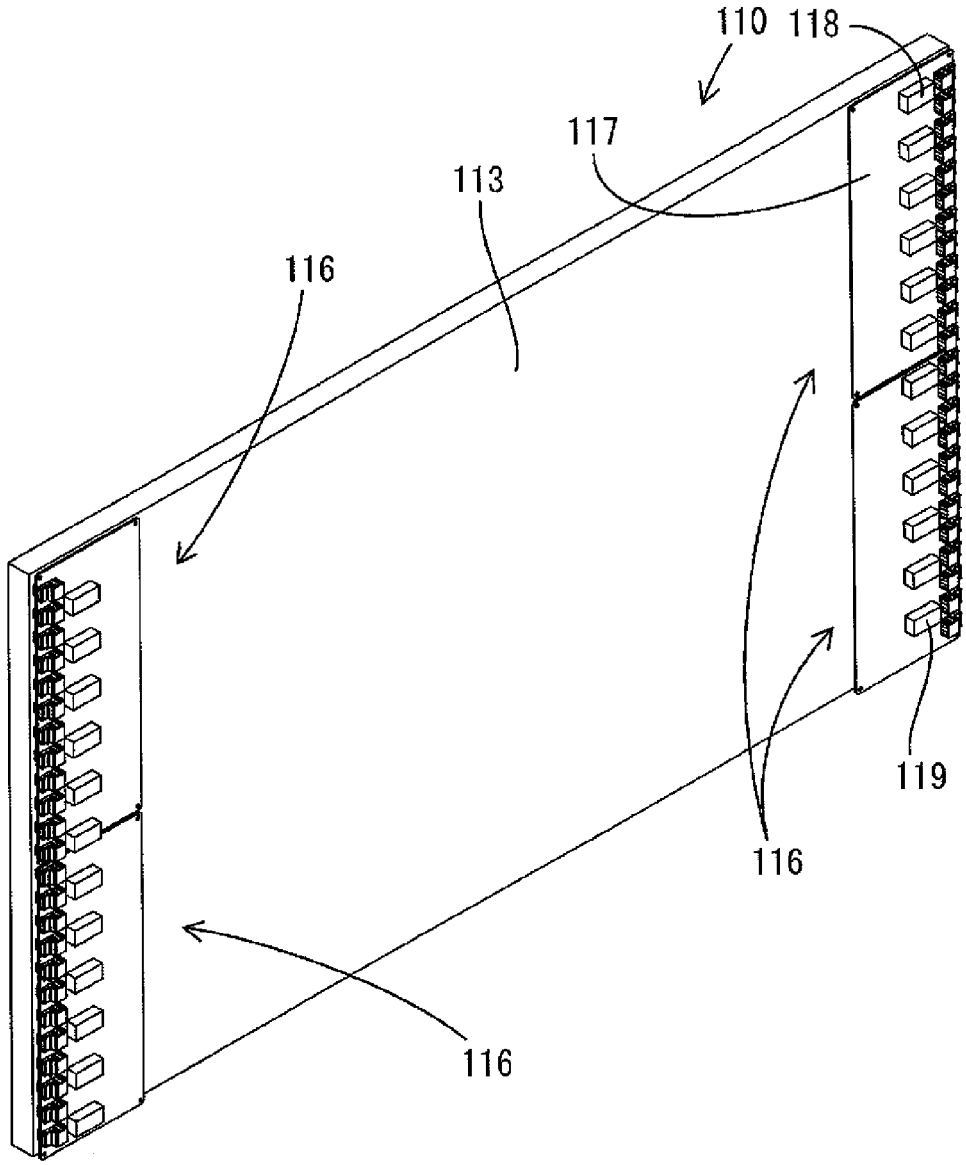
FIG. 32 is a rear perspective view of the lighting device according to preferred embodiment 4 of the present invention.

As shown in FIG. 32, each power board 116 includes a circuit board 117 having a circuit provided on its back surface (i.e., the surface on the opposite side of the chassis 113), electronic components 119 mounted on the back surface of the circuit board 117, and a plurality of on-board connectors 118 mounted on the back surface of the circuit board 117.

The circuit board 117 preferably has a substantially vertically-elongated rectangular shape as a whole, and is preferably formed using a phenolic paper-base copper-clad laminated board (known as a phenolic paper). A plurality of fitting holes 117H having a vertically-elongated rectangular shape are formed through the circuit board 117 so as to extend from the front side to the back side. The plurality of fitting holes 117H are arranged vertically along the lateral side edge of the circuit board 117 so as to correspond to the above-described relay terminals 131 (or relay connectors 114). Each on-board connector 118 includes a housing made of synthetic resin, and an output terminal (not shown) that is completely contained in the housing and made of metal (e.g., nickel silver). The on-board connectors 118 are arranged along the lateral side edge of the circuit board 117 so as to correspond to the respective fitting holes 117H. A fitting space (not shown) is formed on the outer surface of the housing so as to correspond to the fitting hole 117H, and the output terminal is partly exposed to the fitting space.

While the circuit board 117 is kept parallel or substantially parallel to the chassis 113, the power board 116 is moved toward the chassis 113 from the back side and is fixed thereto. At the time of fixation, the wall portions 122 of the relay connectors 114 and the board connecting portions 133 arranged along the wall portions 122 penetrate the circuit board 117 through the fitting holes 117H and are inserted into the fitting spaces of the on-board connectors 118. Thereby, the on-board connectors 118 are fitted onto the relay connectors 114, and the output terminals are conductively connected to the relay terminals 131.

Operational Effects of Preferred Embodiment 4

In preferred embodiment 4, when a discharge tube 115 is supported on relay connectors 114, the stoppers 126 lock the ferrules 136. Therefore, the discharge tube 115 is secure from axial movement relative to the relay connectors 114. That is, if a force is applied to the discharge tube 115 so as to cause movement to the right, the stopper 126 catches the left-adjacent ferrule 136 attached on the left end portion of the discharge tube 115 so that the movement of the discharge tube 115 to the right is restricted. If a force is applied to the discharge tube 115 so as to cause movement to the left, the stopper 126 catches the right-adjacent ferrule 136 attached on the right end portion of the discharge tube 115 so that the movement of the discharge tube 115 to the left is restricted. Thus, the axial movement of the discharge tube 115 to either right or left is restricted, and therefore the tip of the outer lead 135 is secure from hitting the wall of the container room 123 on the opposite side of the escape opening 125.

The stopper 126 can engage with and lock the end edge of the ferrule 136, and therefore a hole that can engage with the stopper 126 is not required to be formed on the outer circumference of the ferrule 136. Thereby, processing cost can be reduced, and reduction in strength of the ferrule 136 can be prevented.

In the case of a construction in which a stopper 126 can engage with the end edge of a ferrule 136 on the side of the conductive portion 140, the conductive portion 140 extending from the end edge of the ferrule 136 may preclude the end edge of the ferrule 136 from engaging with the stopper 126, when the ferrule 136 is attached at some angle about its axis. However, in preferred embodiment 4, the stopper 126 is arranged to engage with the end edge on the opposite side of the conductive portion 140. Therefore, the conductive portion 140 will not preclude the ferrule 136 from engaging with the stopper 126, and consequently the ferrule 136 can infallibly engage with the stopper 126.

The conductive portion 140 includes a cylindrical portion 142, which can be circumferentially connected to the outer lead 135 so as to surround it. Thereby, the conductive portion 140 can be prevented from disengaging from the outer lead 135. That is, the cylindrical portion 142 will not disengage from the outer lead 135 when the cylindrical portion 142 is clamped. Therefore, the conductive portion 140 can be infallibly connected to the outer lead 135.

The margin for engagement of a ferrule 136 with a stopper 126 corresponds to half of the dimensional difference between the outer diameters of the glass tube 134 and the ferrule 136. In preferred embodiment 4, ferrules 136 are concentrically held on a glass tube 134 due to the elastic gripping portions 138A, 138B. Therefore, if the ferrule 136 is set to be large, a large dimensional difference can be secured between the inner diameter thereof and the outer diameter of the glass tube 134. Thereby, the margin for engagement of the ferrule 136 with the stopper 126 can be increased, resulting in reliable restriction of movement of the discharge tube 115.

The concave portion 127 is formed on a stopper 126, so as to abut on the outer circumference of a glass tube 134 when the ferrule 136 engages with the stopper 126. Further, the pair of elastic pressing portions 132 capable of pressing the discharge tube 115 toward the concave portion 127 side are provided in the relay connector 114. Specifically, the pair of elastic pressing portions 132 press the discharge tube 115 toward the concave portion 127 side, obliquely from above and obliquely from below, i.e., vertically symmetrically. Thereby, the glass tube 134 is prevented from disengaging from the concave portion 127, and therefore the engagement of the ferrule 136 with the stopper 126 can be reliably maintained.

The relay connector 114 is formed by mounting a relay terminal 131 in a holder 120 made of synthetic resin. In preferred embodiment 4, the stopper 126 is formed on the synthetic-resin holder 120. Therefore, a stopper is not required to be formed on the relay terminal 131, and thereby the material for manufacturing the relay terminals 131 can be reduced. Considering that the material cost for synthetic resin is generally lower than that for metal, the material cost for relay connectors 114 can be reduced according to preferred embodiment 4.

Preferred Embodiment 5

Next, preferred embodiment 5 of the present invention will be explained with reference to FIGS. 33 to 39. In preferred embodiment 5, the constructions of a structure arranged to support a discharge tube 115 differ from those of preferred embodiment 4. The other constructions are similar to preferred embodiment 4. Therefore, the same constructions are designated by the same symbols, and explanations for the constructions, operations and effects thereof are omitted.

Overview of Grounding Member 150

Figure 33:
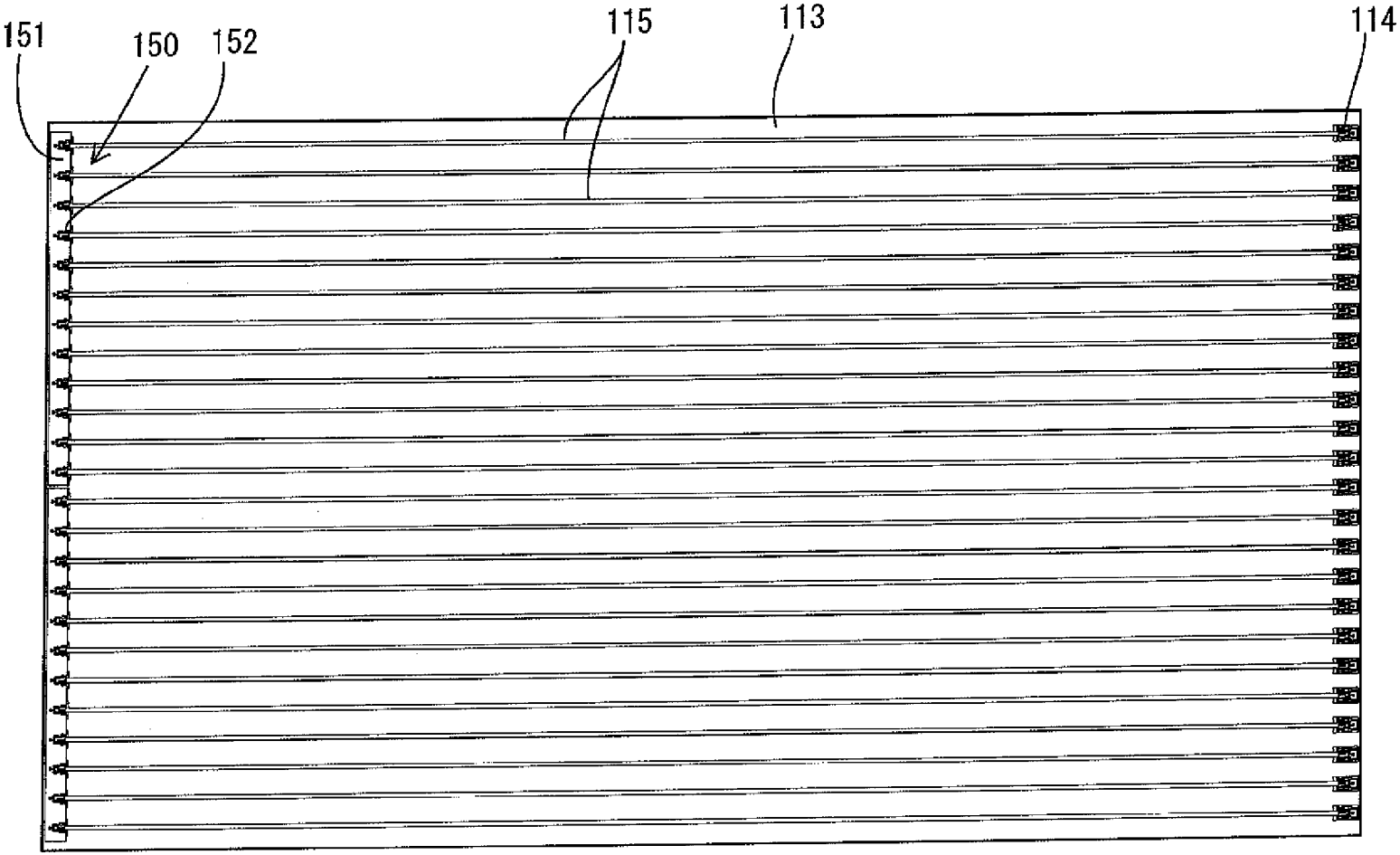
FIG. 33 is a front view of a lighting device according to preferred embodiment 5 of the present invention.
Figure 34:
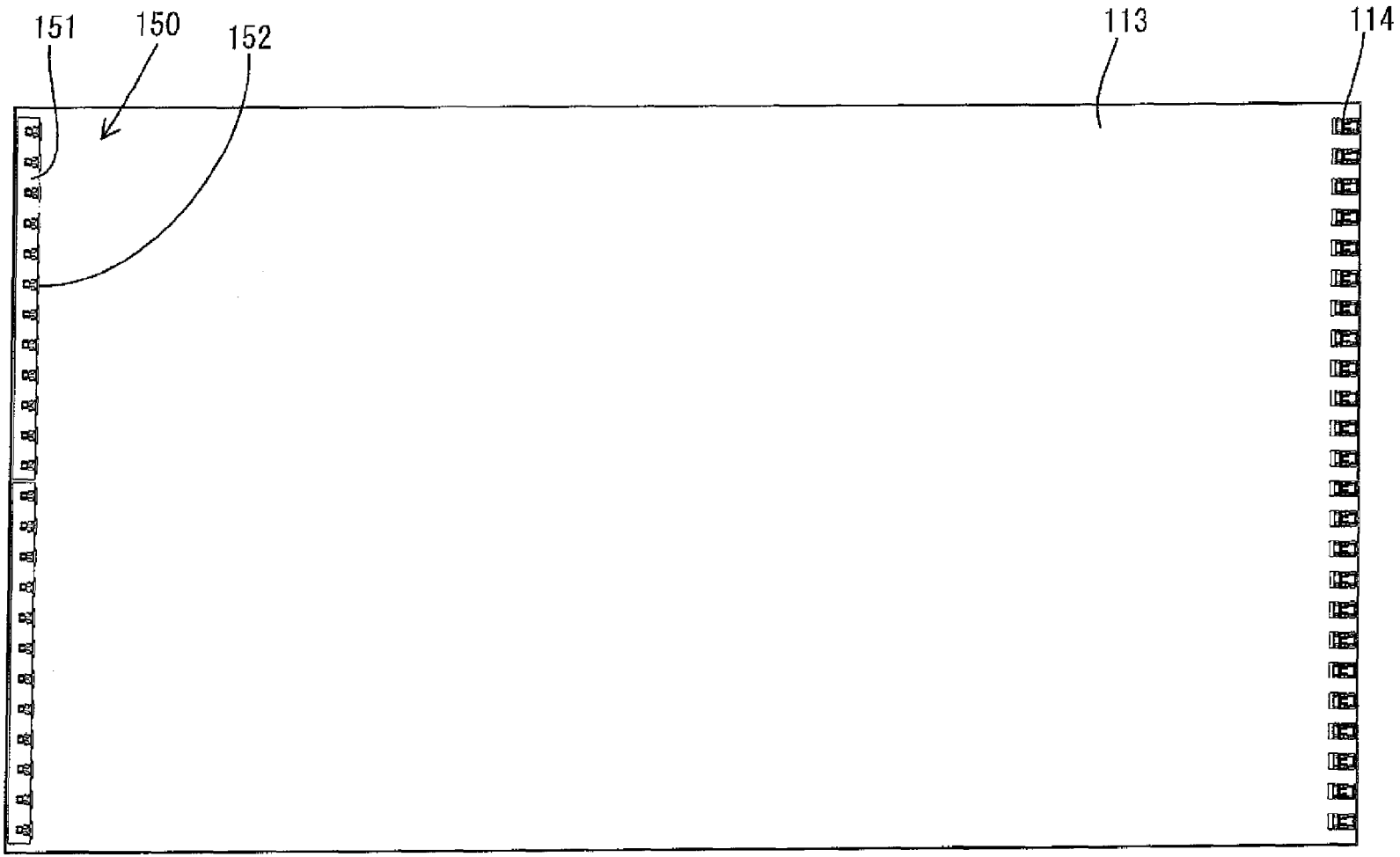
FIG. 34 is a front view showing the lighting device, from which discharge tubes are detached.
Figure 35:
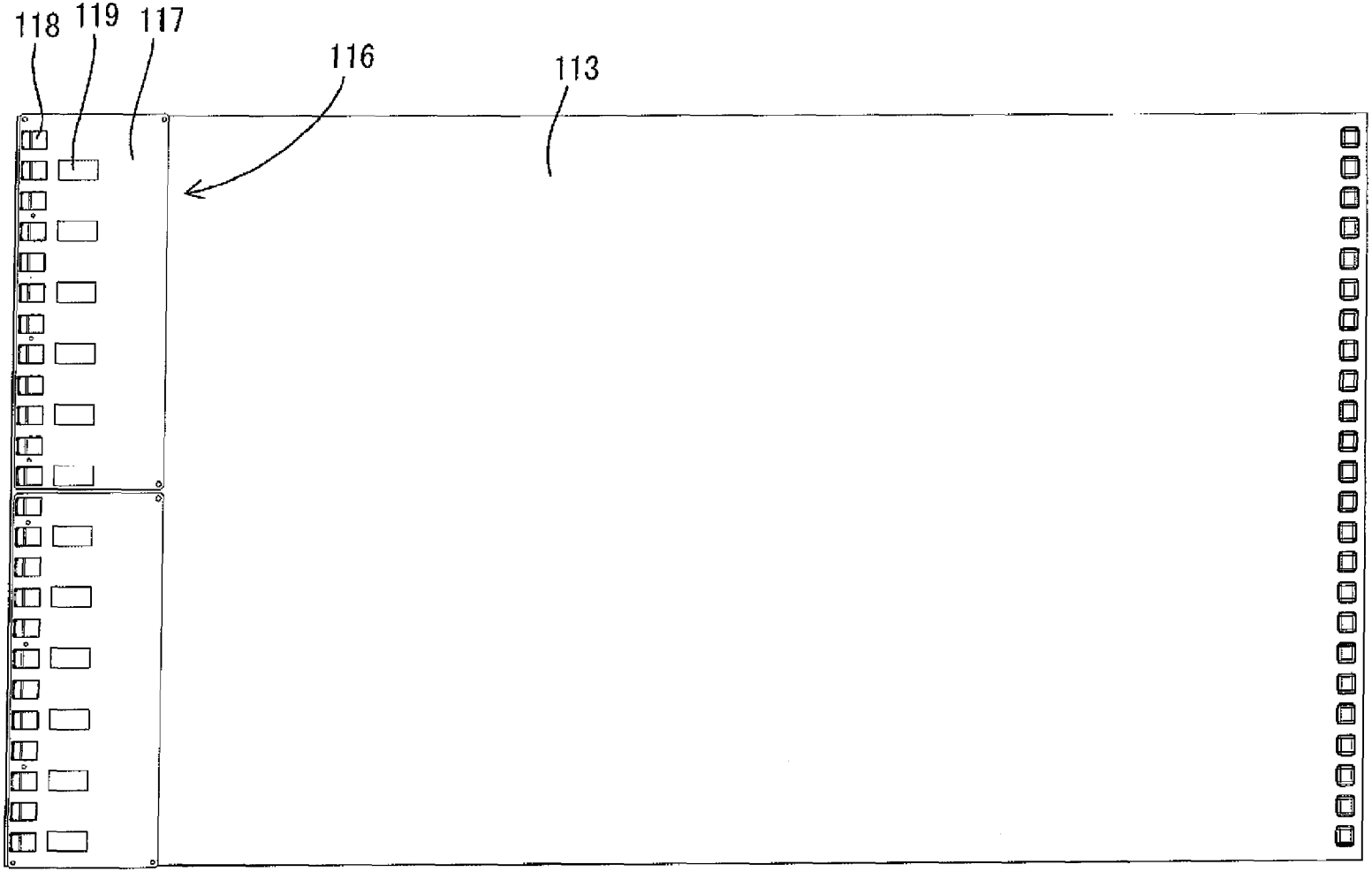
FIG. 35 is a rear view of the lighting device.

In preferred embodiment 4, the end portions of a discharge tube 115 are supported by relay connectors 114, each of which includes a holder 120 and a relay terminal 131. In preferred embodiment 5, as shown in FIGS. 33 and 34, one of the end portions of a discharge tube 115 is supported by the same relay connector 114 as preferred 4, while the other end portion of the discharge tube 115 is supported by a grounding member 150.

Figure 36:
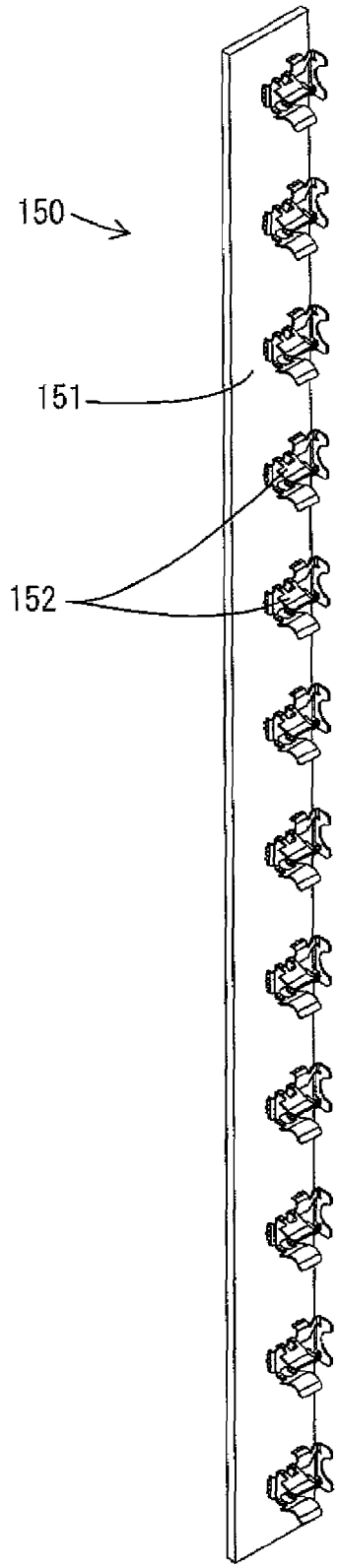
FIG. 36 is a perspective view of a grounding member.

As shown in FIG. 36, the grounding member 150 includes an elongated support plate 151 fixed to the chassis 113 so as to extend along one of the lateral edge portions thereof, and further includes a plurality of grounding terminals 152 conductively mounted on the front surface of the support plate 151. Mounting holes 151H are formed through the support plate 151 so as to correspond three-to-one with the grounding terminals 152. The support plate 151 is formed of a substrate or a metallic plate.

Figure 37:
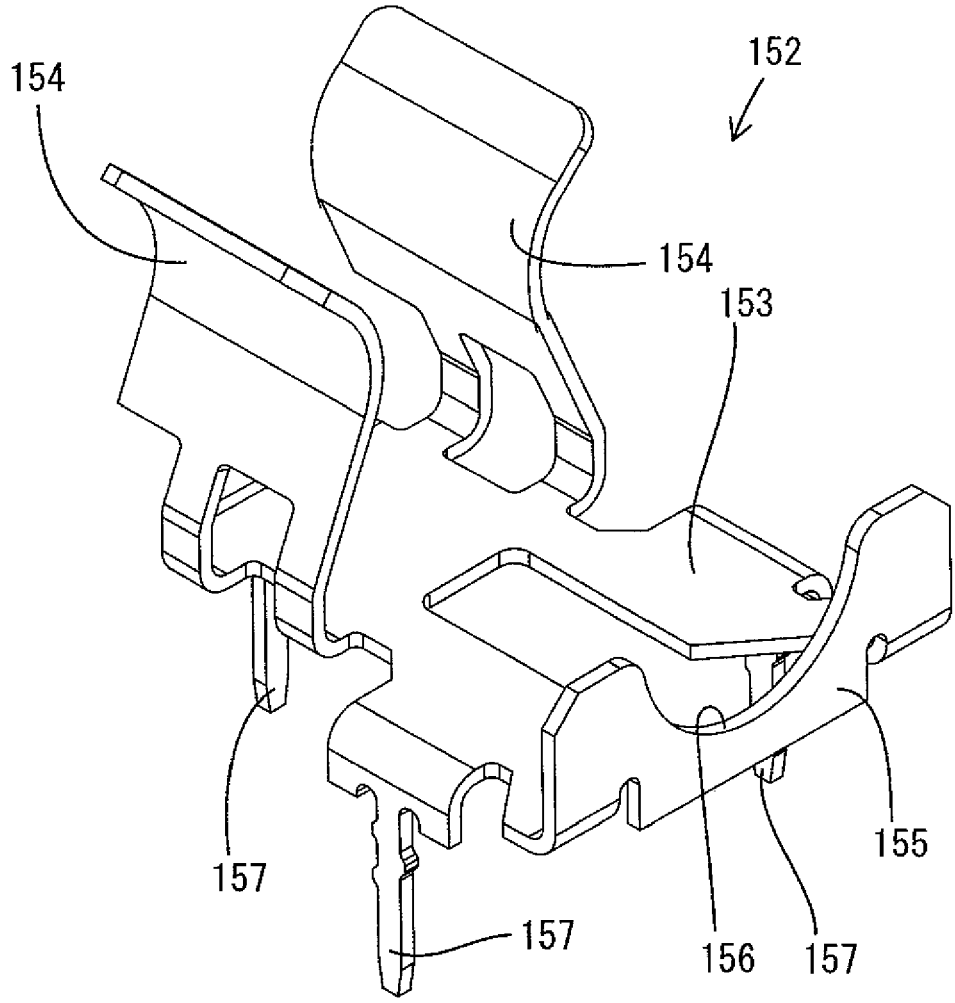
FIG. 37 is a perspective view of a grounding terminal.
Figure 38:
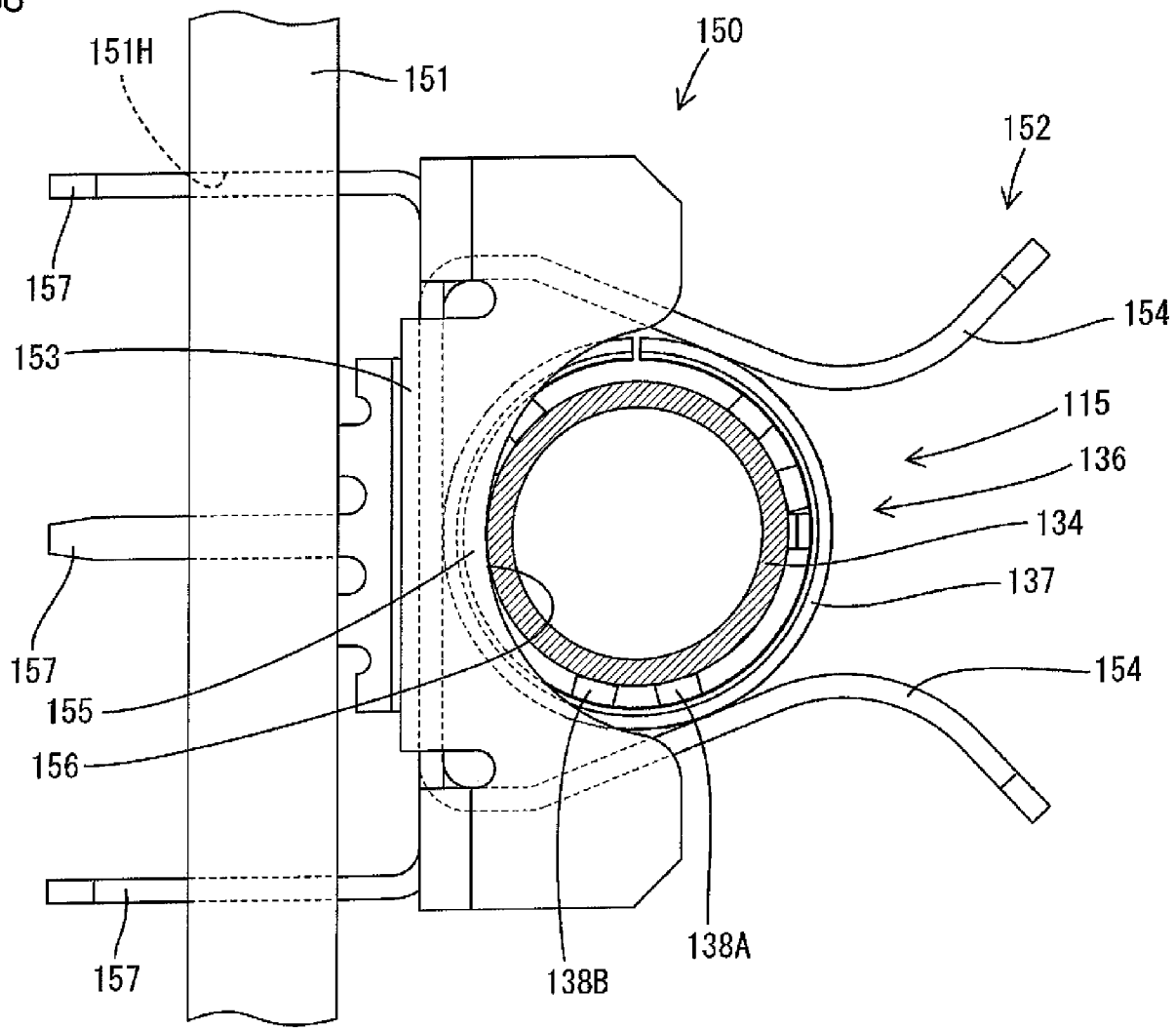
FIG. 38 is a sectional view showing that a ferrule on a discharge tube is capable of engaging with a stopper.
Figure 39:
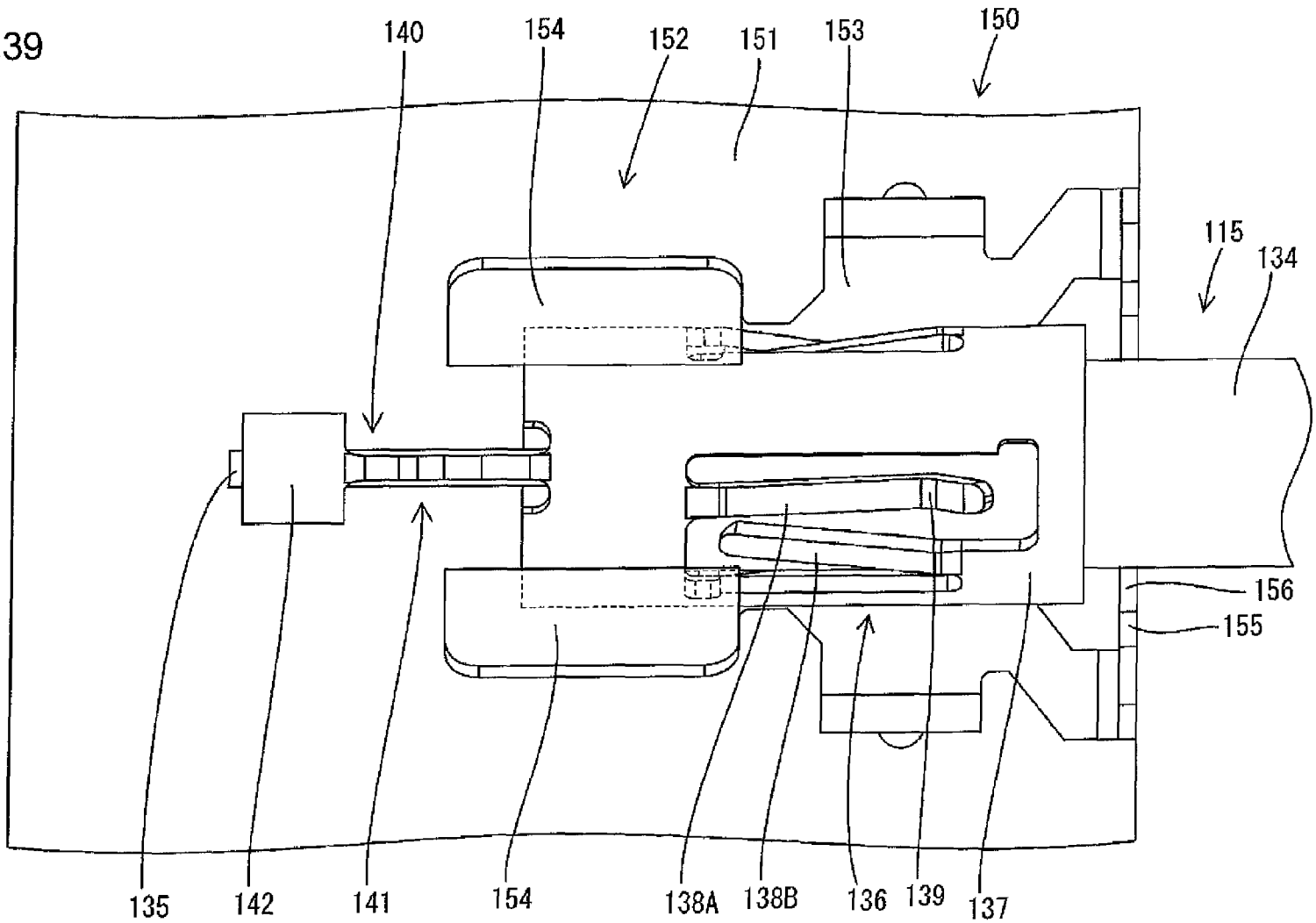
FIG. 39 is a partially-enlarged front view showing a connecting structure between a grounding terminal and a discharge tube.

On the other hand, as shown in FIGS. 37 and 38, each grounding terminal 152, which can be formed by bending a metallic (e.g., nickel silver) plate that is formed into a predetermined shape by punching, includes a base portion 153 and a pair of elastic pressing portions 154 which extend vertically symmetrically from the respective upper and lower edge portions of the base portion 153 to the front side. Further included is a stopper 155 (corresponding to a movement restricting portion of the present invention) that extends from one of the lateral edge portions of the base portion 153 to the front side.

The pair of elastic pressing portions 154 are provided on the lateral edge portion on the opposite side of the stopper 155, so as to form bulging curves toward each other. The elastic pressing portions 154 are capable of elastic deflection so as to increase the distance therebetween. The minimum distance between the pair of elastic pressing portions 154, when the elastic pressing portions 154 are free from elastic deflection, is preferably smaller than the outer diameter of the glass tube 134 of a discharge tube 115.

The stopper 155 is raised from the base portion 153, so as to form a right angle with the axis of the discharge tube 115. A concave portion 156 is formed on the stopper 155, so as to sag in a substantially circular arc. On a relay connector 114 of preferred embodiment 4, a pair of guiding portions 128 are raised from the respective upper and lower sides of the concave portion 127 of the stopper 126. However, in preferred embodiment 5, the heights of portions raised from the respective upper and lower sides of the concave portion 156 of the base portion 153 are reduced to be short. That is, elements corresponding the guiding portions 128 of preferred embodiment 4 are not provided. Therefore, metallic material required for grounding terminals 152 can be reduced, compared to including guiding portions.

Three leg portions 157 are further formed on the base portion 153, so as to be integrated therewith. Two of the three leg portions 157 are provided between the elastic pressing portions 154 and the stopper 155, so as to project from the respective upper and lower edge portions of the base portion 153 to the opposite side of the elastic pressing portions 154 or the stopper 155 (i.e., to the back side). The remaining one of the leg portions 157 is provided on the lateral edge of the base portion 153 on the opposite side of the stopper 155, so as to project from the intermediate position between the elastic pressing portions 154 to the opposite side of the elastic pressing portions 154 or the stopper 155 (i.e., to the back side).

The grounding terminal 152 is not housed in a member such as a plastic housing, i.e., barely provided, and is conductively fixed to the support plate 151 by soldering or the like so that its leg portions 157 penetrate through the mounting holes 151H (See FIG. 38). Thus, the plurality of grounding terminals 152 are mounted to the common support plate 151, and thereby are conductively connected to one another via the support plate 151. Power boards are not connected to the grounding members 150, and the support plate 151 is conductively connected to the chassis 113.

Mounting of Discharge Tube 115 to Grounding Terminal 152

When a discharge tube 115 is fixed to a grounding terminal 152, the discharge tube 115 held in a horizontal position is moved toward the front face of the chassis 113, and the end portion and the ferrule 136 of the glass tube 134 are fitted between the pair of upper and lower elastic pressing portions 154 from the front side. At the time, the pair of elastic pressing portions 154 are pushed by the body 137 of the ferrule 136 so as to open vertically due to elastic deflection. After the body 137 has passed through the shortest-distance portions of the pair of elastic pressing portions 154, the body 137 is pulled toward the base portion 153 side due to elastic restoring forces of the elastic pressing portions 154, resulting in the body 137 abutting on the base portion 153. Then, the fixation of the discharge tube 115 is completed. The other end portion of the discharge tube 115 is fixed to a relay connector 114 in a similar manner to preferred embodiment 4.

The discharge tube 115 thus mounted is supported by the relay connector 114 and the grounding member 150 at its respective end portions. The pairs of elastic pressing portions 132, 154 can have elastic contact with the outer circumferential surfaces of the bodies 137 of the ferrules 136, and thereby the outer leads 135 are electrically conductively connected to the relay terminal 131 and the grounding terminal 152 via the ferrules 136. Further, the glass tube 134 is held due to elastic restoring forces of the pairs of elastic pressing portions 132, 154, so as to be pressed against the concave portions 127, 156 of the stoppers 126, 155. Therefore, when viewed along the axial direction of the discharge tube 115, the body 137 appears to be positioned so as to partially overlap with the stopper 126 or 155. That is, the end edge of the body 137 on the opposite side of the conductive portion 140 is axially positioned in proximity to the stopper 126 or 155 so as to be partially faced therewith.

Figure 42:
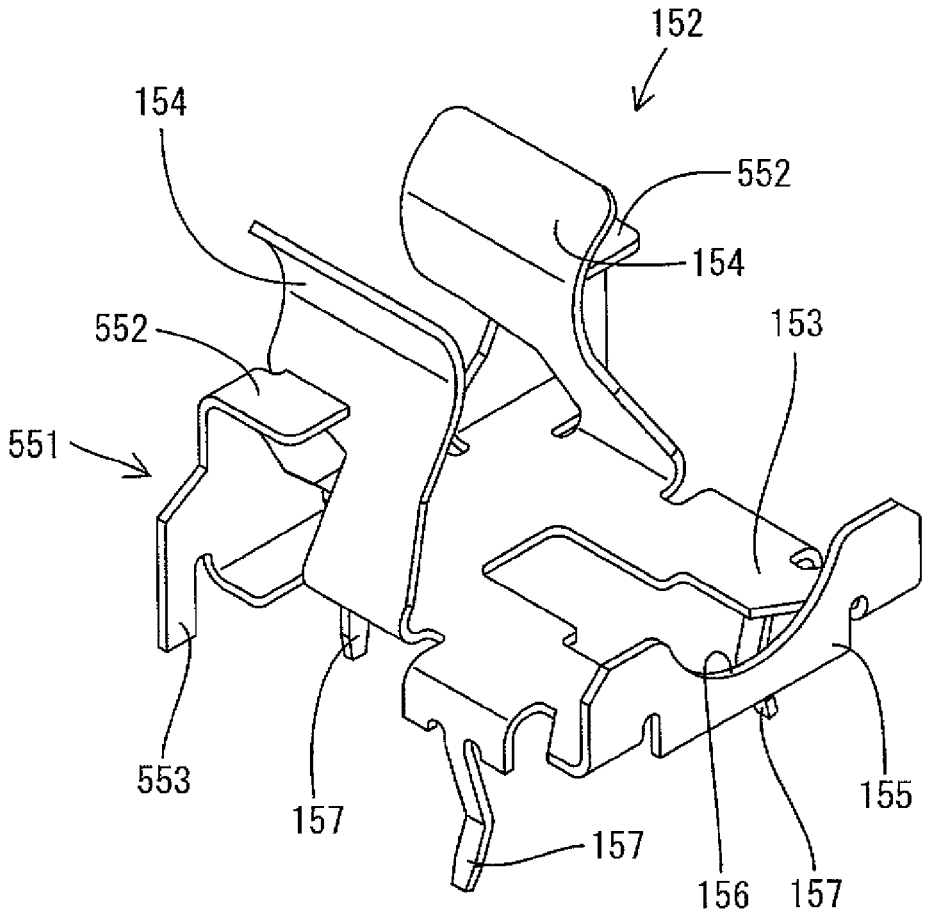
FIG. 42 is a perspective view of a grounding terminal.
Figure 43:
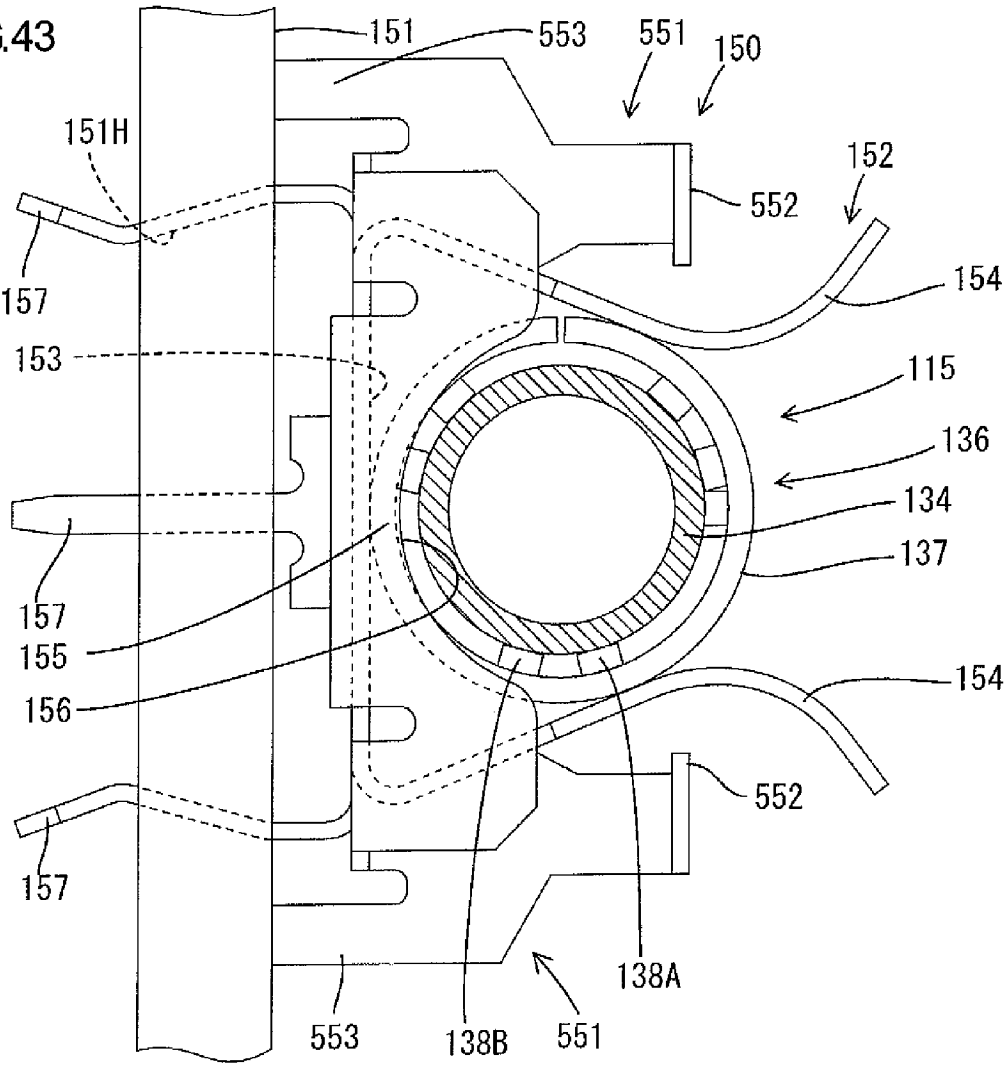
FIG. 43 is a sectional view showing a connection between a grounding terminal shown in FIG. 42 and a ferrule.

As shown in FIGS. 42 and 43, protector portions 551 may be provided on the grounding terminal 152. Each protector portion 551 includes a restricting portion 552 for an elastic pressing portion, and further includes an abutting portion 553 for abutting on the support plate. When the grounding terminal 152 is mounted and fixed to the support plate 151, the abutting portions 553 abut on or are located close to the support plate 151. If some kind of external force is applied to the elastic pressing portions 154 so that they are pushed to open, they first become in contact with the restricting portions 552 during the course of opening. The abutting portions 553 serve as supports for preventing the protector portions 551 from collapsing, when an additional load is thereafter applied. The protector portions 551 are connected to the feet of the elastic pressing portions 154, and therefore the abutting portions 553 should be formed lateral to the connection portion in order that the abutting portions 553 work. Note that abutting portions 553 located at a longer distance from the connection portion are more effective.

Operational Effects of Preferred Embodiment 5

In preferred embodiment 5, when a discharge tube 115 is supported on a relay connector 114 and a grounding member 150, the stopper 126 of the holder 120 and the stopper 155 of the grounding terminal 152 lock the ferrules 136 on the respective ends of the discharge tube 115. Therefore, the discharge tube 115 is prevented from axially moving relative to the relay connector 114.

That is, if a force is applied to the discharge tube 115 so as to cause movement from the relay connector 114 side to the grounding member 150 side, the ferrule 136 attached on the end portion of the discharge tube 115 on the relay connector 114 side is caught by the stopper 126 of the holder 120 so that the movement of the discharge tube 115 to the grounding member 150 side is restricted. If a force is applied to the discharge tube 115 so as to cause movement from the grounding member 150 side to the relay connector 114 side, the ferrule 136 attached on the end portion of the discharge tube 115 on the grounding member 150 side is caught by the stopper 155 of the grounding terminal 152 so that the movement of the discharge tube 115 to the relay connector 114 side is restricted. Thus, the axial movement of the discharge tube 115 to either right or left is restricted, and therefore the tip of the outer lead 135 is secure from hitting the wall of the container room 123 on the opposite side of the escape opening 125 or hitting the sidewall of the chassis 113.

The concave portion 156 is formed on the stopper 155 of a grounding terminal 152, so as to abut on the outer circumference of a glass tube 134 when the ferrule 136 is engaged with the stopper 155. Further, the pair of elastic pressing portions 154 capable of pressing the discharge tube 115 toward the concave portion 156 side are provided on the grounding terminal 152. Specifically, the pair of elastic pressing portions 154 press the discharge tube 115 toward the concave portion 156 side, obliquely from above and obliquely from below, i.e., vertically symmetrically. Thereby, the glass tube 134 is prevented from disengaging from the concave portion 156, and therefore the engagement of the ferrule 136 with the stopper 155 can be reliably maintained.

On the grounding member 150, the stoppers 155 are integrated with the respective grounding terminals 152 to provide conductive connection to the ferrules 136. Thereby, the number of components can be reduced in preferred embodiment 5, compared to including stoppers provided as separate members from the grounding terminals.

The plurality of discharge tubes 115 are short-circuited through the grounding member 150 connected to the ferrule 136 attached on the end of each discharge tube 115, and are collectively grounded. The plurality of grounding terminals 152 of the grounding member 150 are not required to be insulated from one another. Therefore, insulating members, which surround the grounding terminals 152 for insulation purposes or separate the grounding terminals 152, are not necessary. That is, the number of components can be reduced in the present preferred embodiment, compared to a construction in which each discharge tube 115 connected to relay connectors 114 at both end portions thereof is separately grounded.

Other Preferred Embodiments

The present invention is not limited to the preferred embodiments explained in the above description made with reference to the drawings. The following preferred embodiments may be included in the technical scope of the present invention, for example.

The discharge tube is not limited to a cold cathode fluorescent tube. A hot cathode fluorescent tube, a xenon tube or the like may be used instead.

The display panel of the display device is not limited to having TFTs as switching elements, but rather may include, as switching elements, elements other than TFTs such as MIM (Metal Insulator Metal) elements.

The display device is not limited to a liquid crystal display device. Various display devices requiring a lighting device on the back side of a display panel can be included.

As elements for absorbing the displacement of relay terminals from output terminals, relay terminals having an elongated shape substantially perpendicular to the array direction of the on-board connectors, and output terminals having a plate-shaped configuration that is parallel or substantially parallel to the array direction may be provided.

The mounting direction of the discharge tube to the relay connectors and the mounting direction of the on-board connectors to the relay connectors are not limited to being parallel to each other. For example, the mounting direction of the discharge tube to the relay connectors may be substantially parallel to the surface of the chassis, while the mounting direction of the on-board connectors to the relay connectors is substantially perpendicular to the surface of the chassis. Conversely, the mounting direction of the on-board connectors to the relay connectors may be substantially parallel to the surface of the chassis, while the mounting direction of the discharge tube to the relay connectors is substantially perpendicular to the surface of the chassis.

The connecting portion provided on the relay connector for connection to the power board is not limited to being formed as a protrusion, but rather may be formed as a recess. In this case, the connecting portions provided on the power board for connection to the relay connectors should be formed as protrusions.

The output terminal may be formed into a predetermined shape simply by punching a metallic material, without bending.

The power source is not limited to a power board that includes electronic components mounted on a circuit board, but rather may be provided by connecting electronic components by wires without using a circuit board.

The structure for bearing the body of a ferrule is not limited to a relay connector. The ferrule may be directly (i.e., without using a relay connector) fixed to a connector (e.g., an inverter connector) directly mounted on the power board. Alternatively, a dedicated bearing element, to which the ferrule is fixed, may be provided separately from the power supply path formed between the power source and the outer lead.

The on-board connectors may be eliminated from a circuit board, so that the relay connectors are connected to the power source (or power board) via cables.

The holder may be fixed to the chassis by screws or press fitting, without using elastic retaining portions.

One elastic retaining portion may be provided, or alternatively, three or more elastic retaining portions may be provided.

The holder may be mounted to the chassis from the back side.

The tube connecting portion may be arranged to be exposed to the outside of the holder, instead of being arranged within the container room.

The on-board connectors of the power source may be mounted on the chassis-side surface or front surface of the circuit board.

The board connecting portion may be formed of a female component (i.e., a component having a concave shape).

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. A relay connector to be arranged to supply power from a power source arranged on a back side of a chassis having substantially a plate-like shape to a discharge tube arranged on a front side of said chassis, said relay connector comprising:

a holder having an insulation property and to be mounted to said chassis; and a relay terminal mounted to said holder and capable of electrical connection to said discharge tube and said power source, wherein:

said power source includes an on-board connector mounted on a back surface of a circuit board that is to be arranged parallel to said chassis so that the back surface is on an opposite side of said chassis, and further includes an output terminal arranged in an engaging recess that is formed on said on-board connector so as to correspond to a fitting hole formed through said circuit board;

a wall portion, capable of projecting to the back side of said chassis and penetrating through said fitting hole so as to be inserted into said engaging recess, is provided on said holder; and a board connecting portion capable of connection to said output terminal is provided on said relay terminal so as to extend along said wall portion.

2. A relay connector as in claim 1, wherein:

said holder is capable of being arranged to penetrate through a mounting hole of said chassis;

an elastic retaining part capable of elastic deflection and an engaging surface capable of being arranged to be substantially perpendicular to a through direction of said mounting hole are provided on an outer surface of said holder; and said holder is capable of being fixed to said chassis while said chassis is sandwiched between said elastic retaining part and said engaging surface.

3. A relay connector as in claim 2, wherein a travel restricting portion, capable of abutting on an opening edge of said mounting hole when said holder is mounted to said chassis, is provided on an outer surface of said holder on which said elastic retaining part is formed.

4. A relay connector as in claim 2, wherein a surface of said elastic retaining part, which is capable of abutting on an opening edge of said mounting hole, is formed of an inclined surface capable of being arranged at an angle to a thickness direction of said chassis.

5. A relay connector as in claim 1, wherein:

a container room capable of holding an end portion of said discharge tube is provided in said holder;

a tube connecting portion of said relay terminal is arranged in said container room; and said tube connecting portion is capable of being electrically connected to said discharge tube within said container room.

6. A relay connector as in claim 5, wherein:

a mounting direction of said discharge tube to said container room is set to be perpendicular to an axis of said discharge tube, and a ferrule attached to the end portion of said discharge tube is held in said container room when said discharge tube is mounted; and a movement restricting portion, capable of locking said ferrule so that axial movement of said discharge tube in a direction away from said container room is restricted, is provided in said container room.

7. A relay connector as in claim 5, wherein an extended portion, capable of being arranged to protrude from between said chassis and an opening edge of said container room and extend along a surface of said chassis, is provided on an outer surface of said holder that is arranged perpendicularly to the surface of said chassis and includes an opening of said container room.

8. A relay connector as in claim 5, wherein a tapered guiding portion, inclined from a mounting direction of said discharge tube, is provided on said holder, so as to extend from an opening edge of an opening provided as a receiving opening of said container room for receiving said discharge tube.

9. A relay connector as in claim 1, wherein:

said relay terminal is capable of being connected to said output terminal when said relay terminal is inserted into said engaging recess; and said relay terminal when being fitted into said engaging recess is capable of displacement caused by movement, and a connection between said relay terminal and said output terminal is maintained at a time of said displacement.

10. A relay connector as in claim 9, wherein said relay terminal when being fitted into said engaging recess is capable of displacement caused by movement in an inserting direction thereof into said engaging recess, and a connection between said relay terminal and said output terminal is maintained at a time of said displacement in the inserting direction.

11. A relay connector as in claim 1, wherein said relay terminal is arranged so that a distal end of said relay terminal or a distal end of the wall portion is prevented from contact with a far end of said engaging recess at a time of insertion into said engaging recess.

12. A relay connector as in claim 1, wherein an insertion restricting portion is provided on said holder, so as to abut on said board at a time of insertion into said engaging recess.

13. A relay connector as in claim 1, wherein:

said output terminal includes a proximal portion arranged so that its displacement from said circuit board is restricted, a flexible portion extending from said proximal portion and being capable of elastic deflection, and a connecting part having substantially a U-shape that extends from said flexible portion and is capable of elastically pinching said wall portion and said board connecting portion;

said board connecting portion when being inserted into said engaging recess is capable of elastic contact with a free-end-side strip portion of two strip portions of said connecting part on an opposite side of said flexible portion, while said wall portion is capable of elastic contact with a strip portion of the two strip portions of said connecting part on a side of said flexible portion.

14. A relay connector as in claim 1, wherein:

said output source includes a plurality of output terminals which are arranged in a line on a circuit board so as to correspond to a plurality of relay terminals as said relay terminal, and said output terminal includes a connecting part that is elongated in a direction substantially perpendicular to an array direction of said relay terminals and said output terminals;

a board connecting portion, having a plate-like shape wider than said connecting part and capable of being arranged parallel to the array direction of said relay terminals and said output terminals, is provided on said relay terminal; and said board connecting portion is capable of contact with said connecting part.

15. A relay connector as in claim 1, wherein a tube engaging portion arranged to allow said discharge tube to enter therein after approaching along a direction substantially perpendicular to a surface of said chassis, and a power engaging portion arranged to allow an on-board connector of said power source to engage therewith after approaching along a direction substantially perpendicular to the surface of said chassis are provided on said holder.

16. Amounting structure of a relay connector and a power source, said relay connector being arranged to supply power from said power source arranged on a back side of a chassis having substantially a plate-like shape to a discharge tube arranged on a front side of said chassis;

said mounting structure, wherein:

said power source includes an on-board connector mounted on a back surface of a circuit board that is to be arranged parallel to said chassis so that the back surface is on an opposite side of said chassis, and further includes an output terminal arranged in an engaging recess that is formed on said on-board connector so as to correspond to a fitting hole formed through said circuit board;

said relay connector includes a holder having an insulation property and to be mounted to said chassis, and further includes a relay terminal mounted to said holder and capable of electrical connection to said discharge tube and said power source;

a wall portion, capable of projecting to the back side of said chassis and penetrating through said fitting hole so as to be inserted into said engaging recess, is provided on said holder; and a board connecting portion capable of connection to said output terminal is provided on said relay terminal, so as to extend along said wall portion.

17. Amounting structure of a relay connector and a power source, as in claim 16, wherein:

said output terminal includes a proximal portion arranged so that its displacement from said circuit board is restricted, a flexible portion extending from said proximal portion and being capable of elastic deflection, and a connecting part having substantially a U-shape that extends from said flexible portion and is capable of elastically pinching said wall portion and said board connecting portion; and said board connecting portion when being inserted into said engaging recess has elastic contact with a free-end-side strip portion of two strip portions of said connecting part on an opposite side of said flexible portion, while said wall portion has elastic contact with a strip portion of the two strip portions of said connecting part on a side of said flexible portion.

18. Amounting structure of a relay connector and a power source, as in claim 16, wherein:

said power source includes a plurality of output terminals as said output terminal, which are arranged in a line on said circuit board so as to correspond to a plurality of relay terminals as said relay terminal;

said output terminal includes a connecting part that is elongated in a direction substantially perpendicular to an array direction of said relay terminals and said output terminals;

said board connecting portion has a plate-like shape wider than said connecting part and arranged parallel to the array direction of said relay terminals and said output terminals; and said board connecting portion has contact with said connecting part.

19. A mounting structure of a discharge tube and a power source on a relay connector, used to mount said discharge tube and said power source to said relay connector that is arranged to supply power from said power source arranged on a back side of a chassis having substantially a plate-like shape to said discharge tube arranged on a front side of said chassis; said mounting structure, wherein:

said relay connector includes a holder having an insulation property and to be mounted to said chassis, and further includes a relay terminal mounted to said holder and capable of electrical connection to said discharge tube and said power source; and a tube engaging portion arranged to allow said discharge tube to enter therein after approaching along a direction substantially perpendicular to a surface of said chassis, and a power engaging portion arranged to allow an on-board connector of said power source to engage therewith after approaching along a direction substantially perpendicular to the surface of said chassis are provided on said holder.

20. A lighting device for a display device comprising:

a chassis having substantially a plate-like shape;

a discharge tube arranged on a front side of said chassis;

a power source arranged on a back side of said chassis; and a relay connector to supply power from said power source, said relay connector including a holder having an insulation property and to be mounted to said chassis and a relay terminal mounted to said holder and capable of electrical connection to said discharge tube and said power source, wherein:

said power source includes an on-board connector mounted on a back surface of a circuit board that is to be arranged parallel to said chassis so that the back surface is on an opposite side of said chassis, and further includes an output terminal arranged in an engaging recess that is formed on said on-board connector so as to correspond to a fitting hole formed through said circuit board;

a wall portion, capable of projecting to the back side of said chassis and penetrating through said fitting hole so as to be inserted into said engaging recess, is provided on said holder; and a board connecting portion capable of connection to said output terminal is provided on said relay terminal so as to extend along said wall portion.

21. A display device comprising the lighting device as in claim 20, and a display panel arranged on a front side of said lighting device.

22. A television receiver comprising the display device as in claim 21.

* * * * *